US010351288B2

(12) United States Patent
Hirose et al.

(10) Patent No.: US 10,351,288 B2
(45) Date of Patent: Jul. 16, 2019

(54) PAPER SHEETS PRE-PROCESSING APPARATUS

(71) Applicant: Kabushiki Kaisha Toshiba, Tokyo (JP)

(72) Inventors: Kenichi Hirose, Kanagawa (JP); Kazuhiro Mukai, Kanagawa (JP); Masahiro Nagao, Kanagawa (JP); Junichi Inoue, Kanagawa (JP); Toshinori Utsugi, Tokyo (JP); Osamu Maruyama, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 610 days.

(21) Appl. No.: 15/061,684

(22) Filed: Mar. 4, 2016

(65) Prior Publication Data

US 2016/0264278 A1 Sep. 15, 2016

(30) Foreign Application Priority Data

Mar. 13, 2015 (JP) ..... 2015-050595

(51) Int. Cl.
*B65B 69/00* (2006.01)
*B65B 63/02* (2006.01)
*B65B 65/00* (2006.01)

(52) U.S. Cl.
CPC ..... *B65B 69/0025* (2013.01); *B65B 63/02* (2013.01); *B65B 65/003* (2013.01); *B65B 69/00* (2013.01)

(58) Field of Classification Search
CPC ..... B65B 69/0025; B65B 63/02; B65B 69/00; B65B 65/003

(Continued)

(56) References Cited

U.S. PATENT DOCUMENTS 2,741,885 A * 4/1956 Allison ..... B29C 65/7433 100/17
4,404,723 A * 9/1983 Ohba ..... B65B 69/0025 225/103

(Continued)

FOREIGN PATENT DOCUMENTS

DE 102006014827 A1 10/2007
DE 102008032368 A1 1/2010

(Continued)

OTHER PUBLICATIONS

Search Report issued in related European Application No. 16158725.8, dated Jul. 15, 2016 (8 pages).

*Primary Examiner* — Andrew M Tecco
*Assistant Examiner* — Nicholas Igbokwe
(74) *Attorney, Agent, or Firm* — Baker Botts L.L.P.

(57) ABSTRACT

A paper sheets pre-processing apparatus of an embodiment includes a large band remover, a small bundle coupler, a small band remover and an accumulator. The large band remover conveys a bundle in which a plurality of paper sheets are bound by small bands and a predetermined number of small bundles are bound by a large band, and removes the large band from the bundle. The small bundle coupler conveys the predetermined number of small bundles included in the bundle from which the large band is removed by the large band remover, and couples the predetermined number of small bundles to each other. The small band remover separates a single small bundle from the small bundles coupled by the small bundle coupler and removes the small band from the small bundle. The accumulator accumulates the paper sheets from which the small band is removed by the small band remover.

6 Claims, 46 Drawing Sheets

(58) Field of Classification Search
USPC ..... 53/551–552, 381.1; 83/935
See application file for complete search history.

(56) References Cited

U.S. PATENT DOCUMENTS

| | | | | | |
|---|---|---|---|---|---|
| 4,414,730 | A * | 11/1983 | Ohmura | G07D 11/00 | 209/534 |
| 4,553,312 | A * | 11/1985 | Mitzel | B65B 69/0025 | 29/33.52 |
| 4,586,232 | A * | 5/1986 | Ohmura | B65B 69/0025 | 209/534 |
| 4,722,443 | A * | 2/1988 | Maruyama | B65H 39/00 | 209/534 |
| 4,817,260 | A | 4/1989 | Martin | | |
| 4,845,917 | A * | 7/1989 | Omura | G07D 11/0084 | 53/53 |
| 4,870,807 | A * | 10/1989 | Palamides | B65B 27/08 | 53/528 |
| 5,022,531 | A * | 6/1991 | Horino | B65B 27/08 | 209/534 |
| 5,044,937 | A * | 9/1991 | Lisa | B65B 69/0025 | 432/5 |
| 5,074,739 | A * | 12/1991 | Takahashi | B65B 69/0025 | 414/412 |
| 5,090,573 | A * | 2/1992 | Takahashi | B65B 69/0025 | 209/534 |
| 5,156,516 | A * | 10/1992 | Boisseau | B65B 69/0025 | 29/33.52 |
| 5,507,615 | A * | 4/1996 | Uno | B65G 57/035 | 198/431 |
| 5,970,834 | A | 10/1999 | Garofano et al. | | |
| 6,098,373 | A * | 8/2000 | Ashikawa | B65B 69/0025 | 53/381.2 |
| 7,516,601 | B2 * | 4/2009 | Horiuchi | B65B 27/08 | 53/540 |
| 2011/0100175 | A1 | 5/2011 | Freudenberg et al. | | |
| 2014/0259594 | A1 * | 9/2014 | Pienta | B65B 69/0025 | 29/407.01 |

FOREIGN PATENT DOCUMENTS

| | | | |
|---|---|---|---|
| EP | 0945352 | A1 | 9/1999 |
| JP | 02-180133 | A | 7/1990 |
| JP | 2003-109066 | A | 4/2003 |
| JP | 2003-192172 | A | 7/2003 |
| JP | 2011123847 | A | 6/2011 |

* cited by examiner

PAPER SHEETS PRE-PROCESSING APPARATUS

CROSS-REFERENCE TO RELATED APPLICATION

This application is based upon and claims the benefit of priority from Japanese Patent Application No. 2015-050595, filed Mar. 13, 2015, the entire contents of which are incorporated herein by reference.

FIELD

Embodiments described herein relate generally to a paper sheets pre-processing apparatus.

BACKGROUND

In order to inspect paper sheets loaded by a bundle unit in which a plurality of paper sheets are bound by small bands and the small bundles are arranged and bound in a predetermined number by a large band using a paper sheets inspection apparatus for every sheet, pre-processing of removing the large band and then removing the small bands should be performed. However, since the manpower of an operator is required for removal of the large band and removal of the small bands, much time and effort is required to input the paper sheets into a main body processing apparatus for the paper sheets. In order to solve this problem, the present invention provides a paper sheets pre-processing apparatus capable of reducing the burden in pre-processing of paper sheets.

DETAILED DESCRIPTION

A paper sheets pre-processing apparatus of an embodiment includes a large band remover, a small bundle coupler, a small band remover and an accumulator. In the large band remover, a bundle in which a plurality of paper sheets are bound by small bands and a predetermined number of small bundles are bound by a large band is moved, and the large band is removed from the bundle. The small bundle coupler conveys the predetermined number of small bundles included in the bundle from which the large band is removed by the large band remover along a conveyance path, and couples the predetermined number of small bundles to each other. The small band remover separates a single small bundle from the plurality of small bundles coupled by the small bundle coupler and removes the small band from the small bundle. The accumulator accumulates the plurality of paper sheets from which the small band is removed by the small band remover in a thickness direction of the paper sheets.

Hereinafter, a paper sheets pre-processing apparatus of an embodiment will be described with reference to the accompanying drawings. Further, while the following embodiment describes a paper sheets pre-processing apparatus 5, the paper sheets pre-processing apparatus 5 functions as a paper sheets pre-processing apparatus of the embodiment. Further, paper sheets P may be, for example, paper money but are not limited to the paper money.

Figure 1:
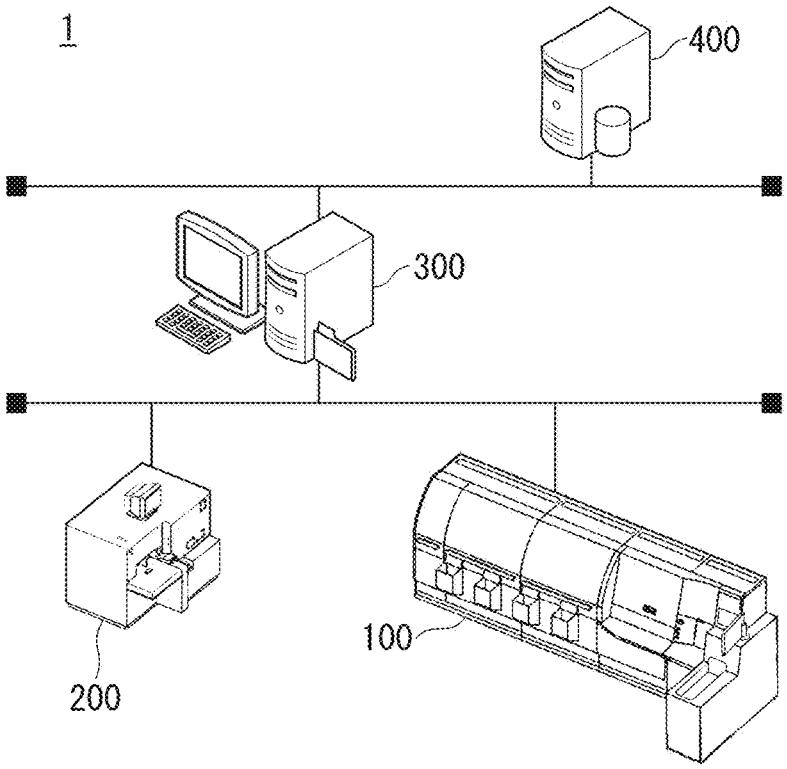
FIG. 1 is a configuration view of a paper sheets comparison system 1 of an embodiment.

First, a paper sheets comparison system 1 of the embodiment will be described. FIG. 1 is a configuration view of the paper sheets comparison system 1 of the embodiment. The paper sheets comparison system 1 includes at least one main body processing apparatus 100 of a paper sheets processing apparatus, a close inspection apparatus 200, a paper sheets comparison apparatus 300 and a host server 400. A paper sheets processing apparatus includes a paper sheets pre-processing apparatus 5 (to be described below), and the main body processing apparatus 100. The main body processing apparatus 100, the close inspection apparatus 200 and the paper sheets comparison apparatus 300 are connected to a network such as a local area network (LAN) or the like.

Figure 2:
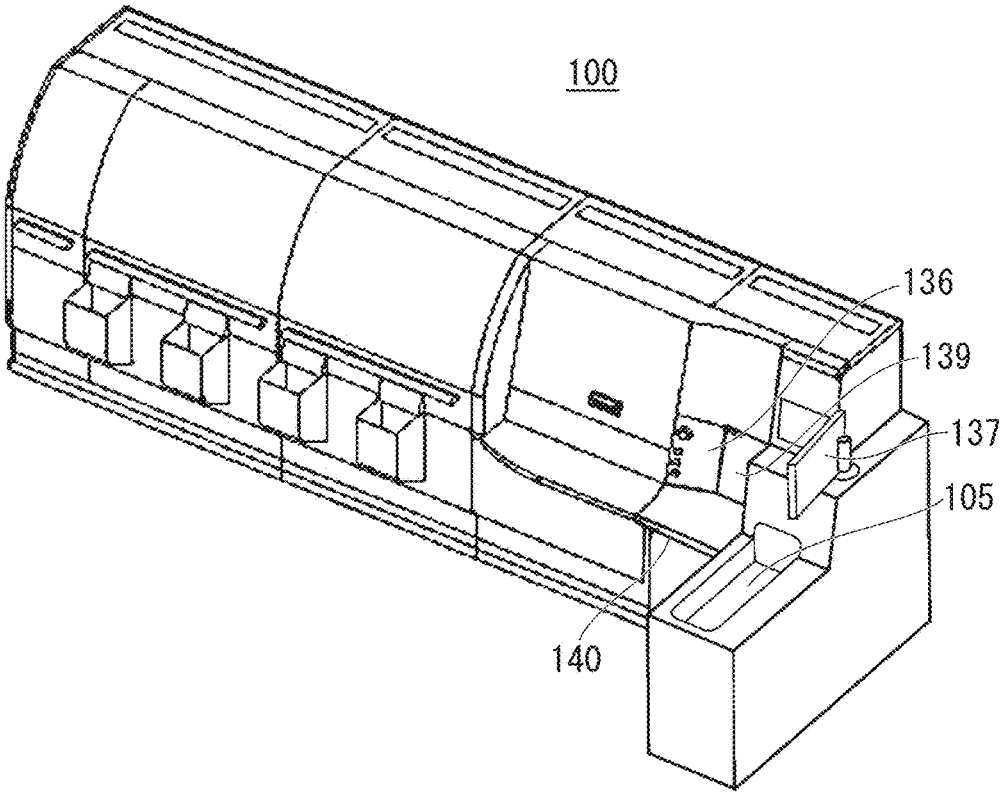
FIG. 2 is an exterior perspective view of a main body processing apparatus 100 in the paper sheets comparison system 1 of the embodiment.

FIG. 2 is an exterior perspective view of the main body processing apparatus 100. The main body processing apparatus 100 includes a paper sheets inputter 105, a manipulator 136, a manipulation display 137, an extractor 139 and a keyboard 140, outside the apparatus. The manipulator 136, the manipulation display 137 and the keyboard 140 are manipulated by an operator to arbitrarily set types of the paper sheets P (types of banknotes) processed by the main body processing apparatus 100. The paper sheets inputter 105 receives the paper sheets P supplied by the paper sheets pre-processing apparatus 5 (to be described below). Further, the paper sheets inputter 105 is not limited to the type shown in FIG. 2 but may include a feeder guide FG (to be described below). In addition, separated small bundles D and batch cards (BC-2) that are pre-processed by the paper sheets pre-processing apparatus 5 may be accumulated and input into the paper sheets inputter 105. The main body processing apparatus 100 ejects the plurality of accumulated paper sheets one by one and inspects the paper sheets one by one. The main body processing apparatus 100 excludes the paper sheets P in a predetermined condition among the plurality of paper sheets P based on inspection results as excluded sheets. The excluded paper sheets P can be ejected from the extractor 139.

The close inspection apparatus 200 more closely reinspects the sheets (the excluded sheets) excluded once by the main body processing apparatus 100 at a lower speed than the main body processing apparatus 100. The close inspection apparatus 200 transmits the reinspected result to the paper sheets comparison apparatus 300. The paper sheets comparison apparatus 300 stores small bundle information transmitted by the paper sheets pre-processing apparatus 5 and the inspection result of the main body processing apparatus 100 to correspond to the reinspected result of the close inspection apparatus 200. The host server 400 manages and accumulates the information obtained from the main body processing apparatus 100 or the close inspection apparatus 200 by the paper sheets comparison apparatus 300.

Figure 3:
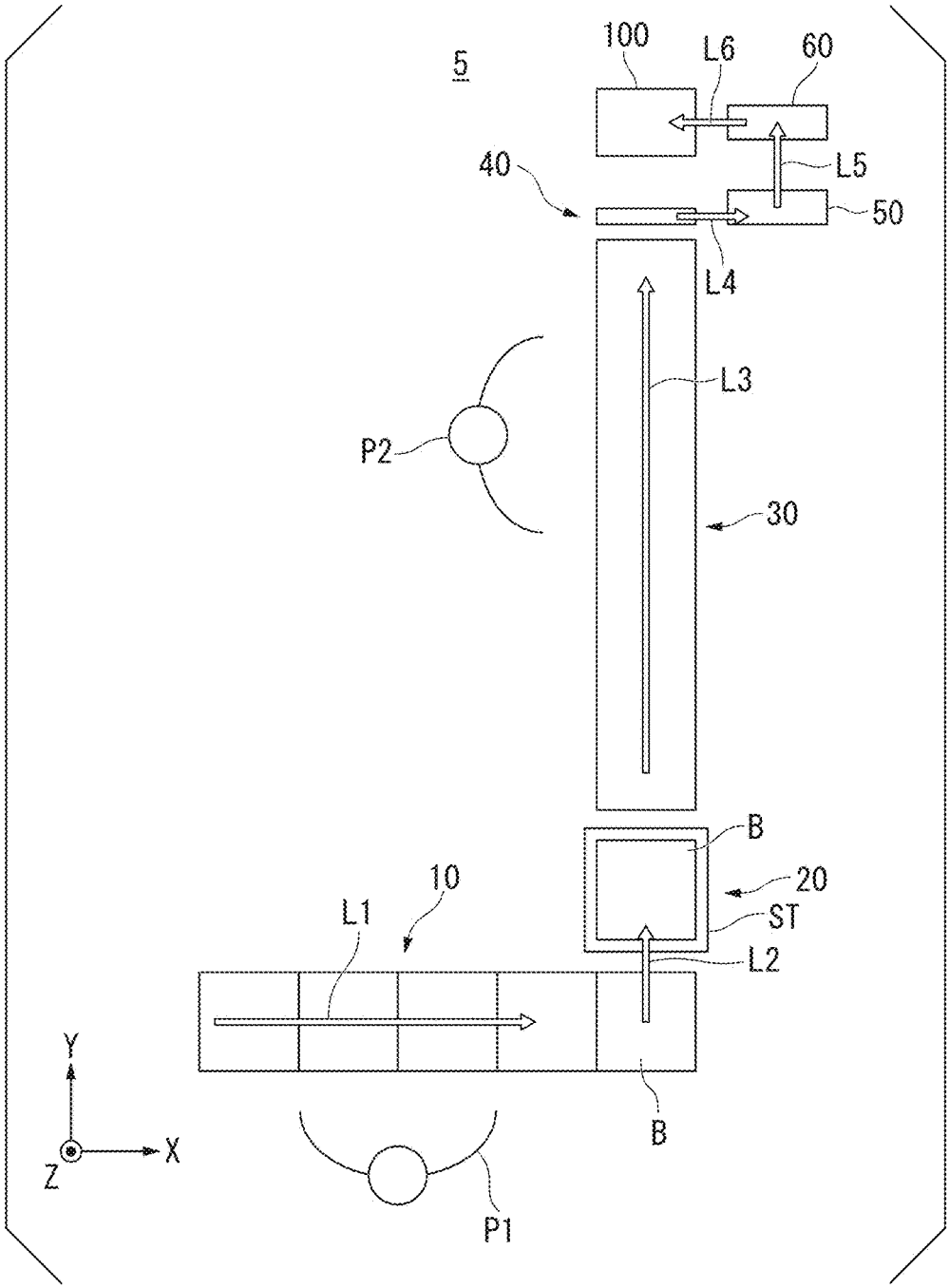
FIG. 3 is a schematic diagram showing a schematic configuration of a paper sheets pre-processing apparatus 5 of the embodiment.
Figure 4:
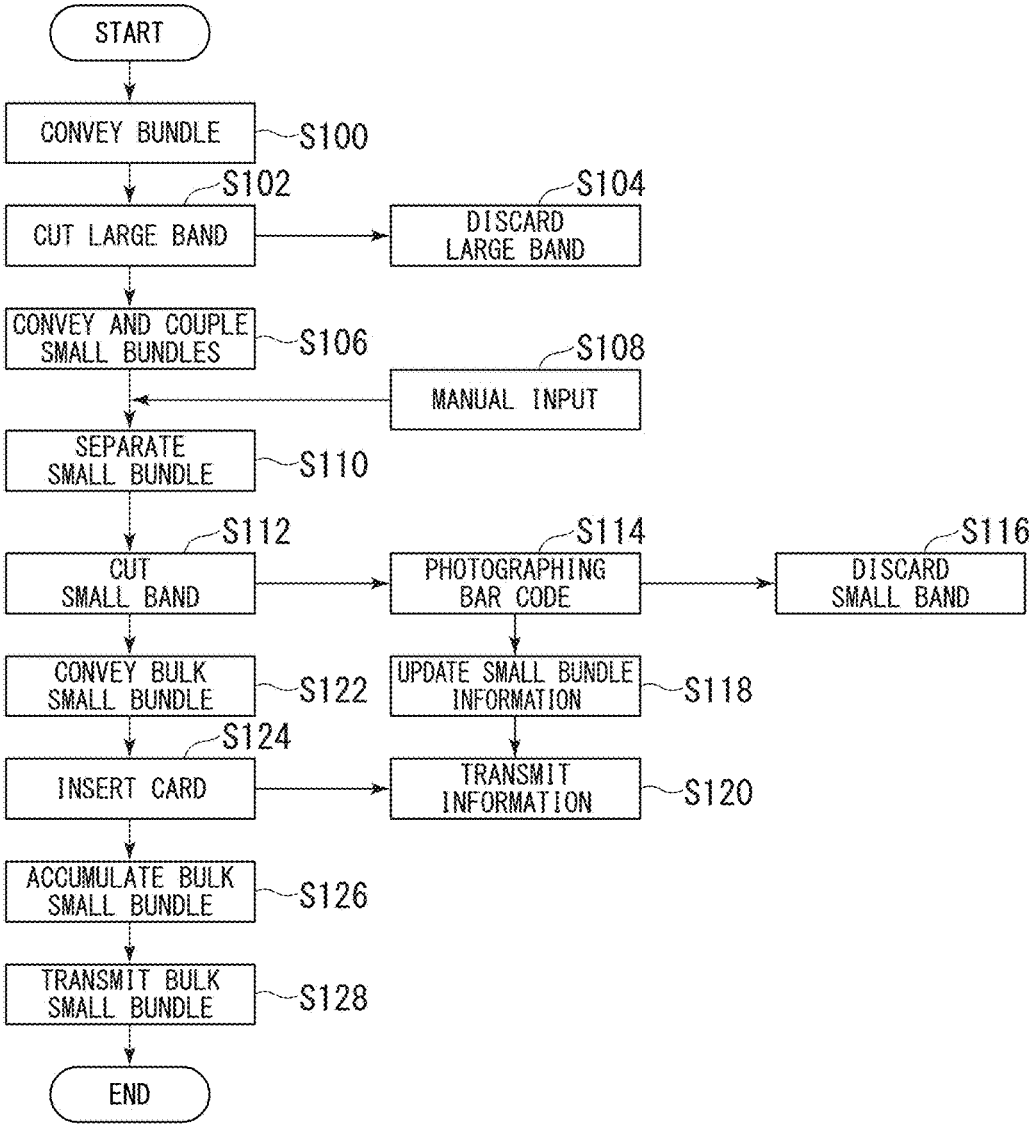
FIG. 4 is a flowchart showing an operation of the paper sheets pre-processing apparatus 5 of the embodiment.

FIG. 3 is a schematic diagram showing a schematic configuration of the paper sheets pre-processing apparatus 5 of the embodiment. FIG. 4 is a flowchart showing an operation of the paper sheets pre-processing apparatus 5 of the embodiment.

The paper sheets pre-processing apparatus 5 functions as a pre-processing apparatus configured to perform pre-processing of transferring the paper sheets P to the main body processing apparatus 100. The paper sheets pre-processing apparatus 5 includes a bundle inputter 10, a large band remover 20, a small bundle coupler 30, a small bundle picker 40, a small band remover 50 and a small bundle accumulator 60.

Figure 5:
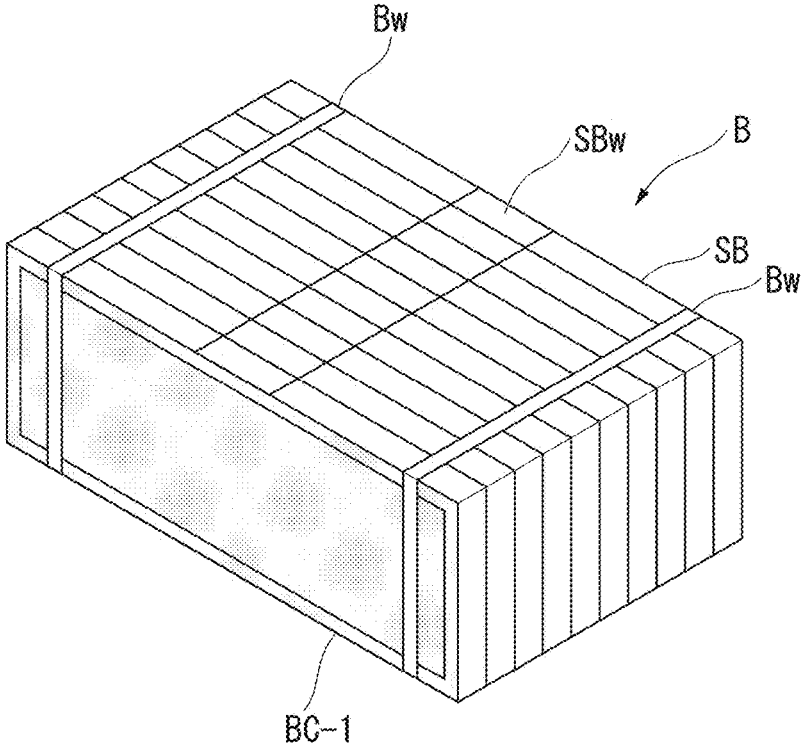
FIG. 5 is a perspective view of a bundle B according to the embodiment.
Figure 6:
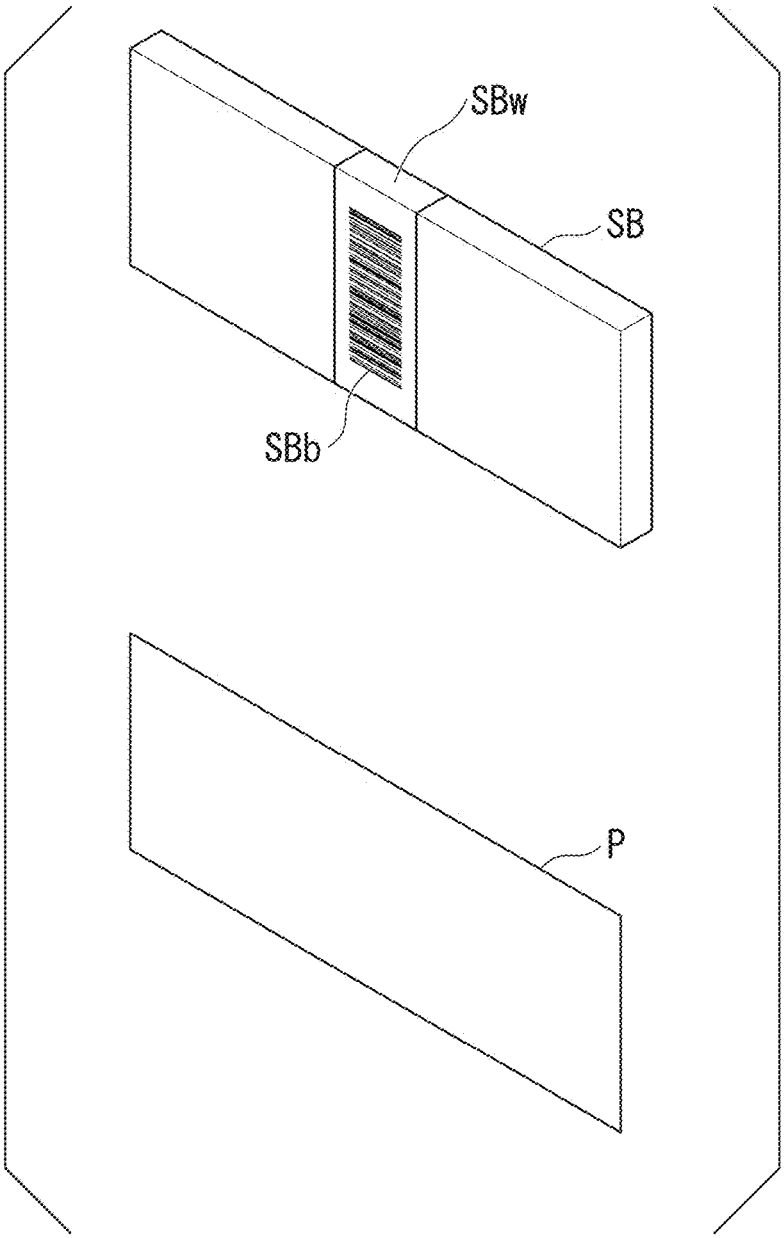
FIG. 6 is a perspective view of a small bundle SB and paper sheets P according to the embodiment.

The bundle inputter 10 conveys a bundle in which the plurality of paper sheets P are bound by small bands in a predetermined number of small bundles and the small bundles are bound by a large band (step S100). FIG. 5 is a perspective view of a bundle B of the embodiment. FIG. 6 is a perspective view of a small bundle SB and the paper sheet P of the embodiment. The small bundle SB is a bundle obtained by binding the plurality of paper sheets P using a small band SBw. The small band SBw is wound in a short side direction of the paper sheets P. The small band SBw is a binding material such as a paper band or the like. A bar code SBb is adhered to the small band SBw. Information embedded in the bar code SBb is common small bundle information of the plurality of paper sheets P bound by the small bundle SB. The small bundle information is information of the small bundle SB such as the strap number, the bank name, the branch name, the person in charge, the transaction date and time, or the like, that identifies the small bundle SB. In the embodiment, while an example in which the bar code SBb is adhered to the small band SBw has been described, the small bundle information may be printed on the small band SBw as characters.

The bundle B is an object obtained by stacking ten small bundles SB in the short side direction and binding the small bundles using large bands Bw. A primary batch card BC-1 configured to identify the bundle B is bound in the bundle B shown in FIG. 5 together with the predetermined number of small bundles SB. The large bands Bw are wound in a thickness direction and a short side direction of the small bundle SB at two places. The large band Bw is an expandable and contractible binding material such as an elastic cord or the like. The bundle B is conveyed by an operator P1 to be placed on a conveyance table in the bundle inputter 10. For example, five bundles B can be placed in the bundle inputter 10.

The bundles B placed in the bundle inputter 10 are conveyed in a conveyance path L1 (an X direction). The bundle inputter 10 delivers one of the bundles B conveyed to a conveyance destination position of the conveyance path L1 to a large band cutting stage ST of the large band remover 20 in a conveyance path L2 (a Y direction). The large band remover 20 automatically cuts the large band Bw from the bundle B as one of the bundles B is delivered (step S102). The large band remover 20 discards the cut large band Bw (step S104).

The bundle B from which the large band Bw is removed is automatically conveyed along a conveyance path L3 by the small bundle coupler 30 as each of the predetermined number of small bundles SB. The small bundle coupler 30 couples the predetermined number of small bundles included in the plurality of bundles B as the predetermined number of small bundles SB are conveyed as each of the plurality of bundles B (step S106). The small bundles SB are manually input into the small bundle coupler 30 by an operator P2 with respect to the conveyance path L3. The small bundle coupler 30 couples the manually input small bundle SB and another small bundle SB conveyed along the conveyance path L3 as the small bundles SB are manually input (step S108).

The small bundle picker 40 automatically separates one small bundle SB from the plurality of small bundles SB coupled by the small bundle coupler 30 (step S110). The small bundle picker 40 separates the one small bundle SB as the one small bundle SB is lifted in an upward direction (a Z direction). The small bundle picker 40 delivers the one small bundle SB that was separated to the small band remover 50 along a conveyance path L4.

The small band remover 50 automatically cuts the small band SBw from the one small bundle SB delivered by the small bundle picker 40 (step S112). The small bundle SB in which the small band SBw was is becomes the separated small bundles D from which the binding is released. The small band remover 50 conveys one of the separated small bundles D along a conveyance path L5, and delivers the separated small bundles D of one small bundle to the small bundle accumulator 60 (step S122).

In addition, the small band remover 50 photographs the bar code SBb of the small band SBw removed from the small bundle SB (step S114). The small band remover 50 photographs the bar code SBb on which small bundle information is printed, and then, discards the bar code SBb (step S116). The small band remover 50 analyzes an image obtained by photographing the bar code SBb and decodes the small bundle information. The small band remover 50 updates the decoded small bundle information (step S118).

The small bundle accumulator 60 inserts a secondary batch card BC-2 between the separated small bundles D as the separated small bundles D of the one small bundle are delivered (step S124). Information that identifies the separated small bundles D is recorded on the secondary batch card BC-2. The paper sheets pre-processing apparatus 5 transmits the bar code information printed on the secondary batch card BC-2 to a banknotes processing apparatus (not shown) along with the small bundle information (step S120). The small bundle accumulator 60 drops the secondary batch card BC-2 and the separated small bundles D to accumulate them in a thickness direction of the paper sheets P (step S126). The small bundle accumulator 60 repeats the insertion of the secondary batch card BC-2 and accumulation of the separated small bundles D whenever the separated small bundles D are delivered from the small band remover 50. Further, the small bundle accumulator 60 may insert the secondary batch card BC-2 into each of the plurality of separated small bundles D. For example, the small bundle accumulator 60 may insert the secondary batch card BC-2 into each of the predetermined number of separated small bundles D included in the bundle B. The small bundle accumulator 60 accumulates the separated small bundles D of the plurality of small bundles SB, slides the accumulated separated small bundles D in a transfer direction L6, and then, transfers the separated small bundles D to the main body processing apparatus 100 of the paper sheets P (step S128).

Hereinafter, configuration of the respective parts of the above-mentioned paper sheets pre-processing apparatus 5 will be described.

[Bundle Inputter 10]

Figure 7:
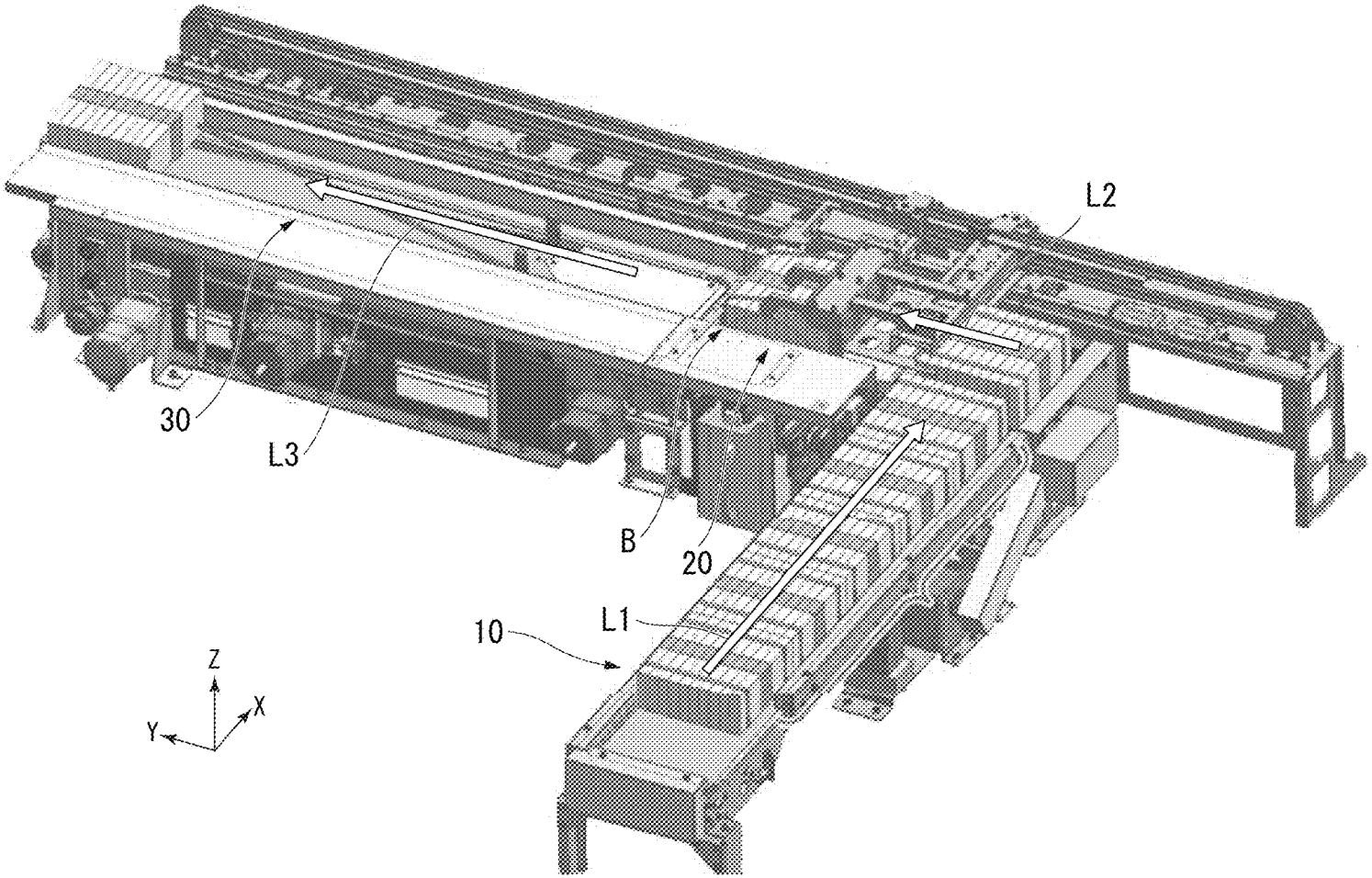
FIG. 7 is a perspective view showing the exterior of a bundle processing system in the paper sheets pre-processing apparatus 5 according to the embodiment.

FIG. 7 is a perspective view showing the exterior of a bundle processing system in the paper sheets pre-processing apparatus 5 of the embodiment.

Figure 8:
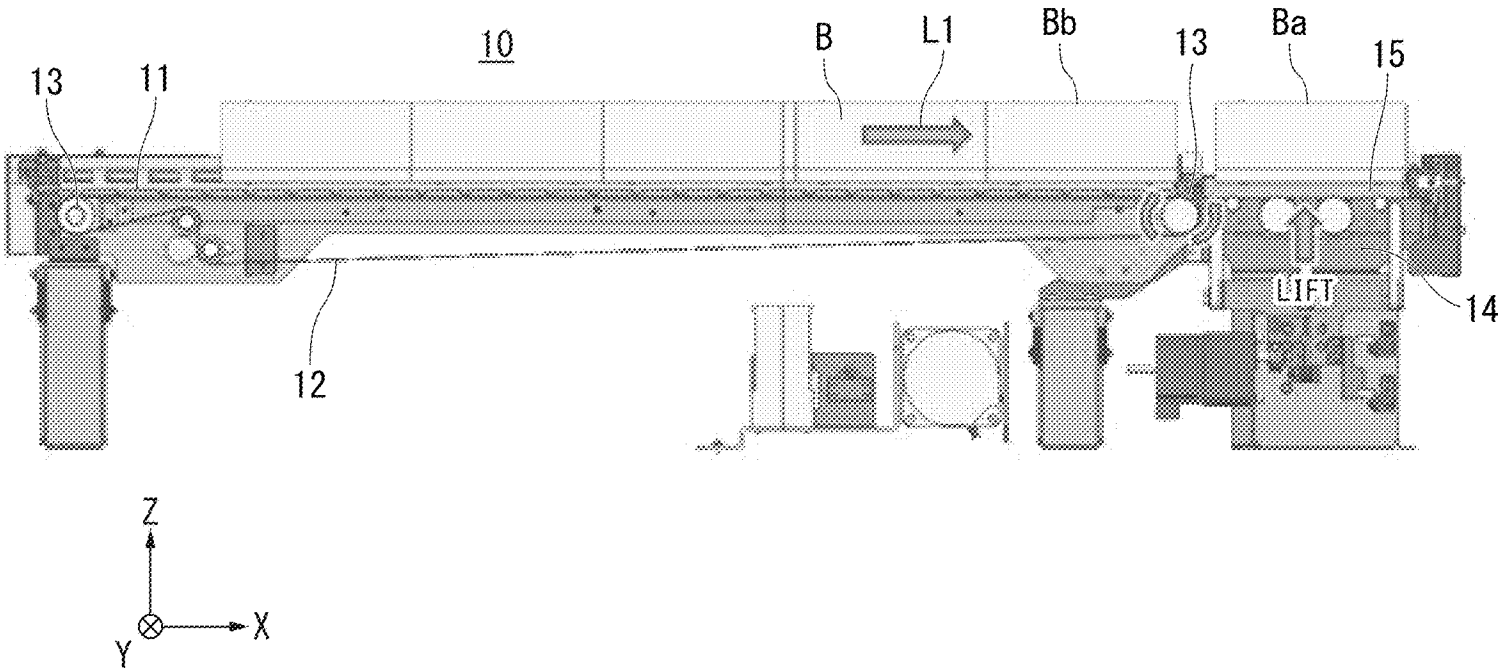
FIG. 8 is a side view of a bundle inputter 10 in the paper sheets pre-processing apparatus 5 of the embodiment.

FIG. 8 is a side view of the bundle inputter 10 in the paper sheets pre-processing apparatus 5 of the embodiment.

The bundle inputter 10 includes a placing part 11, a conveyor belt 12, conveyor rollers 13, a lift mechanism 14 and an input stage 15. A plurality of placing parts 11 are installed in the X direction. A plurality of bundles B are placed on the placing parts 11 by the operator P1. For example, five bundles B may be placed on the placing parts 11. The conveyor belt 12 and the conveyor rollers 13 are normally driven by a driving torque generated by a conveyor motor (not shown) to rotate the conveyor rollers 13. Accordingly, the plurality of bundles B placed on the placing parts 11 are conveyed to the input stage 15 along the conveyance path L1. In the bundle inputter 10, when a bundle Ba at the head of the plurality of bundles B is conveyed to the input stage 15, the bundle Ba butts against a protrusion section (not shown).

Afterward, the bundle inputter 10 reversely drives the conveyor roller 13. Accordingly, the bundle Ba conveyed to the input stage 15 is separated from a bundle Bb conveyed to the front of the input stage 15. In addition, the bundle inputter 10 drives the lift mechanism 14 to raise the input stage 15. As a result, the bundle inputter 10 separates the one bundle B from the plurality of bundles B.

[Large Band Remover 20]

Figure 9:
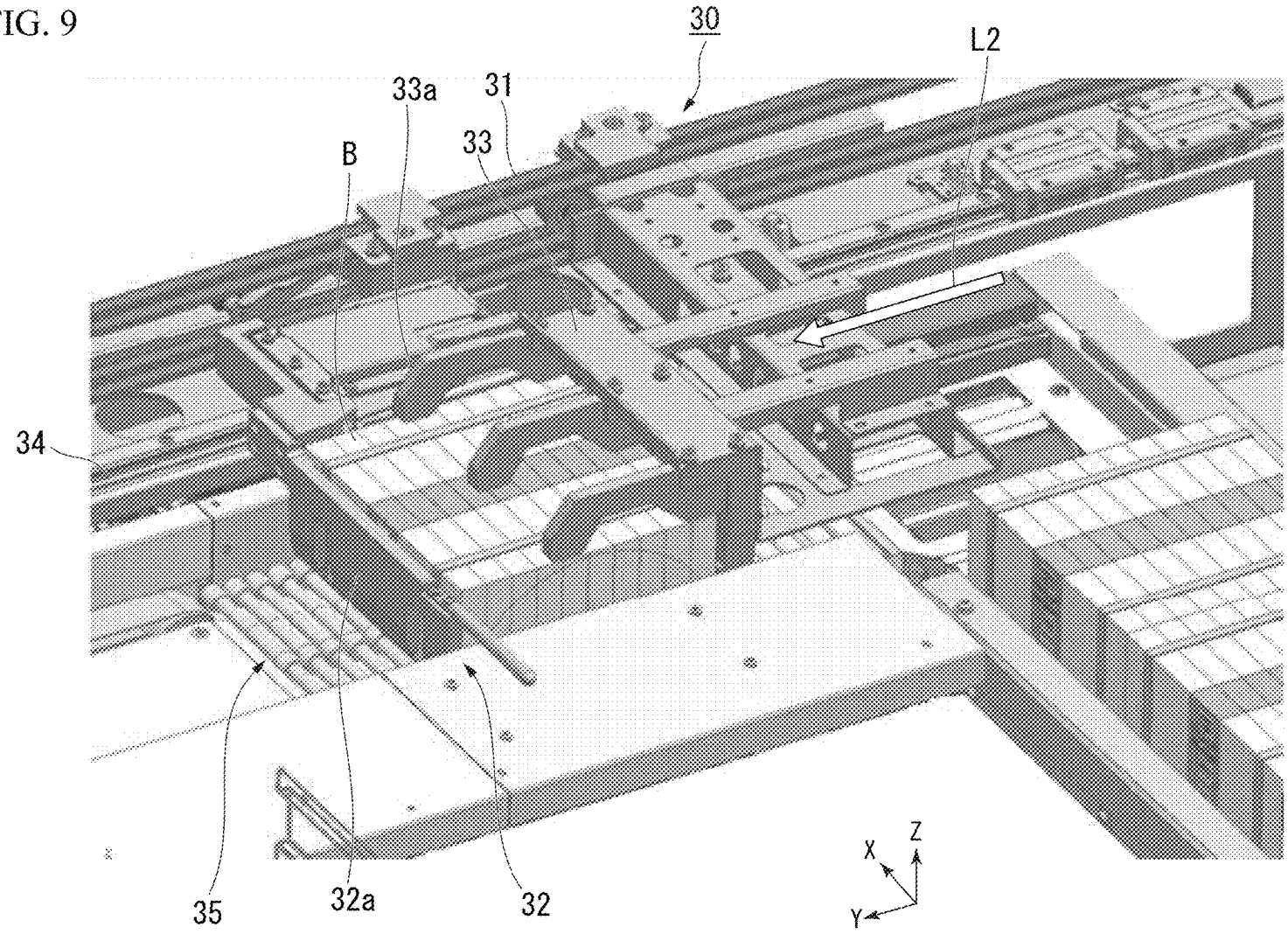
FIG. 9 is a perspective view showing a large band remover 20 and a small bundle coupler 30 in the paper sheets pre-processing apparatus 5 of the embodiment.
Figure 10:
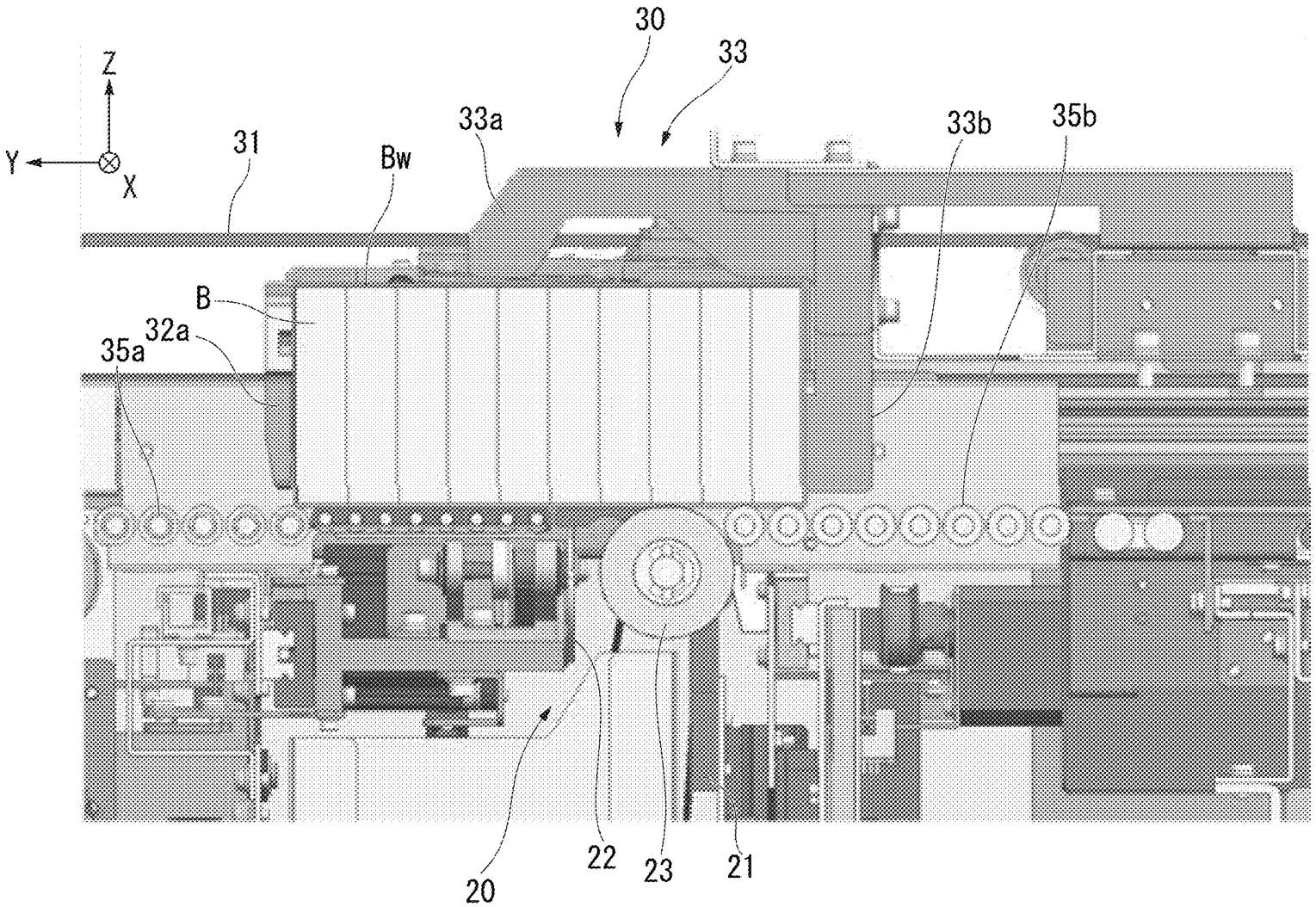
FIG. 10 is a side view showing the large band remover 20 and the small bundle coupler 30 in the paper sheets pre-processing apparatus 5 of the embodiment.

FIG. 9 is a perspective view showing the large band remover 20 and the small bundle coupler 30 in the paper sheets pre-processing apparatus 5 of the embodiment. FIG. 10 is a side view showing the large band remover 20 and the small bundle coupler 30 in the paper sheets pre-processing apparatus 5 of the embodiment.

As shown in FIG. 9, the small bundle coupler 30 includes a conveyance chain 31, a first carrier 32, a second carrier 33, a conveyance rail 34 and roller tables 35 (35*a* and 35*b*). As shown in FIG. 10, the large band remover 20 includes a deformation lift mechanism (a deformer) 21, a band cutter mechanism (a cutter) 22, a band removal roller (a discarder) 23 and a band clamp pin 24 (see FIG. 11).

The first carrier 32 and the second carrier 33 conveys the bundle B conveyed to the input stage 15 to the large band remover 20. The first carrier 32 supports a side in a +Y direction of the bundle B. The second carrier 33 supports a side in a +Z direction of the bundle B and a side in a −Y direction of the bundle B. The first carrier 32 and the second carrier 33 are connected to the conveyance chain 31 and the conveyance rail 34. The conveyance chain 31 is provided along the conveyance path L2 from a +X side of the input stage 15 to an end portion of a +Y side of the conveyance path L3 of the small bundle coupler 30. The conveyance chain 31 is driven by a conveyance motor (not shown) and moves the first carrier 32 and the second carrier 33 in the ±Y direction.

The large band remover 20 removes the large band Bw from the bundle B according to conveyance of the bundle B to the predetermined large band removal position. The predetermined large band removal position is a position at which the deformation lift mechanism (a presser) 21 and the band cutter mechanism 22 are installed at the roller tables 35 in the Y direction. In a state in which the bundle B is conveyed to a predetermined position, a side of the bundle B in the +Y direction is pressed by a support 32*a* (a first support) of the first carrier 32. In addition, an upper side of the bundle B is pressed by three claw sections 33*a* (second support sections) of the second carrier 33. Further, a side of the bundle B in the −Y direction is pressed by a support section 33*b* (a first support section) of the second carrier 33.

Figure 11:
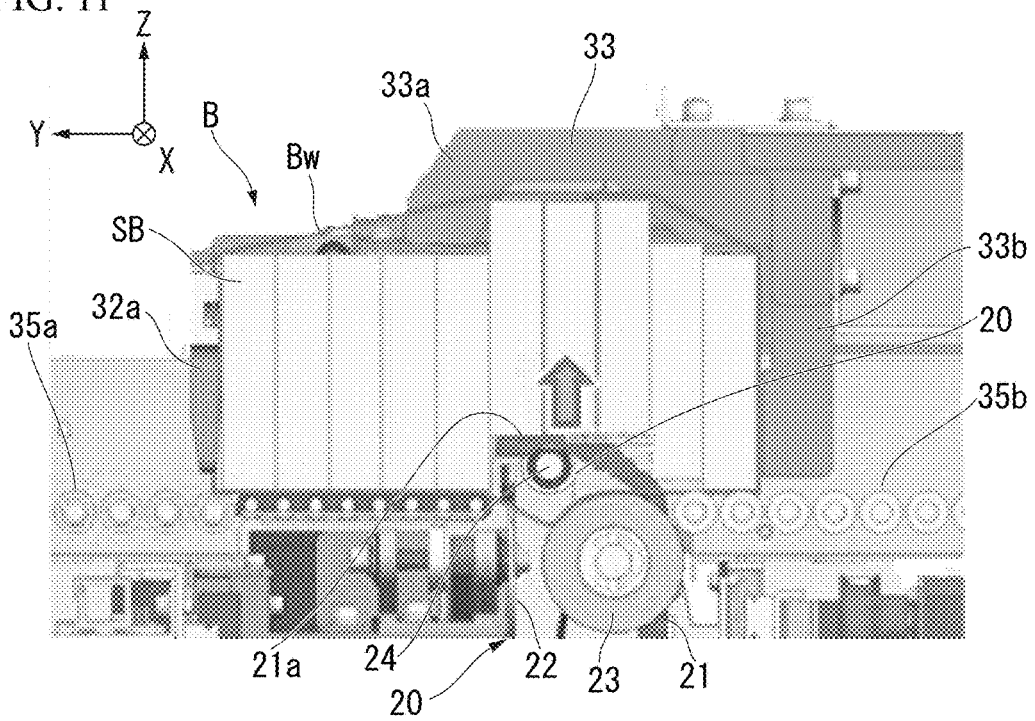
FIG. 11 is a side view showing a state in which the bundle B is deformed by the large band remover 20 of the paper sheets pre-processing apparatus 5 of the embodiment.

The large band remover 20 drives the deformation lift mechanism 21 upward and raises some small bundles SB of the plurality of small bundles SB in the bundle B. FIG. 11 is a side view showing a state in which the bundle B is deformed by the large band remover 20 in the paper sheets pre-processing apparatus 5 of the embodiment. The deformation lift mechanism (the presser) 21 raises three or four small bundles SB using three lifters 21*a*, 21*b* and 21*c* in a long side direction (an X direction) of the small bundle SB (see FIG. 12). Accordingly, the deformation lift mechanism 21 forms the space 20*a* between the large band Bw and the small bundle SB by deforming the bundle B. Further, a lift amount by the deformation lift mechanism 21 is set such that the space 20*a* is formed and a bottom surface of the small bundle SB is disposed higher than the band clamp pin 24 in the Z direction.

Figure 12:
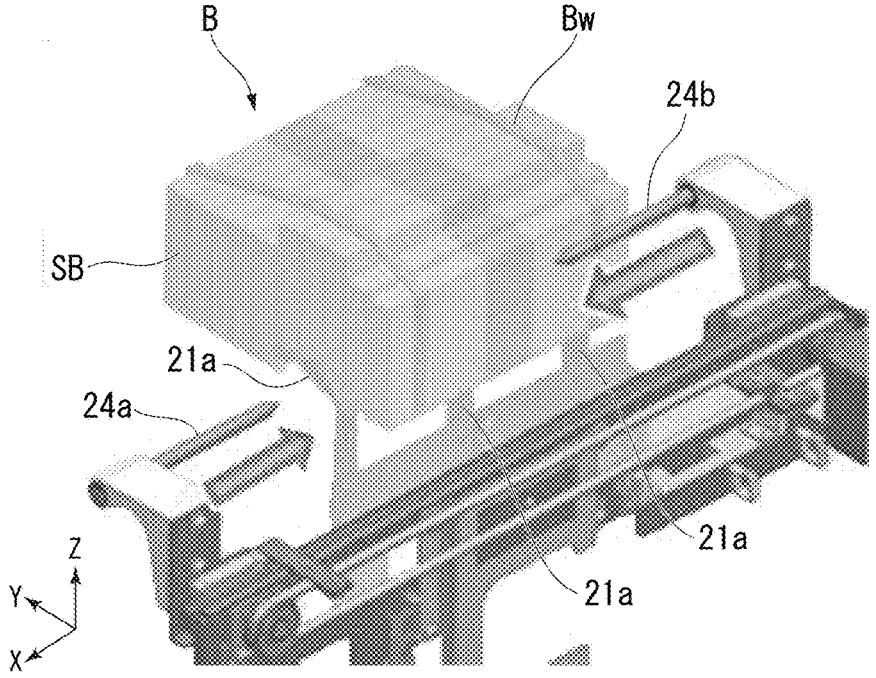
FIG. 12 is a perspective view showing a state in which a band clamp pin 24 is to be inserted into a space 20*a* by the large band remover 20 of the paper sheets pre-processing apparatus 5 of the embodiment.
Figure 13:
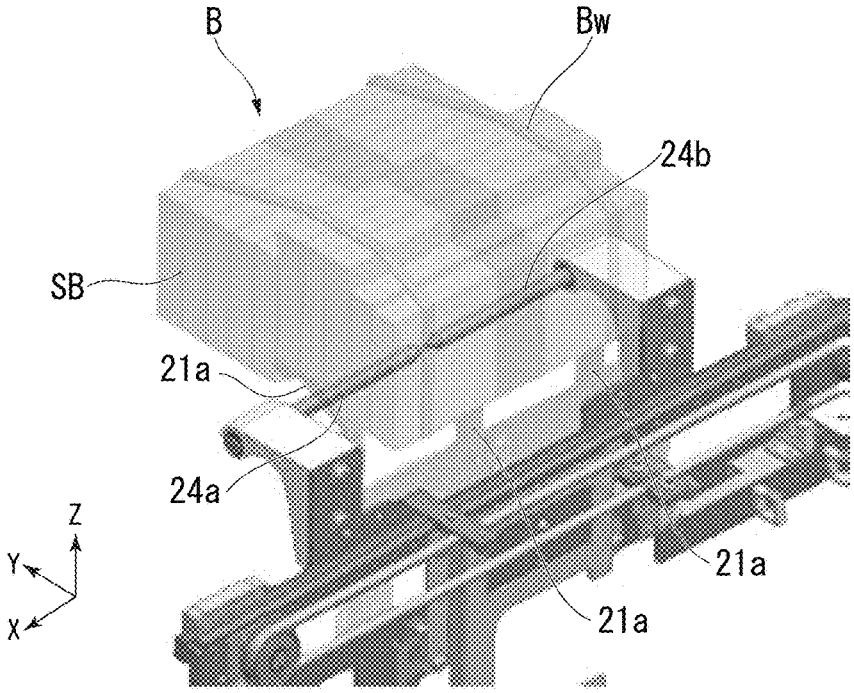
FIG. 13 is a perspective view showing a state in which the band clamp pin 24 is inserted into the space 20*a* by the large band remover 20 of the paper sheets pre-processing apparatus 5 of the embodiment.

Next, the large band remover 20 inserts the band clamp pin 24 into the space 20*a*. FIG. 12 is a perspective view showing a state in which the band clamp pin 24 is to be inserted into the space 20*a* by the large band remover 20 in the paper sheets pre-processing apparatus 5 of the embodiment. Front end portions 24*a* and 24*b* of the band clamp pin 24 are moved toward the space 20*a* from both sides in the X direction. Movement of the front end portions 24*a* and 24*b* in a state in which they are opposite to each other in the space 20*a* is stopped. Accordingly, the band clamp pin 24 is inserted between the large band Bw and the small bundle SB. FIG. 13 is a perspective view showing a state in which the band clamp pin 24 is inserted into the space 20*a* by the large band remover 20 in the paper sheets pre-processing apparatus 5 of the embodiment.

Figure 14:
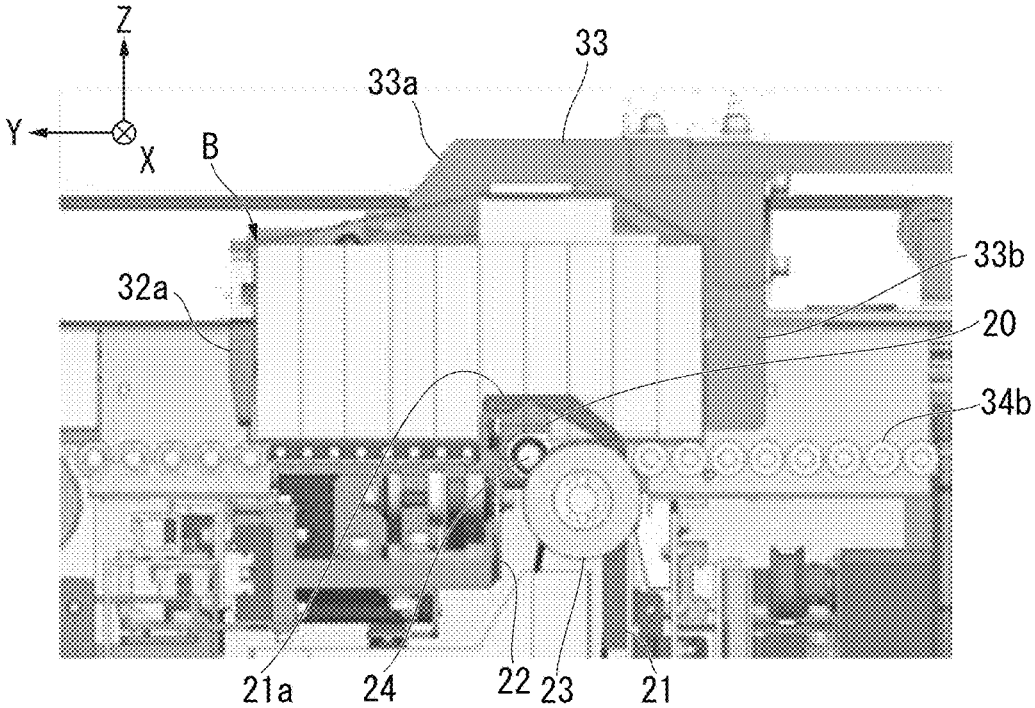
FIG. 14 is a side view showing a state in which the band clamp pin 24 is lowered by the large band remover 20 of the paper sheets pre-processing apparatus 5 of the embodiment.

Next, the large band remover 20 lowers the band clamp pin 24 to abut the band removal roller 23. FIG. 14 is a side view showing a state in which the band clamp pin 24 is lowered by the large band remover 20 in the paper sheets pre-processing apparatus 5 of the embodiment. The large band Bw is pressed against the band removal roller 23 when the band clamp pin 24 and the band removal roller 23 abut each other.

Figure 15:
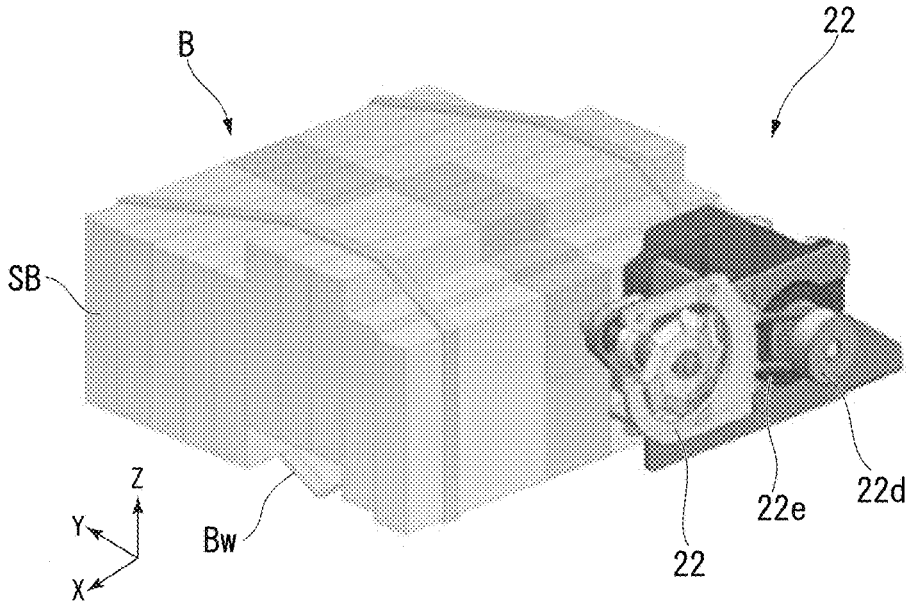
FIG. 15 is a perspective view showing a state in which a band cutter mechanism 22 of the large band remover 20 of the paper sheets pre-processing apparatus 5 of the embodiment is moved.
Figure 16:
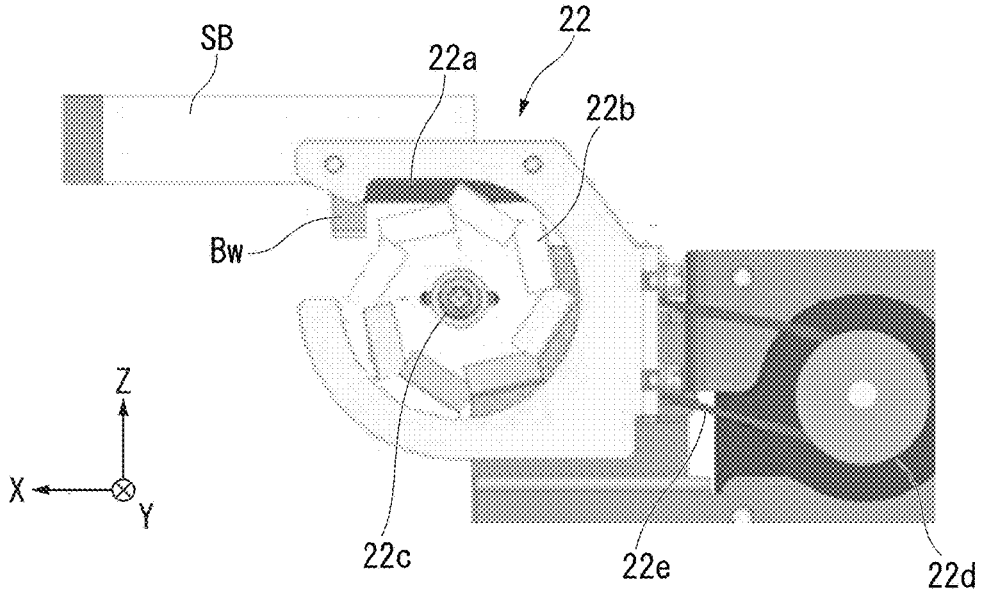
FIG. 16 is a side view of the band cutter mechanism 22 of the paper sheets pre-processing apparatus 5 of the embodiment.

Next, the large band remover 20 moves the band cutter mechanism 22 in the X direction. FIG. 15 is a perspective view showing a state in which the band cutter mechanism 22 of the large band remover 20 in the paper sheets pre-processing apparatus 5 of the embodiment is moved. FIG. 16 is a side view of the band cutter mechanism 22 of the paper sheets pre-processing apparatus 5 of the embodiment. The band cutter mechanism 22 includes an upper blade 22*a* and a cutting blade 22*b*. The upper blade 22*a* is formed at a substantially C-shaped inner wall section of the band cutter mechanism 22. The cutting blade 22*b* is disposed inside the substantially C-shaped inner wall to oppose the upper blade 22*a*. The cutting blade 22*b* receives a rotational torque by rotational driving of a rotation roller 22*d* via a pivot belt 22*e*. Accordingly, the cutting blade 22*b* is rotationally driven about a rotary shaft 22*c*. The band cutter mechanism 22 moves the cutting blade 22*b* in the X direction shown in FIG. 15 while rotationally driving the cutting blade 22*b*. The band cutter mechanism 22 cuts the large band Bw through rotation of the cutting blade 22*b* when the upper blade 22*a* and the cutting blade 22*b* come in contact with the large band Bw.

Figure 17:
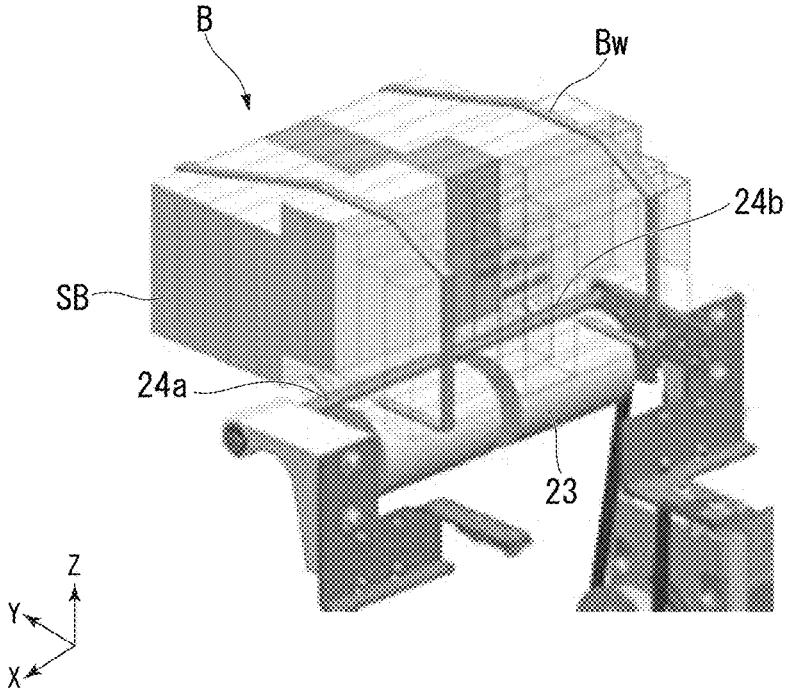
FIG. 17 is a perspective view when a band removal roller 23 of the large band remover 20 is seen from a −Y direction side in the paper sheets pre-processing apparatus 5 of the embodiment.
Figure 18:
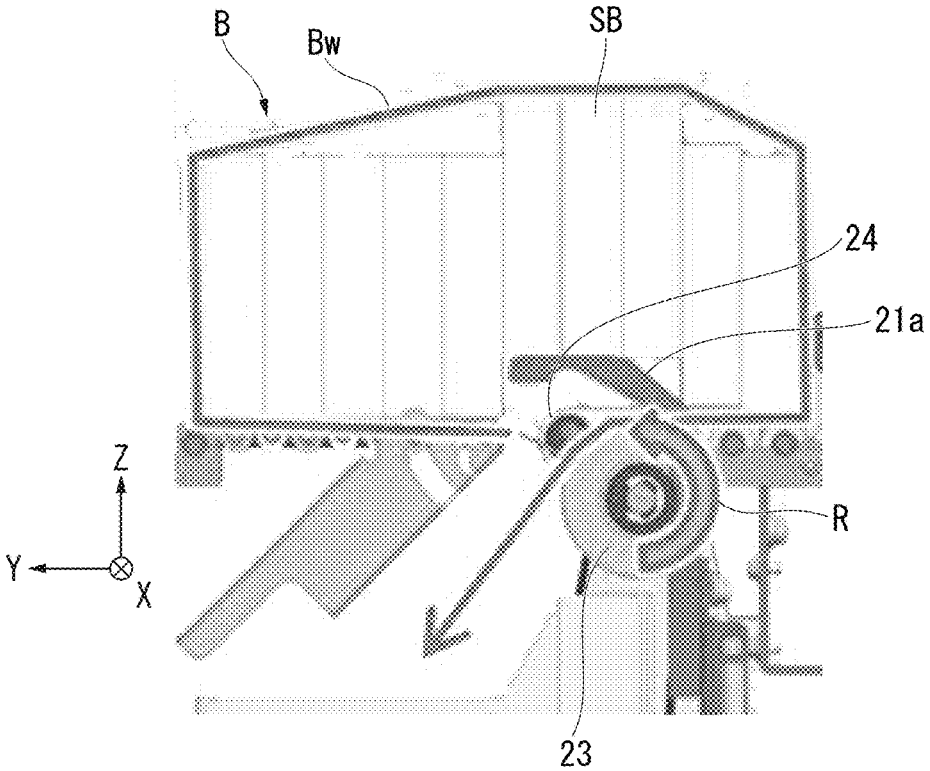
FIG. 18 is a side view showing a state in which the band removal roller 23 of the large band remover 20 in the paper sheets pre-processing apparatus 5 of the embodiment is rotated.
Figure 19:
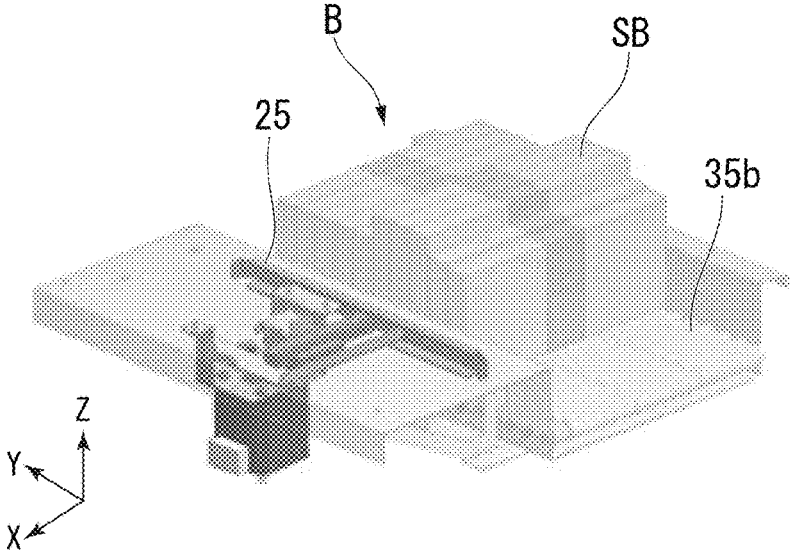
FIG. 19 is a perspective view showing an arranger 25 of the large band remover 20 in the paper sheets pre-processing apparatus 5 of the embodiment.

Next, the large band remover 20 rotates the band removal roller 23. FIG. 17 is a perspective view when the band removal roller 23 of the large band remover 20 is seen from the −Y direction side in the paper sheets pre-processing apparatus 5 of the embodiment. FIG. 18 is a side view showing a state in which the band removal roller 23 of the large band remover 20 is rotated in the paper sheets pre-processing apparatus 5 of the embodiment. The band removal roller 23 is rotated in a direction R shown by an arrow of FIG. 18 with the large band Bw interposed between the band clamp pin 24 and the band removal roller 23. Accordingly, the band removal roller 23 pulls the cut large band Bw. The pulled large band Bw is discharged to the outside of the apparatus or accumulated in an exclusion box to be discarded. Afterward, the large band remover 20 pushes the side of the bundle B in the X direction using an arranger 25 to prepare positions of the plurality of small bundles SB. FIG. 19 is a perspective view showing the arranger 25 of the large band remover 20 in the paper sheets pre-processing apparatus 5 of the embodiment.

[Small Bundle Coupler 30]

Figure 20:
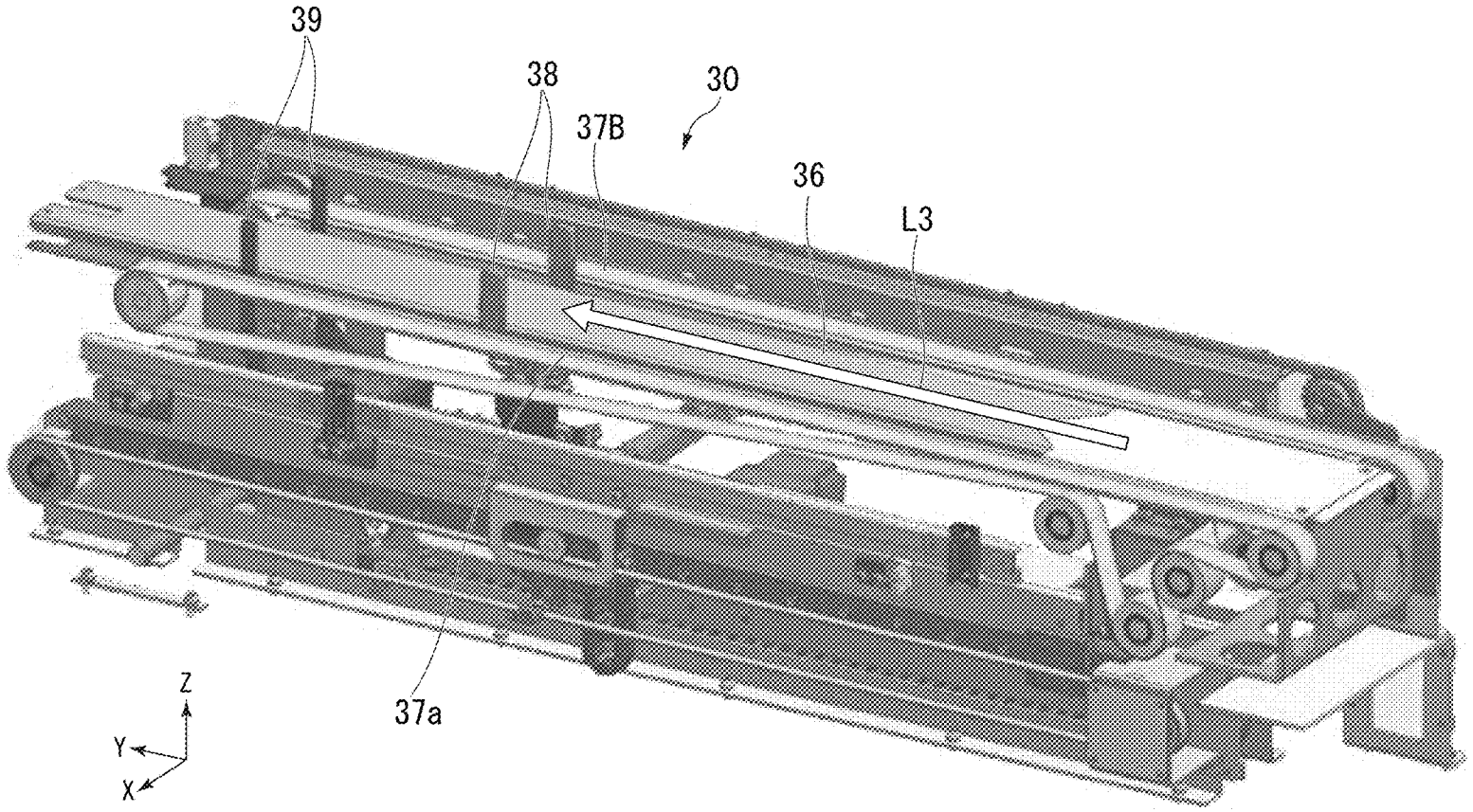
FIG. 20 is a configuration view of a portion of the small bundle coupler 30 in the paper sheets pre-processing apparatus 5 of the embodiment.

FIG. 20 is a configuration view of a portion of the small bundle coupler 30 in the paper sheets pre-processing apparatus 5 of the embodiment. The small bundle coupler 30 includes a small bundle processing table 36, a pair of conveyor belts 37A and 37B, a first slider 38 and a second slider 39.

The small bundle processing table 36 is provided along the conveyance path L3 (the Y direction). The predetermined number of small bundles SB are conveyed to the small bundle processing table 36 whenever the large band Bw is removed by the large band remover 20. The conveyor belts 37A and 37B are installed at both sides of the small bundle processing table 36 in the X direction. The conveyor belts 37A and 37B are disposed to come in contact with lower surfaces of the plurality of small bundles SB conveyed to the small bundle processing table 36. The conveyor belts 37A and 37B are driven in the Y direction by a driving torque of a driving motor (not shown). The conveyor belts 37A and 37B generates an auxiliary force of conveying the small bundle SB along the conveyance path L3 by a frictional force between the plurality of small bundles SB and the conveyor belts 37A and 37B.

The first slider 38 is disposed between the small bundle processing table 36 and the conveyor belts 37A and 37B. The first slider 38 is moved in the Z direction and the Y direction by a moving mechanism (not shown). The first slider 38 protrudes from the small bundle processing table 36 in the +Z direction when the plurality of small bundles SB are conveyed along the conveyance path L3. The first slider 38 is moved in the Y direction based on the positions of the plurality of small bundles SB.

The second slider 39 is disposed further on the +Y direction side than the first slider 38 and between the small bundle processing table 36 and the conveyor belts 37A and 37B. The second slider 39 is moved in the Y direction based on the positions of the plurality of small bundles SB. The second slider 39 is slid toward the −Y direction side to receive the predetermined number of small bundles SB at the beginning of a startup of the paper sheets pre-processing apparatus 5.

FIGS. 21, 22, 23, 24, 25, 26 and 27 are side views showing states in which the predetermined number of small bundles SB are coupled to each other by the small bundle coupler 30 of the paper sheets pre-processing apparatus 5 of the embodiment.

Figure 21:
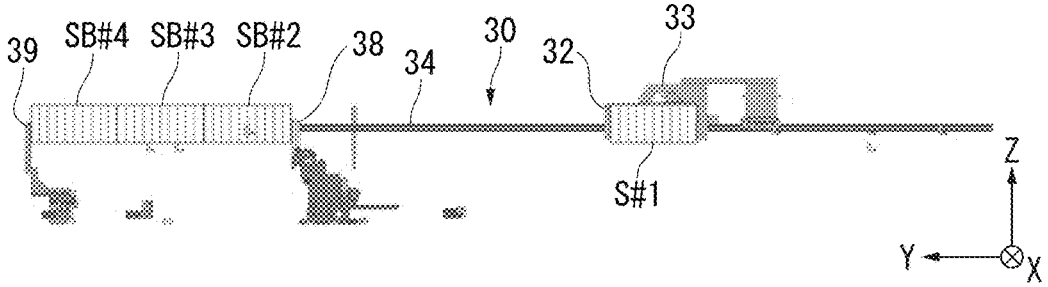
FIG. 21 is a side view showing a state in which a predetermined number of small bundles SB are coupled to each other by the small bundle coupler 30 in the paper sheets pre-processing apparatus 5 of the embodiment.

The predetermined number of small bundles SB are the plurality of small bundles SB included in the one bundle B. As shown in FIG. 21, the predetermined number of small bundles S#1 are pressed from both sides in the Y direction and the side in the +Z direction by the first carrier 32 and the second carrier 33 at the predetermined large band removal position. In a state in which the plurality of small bundles SB#1 are disposed at a large band removal position, the predetermined number of small bundles SB#2, SB#3 and SB#4 are coupled. The predetermined number of small bundles SB#2, SB#3 and SB#4 are pressed from the −Y direction side by the first slider 38 and pressed from the +Y direction side by the second slider 39. Further, the predetermined number of small bundles SB#2, SB#3 and SB#4 are coupled by the small bundle coupler 30, and an operation of cutting the small bundles at every small bundle using the small bundle picker 40 (to be described below) is performed.

Figure 22:
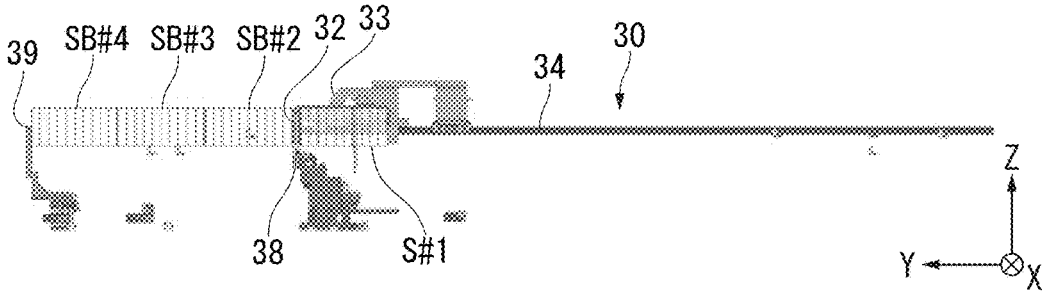
FIG. 22 is a side view showing a state in which the predetermined number of small bundles SB are coupled to each other by the small bundle coupler 30 in the paper sheets pre-processing apparatus 5 of the embodiment.
Figure 23:
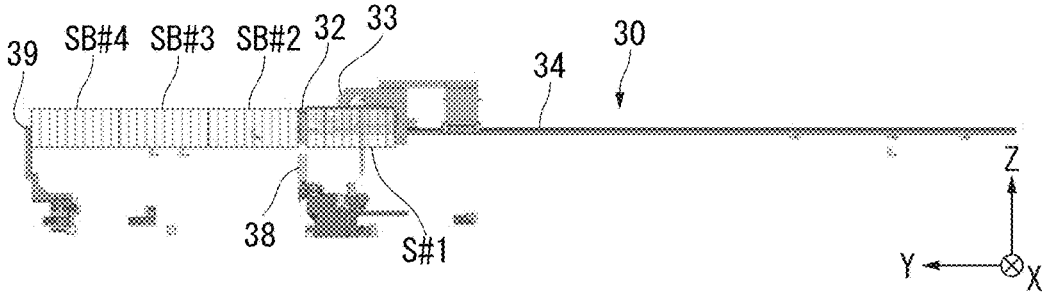
FIG. 23 is a side view showing a state in which the predetermined number of small bundles SB are coupled to each other by the small bundle coupler 30 in the paper sheets pre-processing apparatus 5 of the embodiment.
Figure 24:
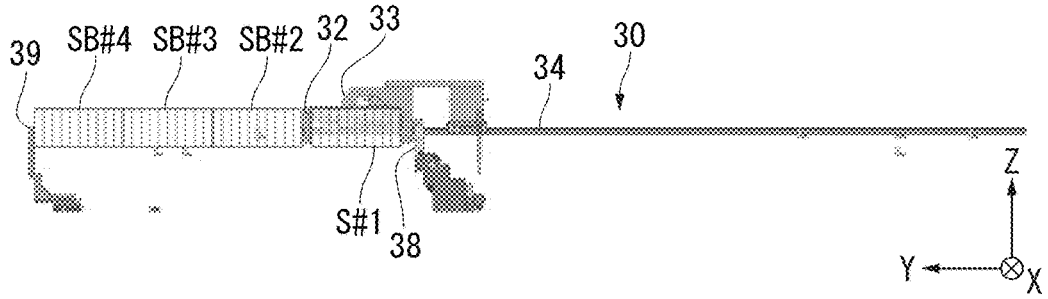
FIG. 24 is a side view showing a state in which the predetermined number of small bundles SB are coupled to each other by the small bundle coupler 30 in the paper sheets pre-processing apparatus 5 of the embodiment
Figure 25:
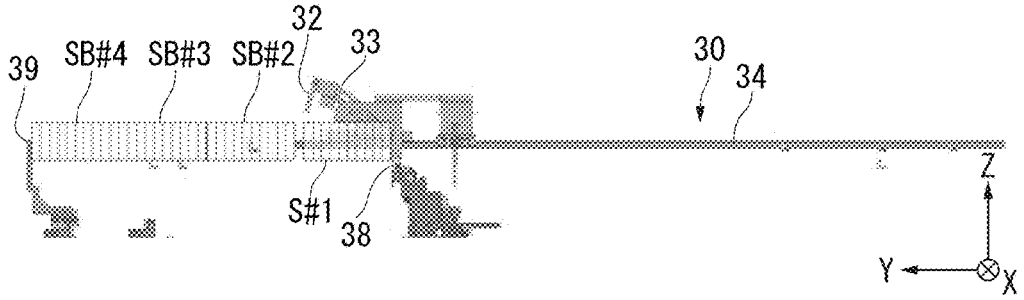
FIG. 25 is a side view showing a state in which the predetermined number of small bundles SB are coupled to each other by the small bundle coupler 30 in the paper sheets pre-processing apparatus 5 of the embodiment.
Figure 26:
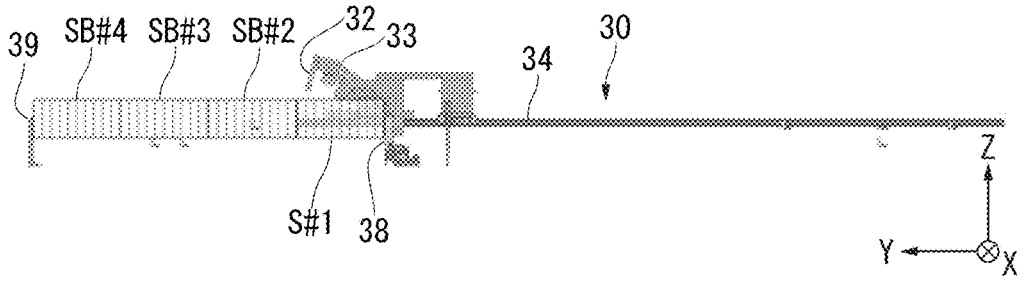
FIG. 26 is a side view showing a state in which the predetermined number of small bundles SB are coupled to each other by the small bundle coupler 30 in the paper sheets pre-processing apparatus 5 of the embodiment.
Figure 27:
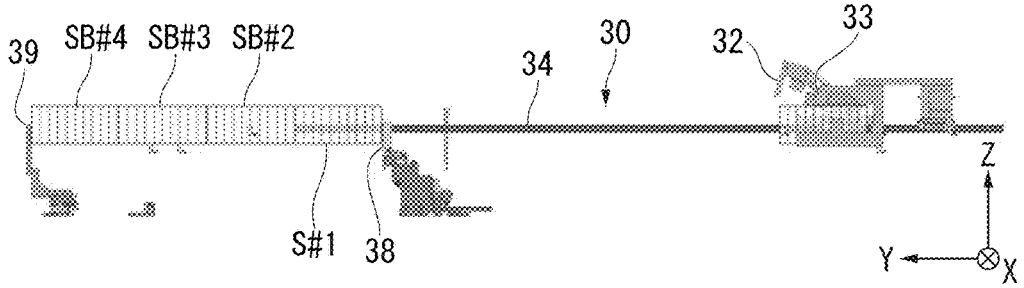
FIG. 27 is a side view showing a state in which the predetermined number of small bundles SB are coupled to each other by the small bundle coupler 30 in the paper sheets pre-processing apparatus 5 of the embodiment.

As shown in FIG. 22, the small bundle coupler 30 slides the first carrier 32 and the second carrier 33 in the +Y direction in a state in which the predetermined number of small bundles SB#1 are pressed by the first carrier 32 and the second carrier 33. The small bundle coupler 30 slides the first carrier 32 and the second carrier 33 to a position at which the first carrier 32 overlaps the first slider 38. Next, as shown in FIG. 23, the small bundle coupler 30 lowers the first slider 38 such that a front end of the first slider 38 is disposed lower than the small bundle processing table 36. Next, as shown in FIG. 24, the small bundle coupler 30 moves the first slider 38 further to the −Y direction side than the predetermined number of small bundles SB#1 and raises the first slider 38 at a position of the −Y direction side of the second carrier 33. Next, as shown in FIG. 25, the small bundle coupler 30 raises the first carrier 32 to withdraw the first carrier 32 from between the predetermined number of small bundles SB#1 and the predetermined number of small bundles SB#2. In addition, the small bundle coupler 30 slides the first slider 38 toward the +Y direction side and brings the first slider 38 in contact with the −Y direction side of the predetermined number of small bundles SB#1. Next, as shown in FIG. 26, the small bundle coupler 30 couples the predetermined number of small bundles SB#1 and the predetermined number of small bundles SB#2 as the first slider 38 slides toward the +Y direction side. Next, as shown in FIG. 27, the first carrier 32 of the small bundle coupler 30 returns the first slider 38 to the large band removal position and receives the next predetermined number of small bundles SB.

Further, in the small bundle coupler 30, the small bundle SB is input onto the small bundle processing table 36 by a manual operation of the operator P2. The small bundle coupler 30 presses the first carrier 32 toward the −Y direction side of the small bundle SB on the small bundle processing table 36 in a state shown in FIG. 26 according to manipulation by a manual input button (not shown). Next, the small bundle coupler 30 lowers the first slider 38 to be lower than the small bundle processing table 36. In this state, the small bundle coupler 30 adjusts a driving torque in the +Y direction of the first carrier 32 to become a pressing force capable of manually moving the first carrier 32 in the −Y direction. Accordingly, the first carrier 32 is slid toward the −Y direction side by the operator P2 to add an additional small bundle SB to the −Y direction side of the coupled small bundles SB. When hands of the operator P2 are separated from the first carrier 32, the first carrier 32 is gradually slid toward the +Y direction side to be pressed against the −Y direction side of the coupled small bundles SB. The small bundle coupler 30 disposes the first slider 38 at the −Y direction side of the coupled small bundles SB while the first carrier 32 is returned to the large band removal position as the manual input button is manipulated again.

[Small Bundle Picker 40]

Figure 28:
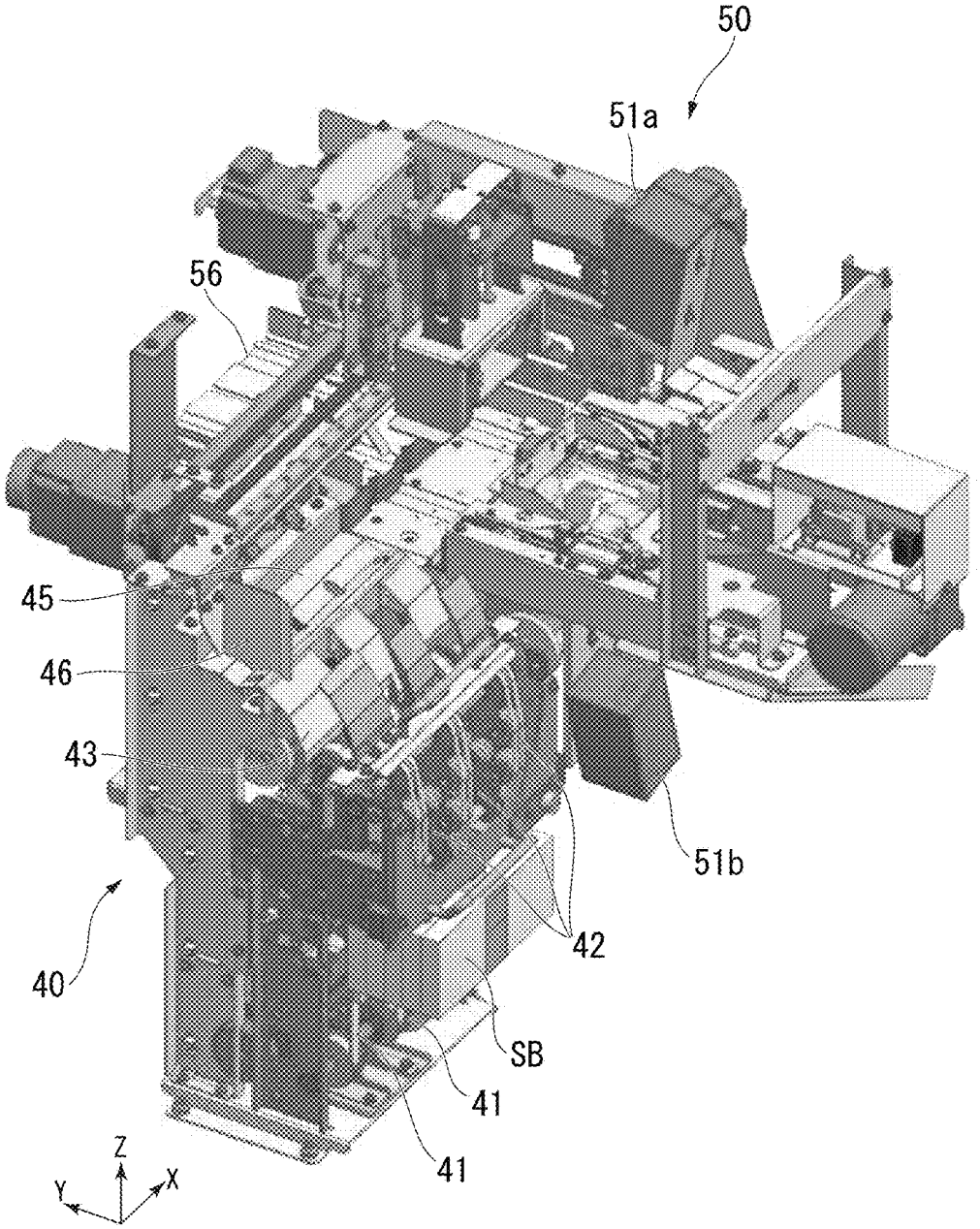
FIG. 28 is a perspective view showing the exterior of a small bundle processing system in the paper sheets pre-processing apparatus 5 of the embodiment.
Figure 29:
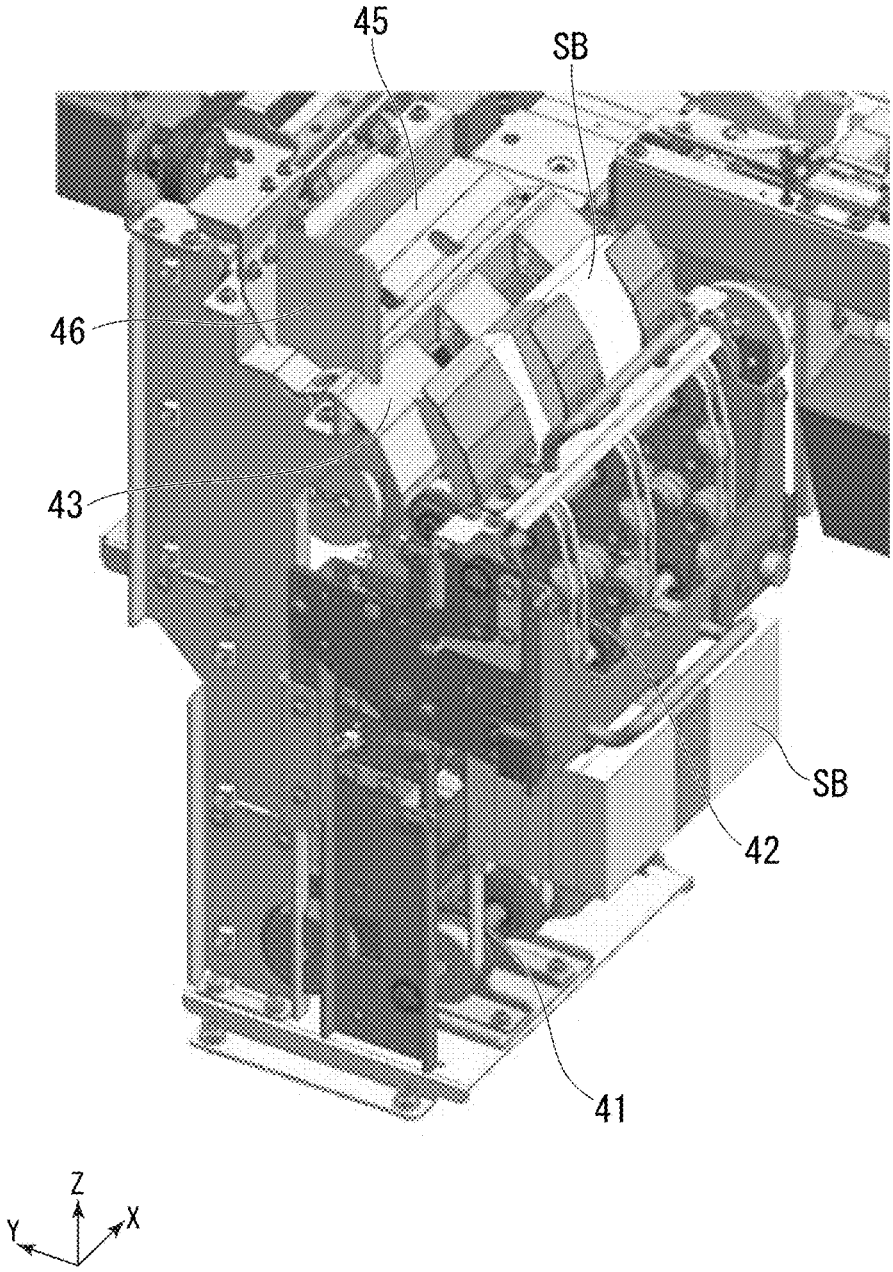
FIG. 29 is a perspective view of a small bundle picker 40 in the paper sheets pre-processing apparatus 5 of the embodiment.
Figure 30:
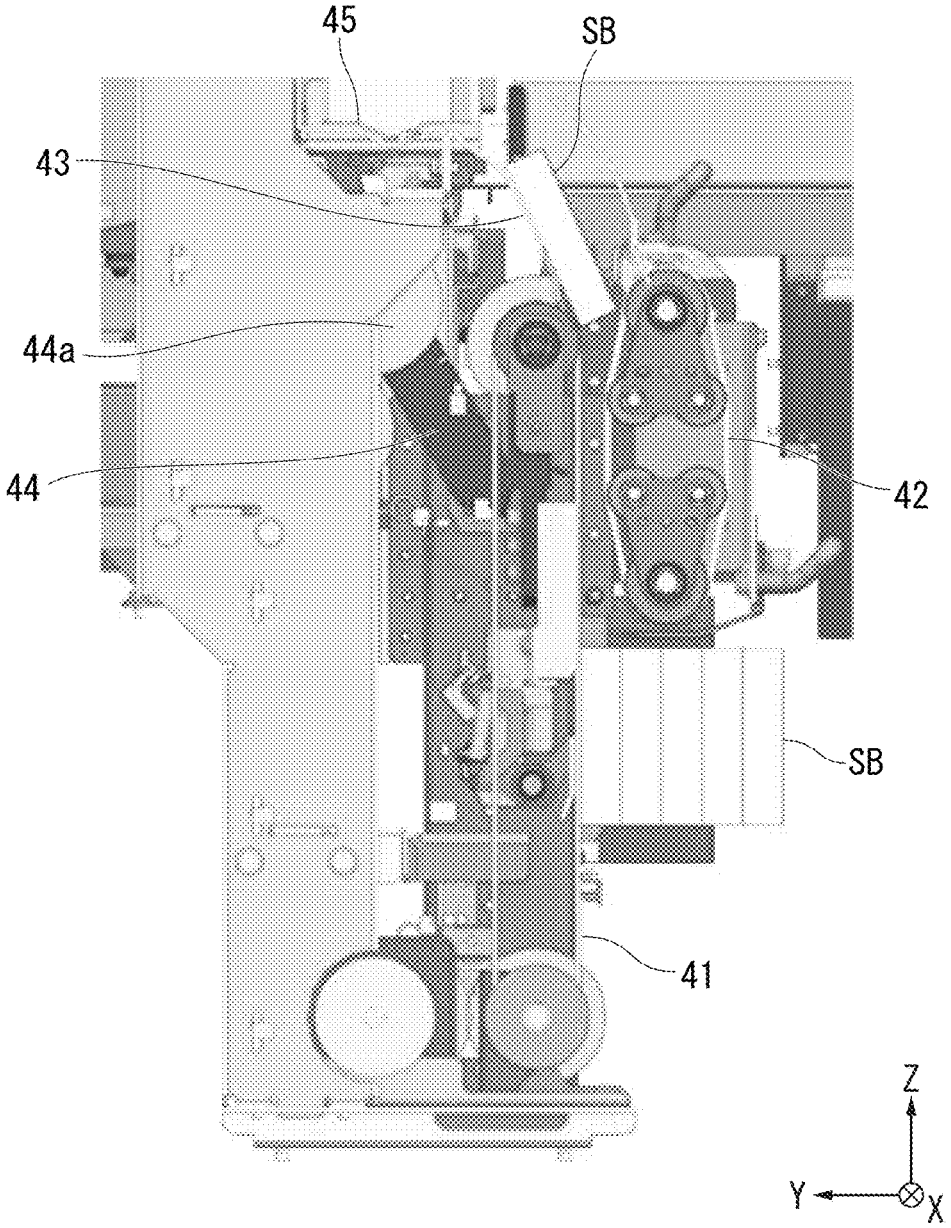
FIG. 30 is a side view of the small bundle picker 40 in the paper sheets pre-processing apparatus 5 of the embodiment.
Figure 31:
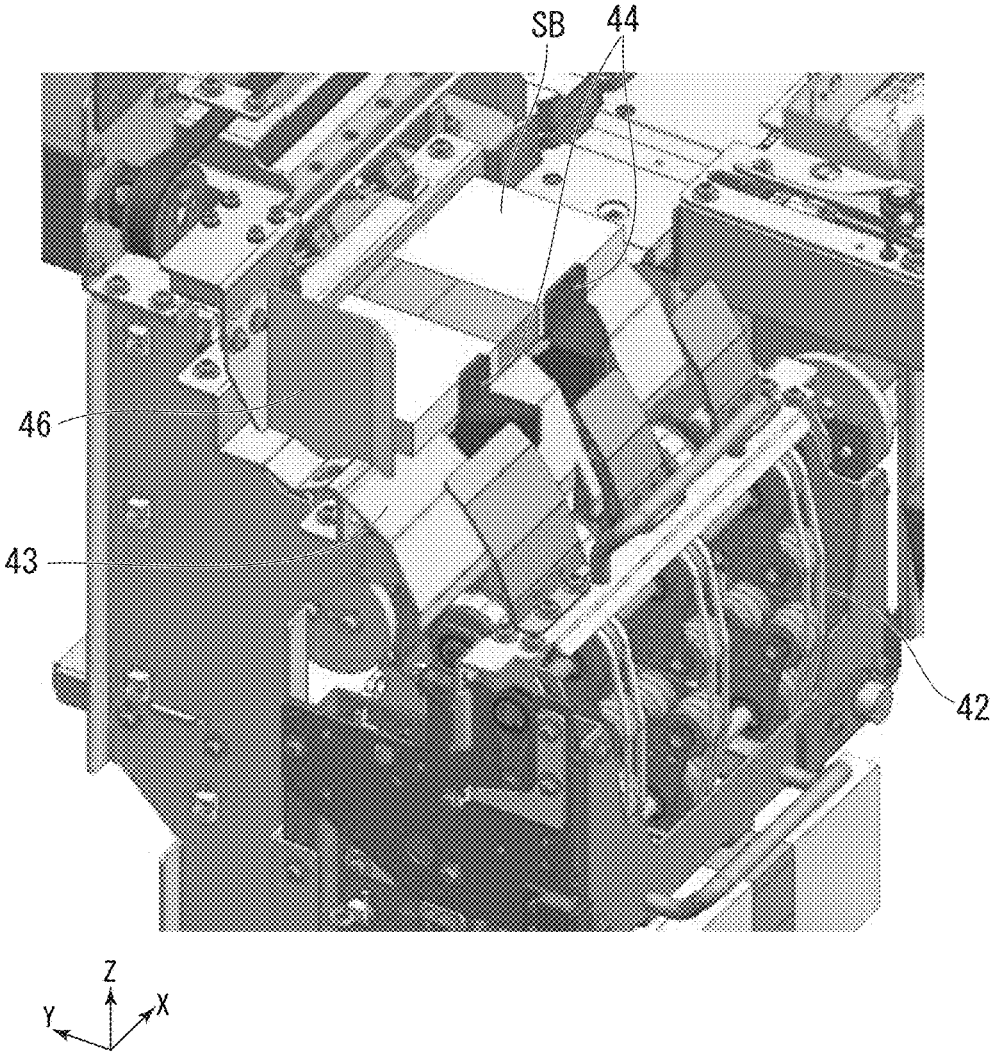
FIG. 31 is a partially enlarged perspective view of the small bundle picker 40 in the paper sheets pre-processing apparatus 5 of the embodiment.

FIG. 28 is a perspective view showing the exterior of the small bundle processing system of the paper sheets pre-processing apparatus 5 of the embodiment. FIG. 29 is a perspective view of the small bundle picker 40 of the paper sheets pre-processing apparatus 5 of the embodiment. FIG. 30 is a side view of the small bundle picker 40 of the paper sheets pre-processing apparatus 5 of the embodiment. FIG. 31 is a partially enlarged perspective view of the small bundle picker 40 of the paper sheets pre-processing apparatus 5 of the embodiment.

The small bundle processing system includes the small bundle picker 40 and the small band remover 50. The small bundle picker 40 receives the plurality of small bundles SB from the small bundle coupler 30 in a state in which the plurality of small bundles SB are coupled in a thickness direction. The small bundle picker 40 separates a small bundle SB down from the plurality of small bundles SB. The small bundle picker 40 includes a plurality of timing belts 41, a plurality of round belts 42, a guide 43, a small bundle lifter 44, a small bundle conveyance table 45 and a first sweeper 46.

Three timing belts 41 are arranged in parallel in a long side direction of the small bundle SB, and the small bundle SB at the head of the plurality of small bundles SB coupled by the small bundle coupler 30 is pressed in the +Y direction. Three round belts 42 are belts having a round cross section and are disposed in parallel in the long side direction of the small bundle SB. The round belts 42 are provided to be separated from each other in the Y direction by substantially the same thickness of the timing belts 41 and the small bundle SB as the one small bundle. Further, the round belts 42 may be moved by a mechanism moved in the thickness direction of the small bundle SB. The timing belts 41 and the round belts 42 are driven such that the small bundle SB is removed by a driving motor (not shown) thereabove. The timing belt 41 removes the one small bundle SB using a frictional force between the timing belt 41 and the small bundle SB. As shown in FIGS. 29 and 30, the round belt 42 conveys the one small bundle SB removed by the timing belts 41 upward while the one small bundle SB is sandwiched between the round belt 42 and the timing belt 41.

The small bundle lifter 44 is pivoted by a lifter driver 44*a* as a sensor (not shown) detects the conveyance of the small bundle SB to a predetermined delivery position. The small bundle lifter 44 stops at a predetermined small bundle reception position and supports the small bundle SB sandwiched between the timing belts 41 and the round belts 42 at the +Z direction side. As shown in FIGS. 30 and 31, the small bundle lifter 44 pivots to raise the small bundle SB using the front end portion, and conveys the small bundle SB to the small bundle conveyance table 45 along the guide 43. Accordingly, the posture of the one small bundle SB is varied from a vertically placed state to a horizontally placed state and the one small bundle SB is isolated on the small bundle conveyance table 45.

Figure 32:
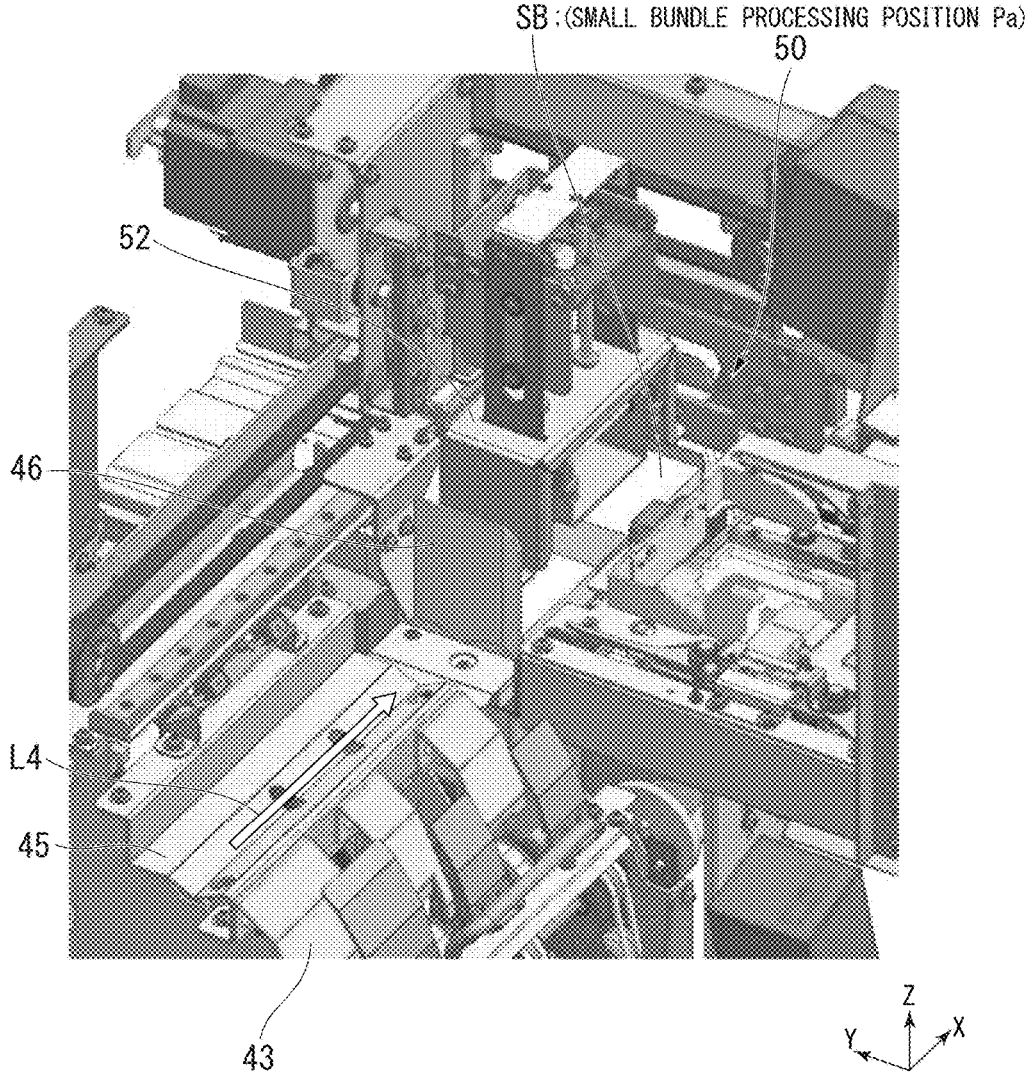
FIG. 32 is a perspective view showing a state in which the small bundle SB is conveyed by a first sweeper 46 of the small bundle picker 40 in the paper sheets pre-processing apparatus 5 of the embodiment.

The small bundle picker 40 slides the first sweeper 46 in the +X direction. The first sweeper 46 is pushed out of a side surface in the −X direction side of the one small bundle SB isolated on the small bundle conveyance table 45 and conveys the small bundle SB. Accordingly, the small bundle SB is conveyed to a small bundle processing position Pa. FIG. 32 is a perspective view showing a state in which the small bundle SB is conveyed by the first sweeper 46 of the small bundle picker 40 in the paper sheets pre-processing apparatus 5 of the embodiment. Further, the small bundle conveyance table 45 and the end portion in the Z direction of the first sweeper 46 is preferably a core structure configured to prevent the paper sheets P from being dropped. After the one small bundle SB is conveyed, the first sweeper 46 is returned to the −X direction side of the small bundle conveyance table 45 and awaits the conveyance of the next small bundle SB.

[Small Band Remover 50]

Hereinafter, an operation of removing the small band SBw from the small bundle SB using the small band remover 50 will be described.

Figure 33:
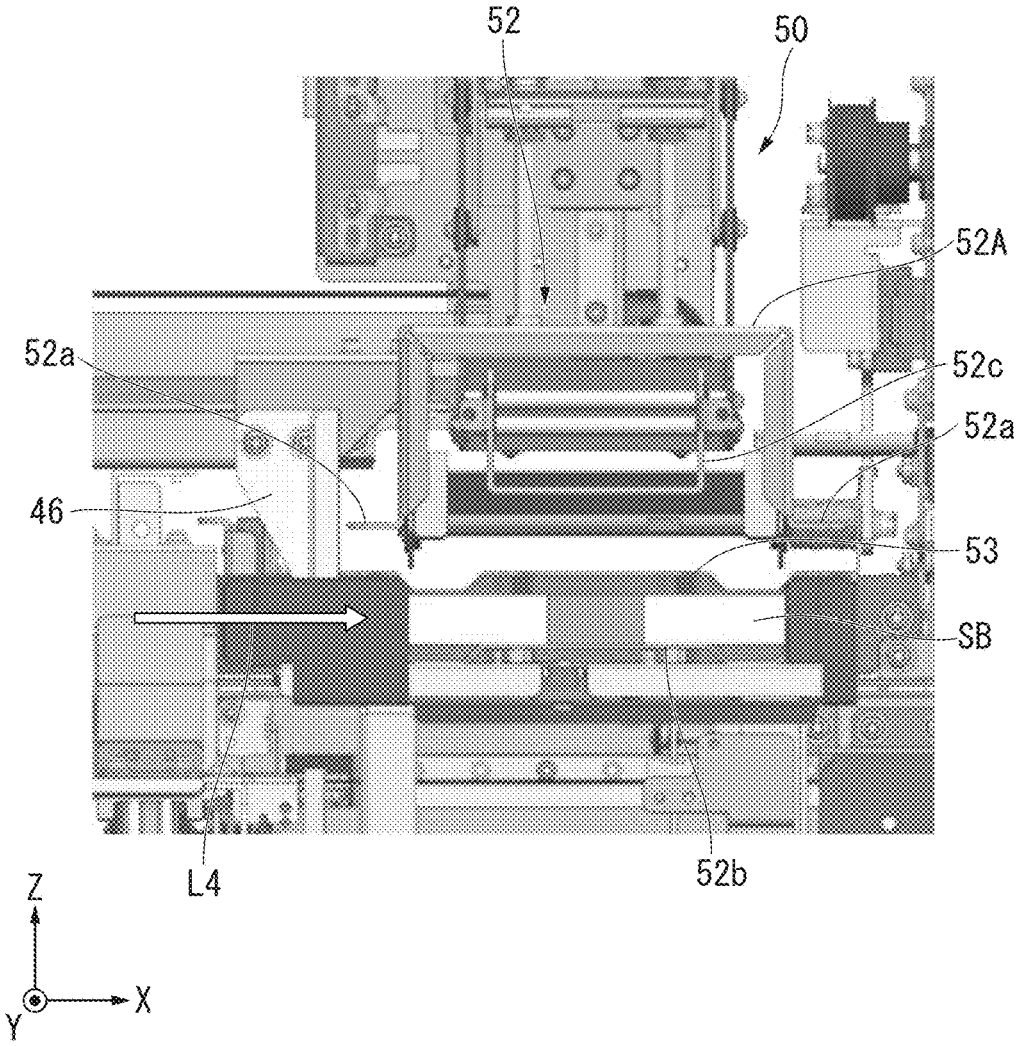
FIG. 33 is a front view of a small band remover 50 in the paper sheets pre-processing apparatus 5 of the embodiment.
Figure 34:
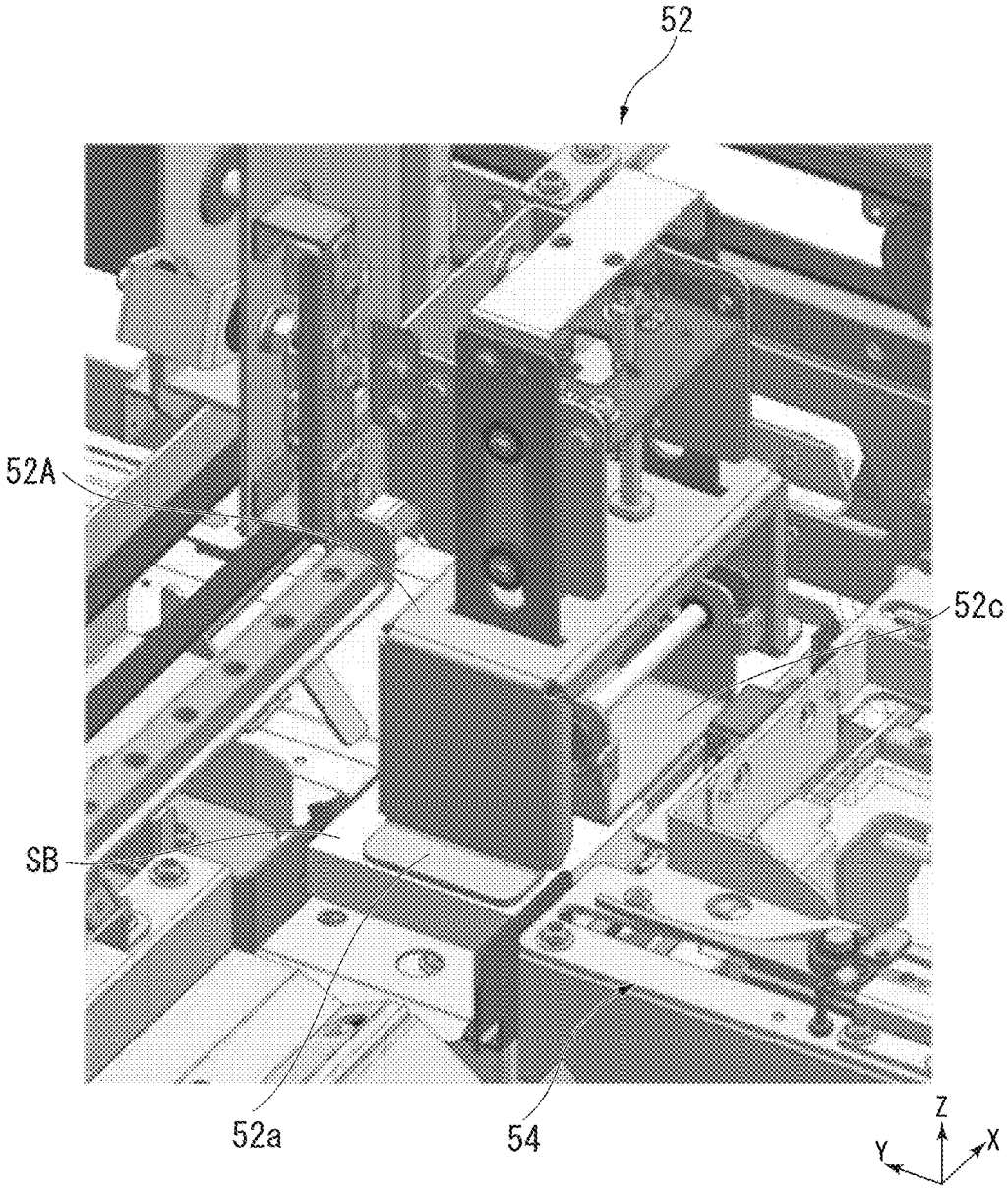
FIG. 34 is a perspective view of the small band remover 50 of the paper sheets pre-processing apparatus 5 of the embodiment.

FIG. 33 is a front view of the small band remover 50 of the paper sheets pre-processing apparatus 5 of the embodiment. FIG. 34 is a perspective view of the small band remover 50 of the paper sheets pre-processing apparatus 5 of the embodiment.

The small band remover 50 includes a small bundle press 52, a small band cutter 53 and a small band picker 54.

The small bundle press 52 includes a press arm 52A, both-end pressers 52*a*, a press stand 52*b* and a central presser 52*c*. As shown in FIG. 34, the one small bundle SB conveyed by the first sweeper 46 is placed on the press stand 52*b*. The small bundle press 52 is disposed on the small bundle SB by a moving mechanism (not shown) when the small band SBw is removed. As shown in FIG. 34, the press arm 52A is lowered by the moving mechanism such that the both-end pressers 52*a* come in contact with both ends of the upper surface of the small bundle SB in the X direction. In addition, the central presser 52*c* is lowered to press a substantially central portion of the small bundle SB. In this state, the small bundle press 52 presses the one small bundle SB conveyed to the press stand 52*b*, by the central presser 52*c* from an upper side toward a lower side.

Figure 35:
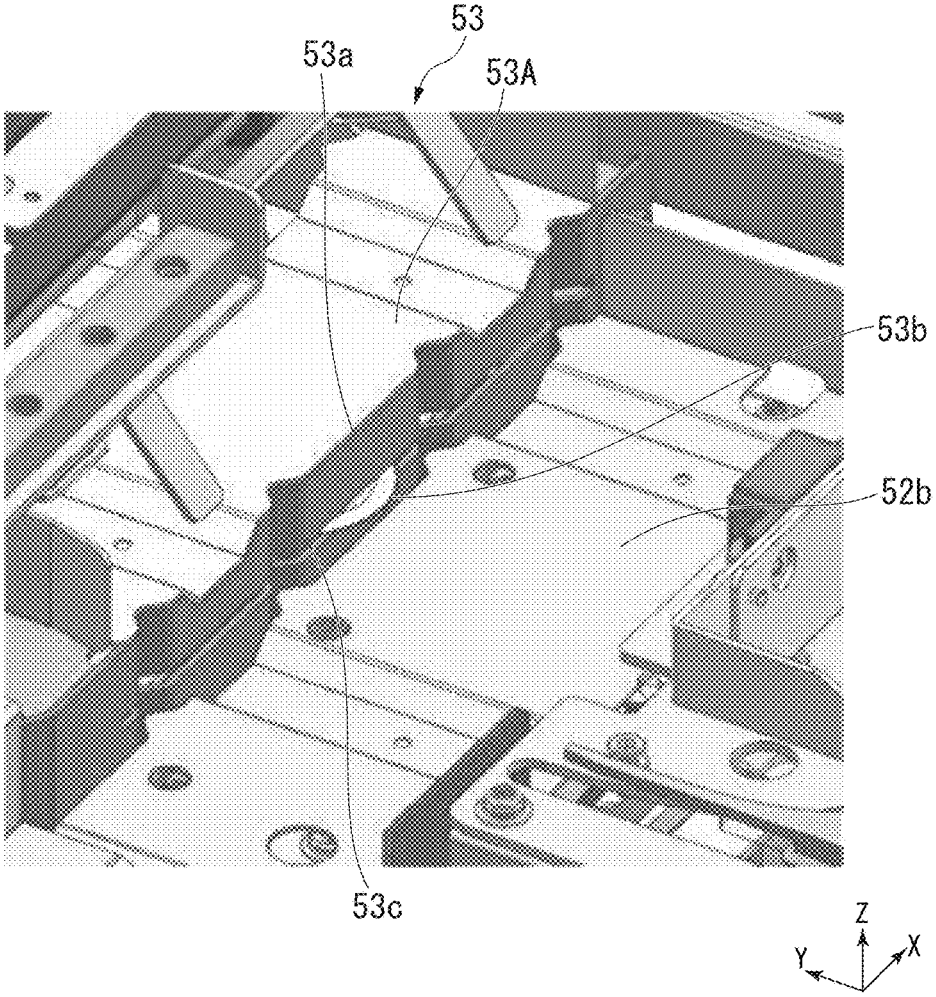
FIG. 35 is a perspective view of a small band cutter 53 of the small band remover 50 in the paper sheets pre-processing apparatus 5 of the embodiment.

FIG. 35 is a perspective view of the small band cutter 53 of the small band remover 50 in the paper sheets pre-processing apparatus 5 of the embodiment. The small band cutter 53 includes a main body section 53A at which a small bundle opposite surface 53*a* is formed, and a cutter 53*b*. As shown in FIG. 35, the small band cutter 53 operates such that the main body section 53A is raised in the +X direction before the small bundle SB is conveyed to the press stand 52*b*. Accordingly, the small band cutter 53 exposes the small bundle opposite surface 53*a*. The small band cutter 53 causes the small bundle opposite surface 53*a* to oppose the side surface of the small bundle SB in a state in which the small bundle SB is placed on the press stand 52*b*.

The small band cutter 53 slides the cutter 53*b* accommodated in the main body section 53A in the X direction to expose the cutter 53*b* from the small bundle opposite surface 53*a* when the small band SBw is to be removed. Next, the small band cutter 53 slides the cutter 53*b* in the X direction. A range in the X direction in which the cutter 53*b* is slid is set to include a winding position of the small band SBw in a state in which the small bundle SB is placed on the press stand 52*b*. The small band cutter 53 is lowered when the separated small bundles D are conveyed after the cutter 53*b* is accommodated in the main body section 53A. Further, the small bundle press 52 presses the small bundle SB with a press to stabilize a behavior of the small band SBw when the small band SBw is removed by the small band cutter 53.

FIGS. 36, 37, 38 and 39 are plan views showing an operation of the small band picker 54 of the small band remover 50 in the paper sheets pre-processing apparatus 5 of the embodiment.

Figure 36:
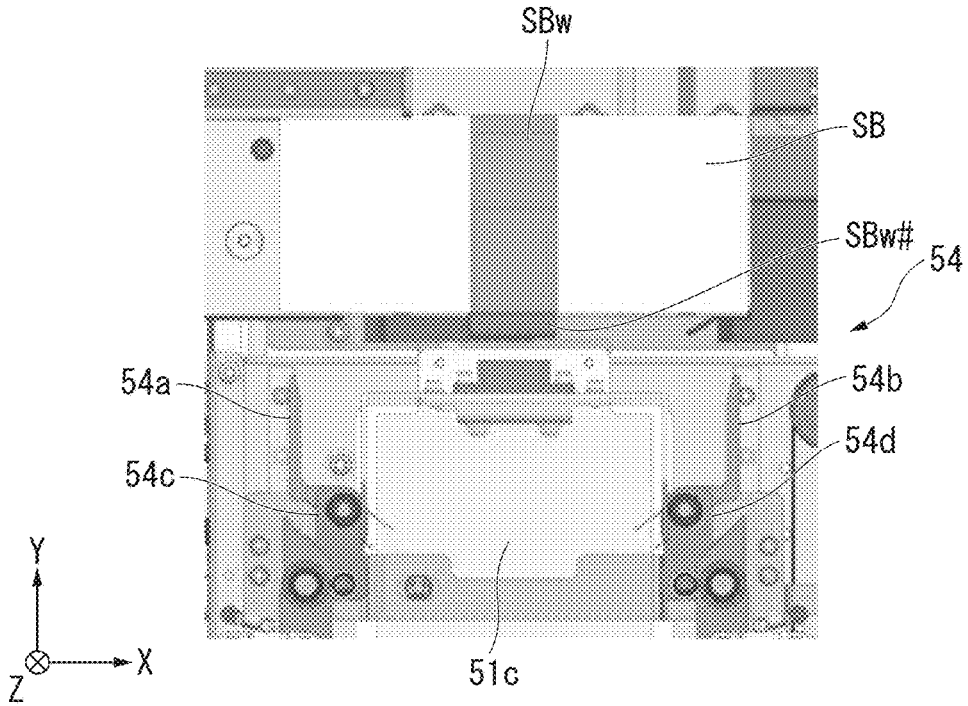
FIG. 36 is a plan view showing an operation of a small band picker 54 of the small band remover 50 in the paper sheets pre-processing apparatus 5.

The small band picker 54 separates the small band SBw cut by the small band cutter 53 from the small bundle SB. As shown in FIG. 36, the small band picker 54 is disposed at an opposite side of the small band cutter 53 in the short side direction of the small bundle SB. The small band picker 54 includes a first picker claw 54*a*, a second picker claw 54*b*, a first cam 54*c* and a second cam 54*d*.

The first picker claw 54*a* is connected to the first cam 54*c*. The second picker claw 54*b* is connected to the second cam 54*d*. The first picker claw 54*a* and the first cam 54*c* are disposed to oppose the second picker claw 54*b* and the second cam 54*d* in the X direction via a photographing stage 51*c*. The first cam 54*c* is driven by a driving mechanism (not shown), and performs an operation of linearly moving the first picker claw 54*a* in the Y direction and an operation of pivoting the front end portion of the first picker claw 54*a*. The second cam 54*d* is driven by a driving mechanism (not shown), and performs an operation of linearly moving the second picker claw 54*b* in the Y direction and an operation of pivoting the front end portion of the second picker claw 54*b*.

When the small band SBw is separated from the small bundle SB by the small band picker 54, the small bundle press 52 preferably presses the small bundle SB with a pressure to prevent the paper sheets P from being extracted from the small bundle SB. In addition, in the small bundle press 52, in order to easily hook the small band SBw by the small band picker 54, it is preferable to cause the small band SBw to deviate from the small bundle SB at a predetermined amount by the central presser 52*c*. In a state in which the small bundle SB is pressed by the both-end pressers 52*a* of the small bundle press 52, as shown in FIG. 36, a portion SBw# of the small band picker 54 side of the small band SBw is bent in the −Y direction with respect to the small bundle SB.

Figure 37:
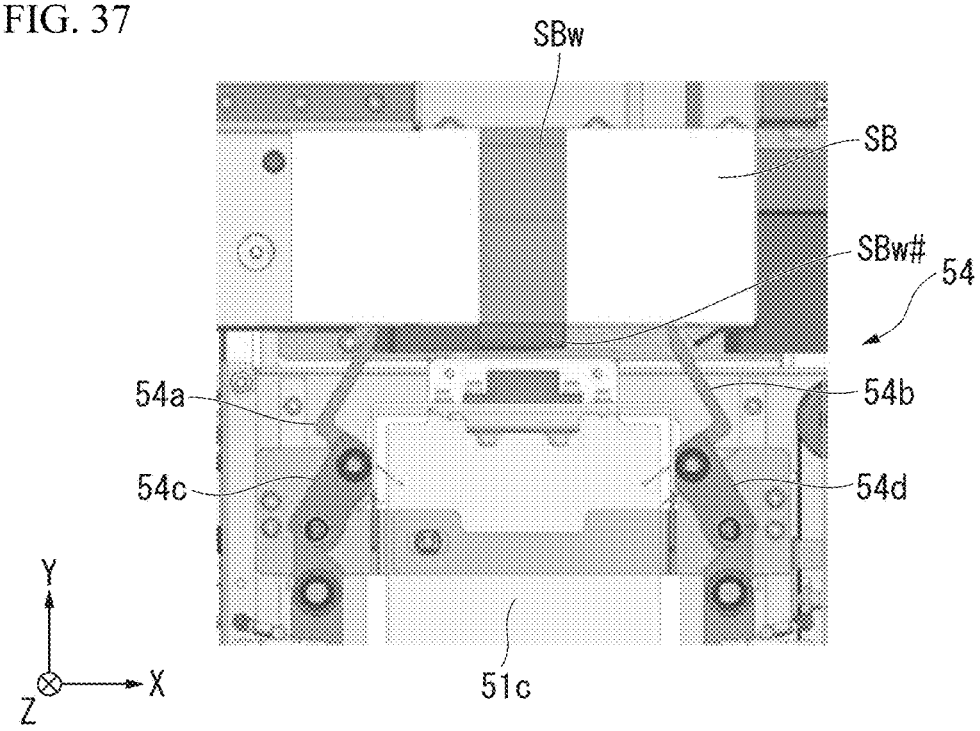
FIG. 37 is a plan view showing the operation of the small band picker 54 of the small band remover 50 in the paper sheets pre-processing apparatus 5.
Figure 38:
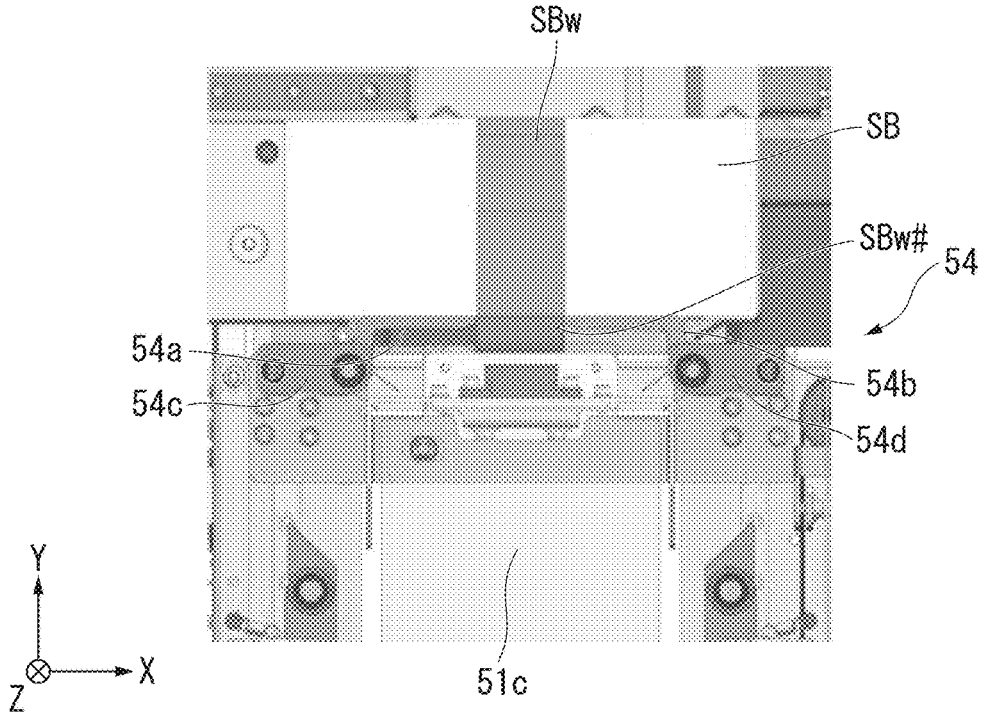
FIG. 38 is a plan view showing the operation of the small band picker 54 of the small band remover 50 in the paper sheets pre-processing apparatus 5.
Figure 39:
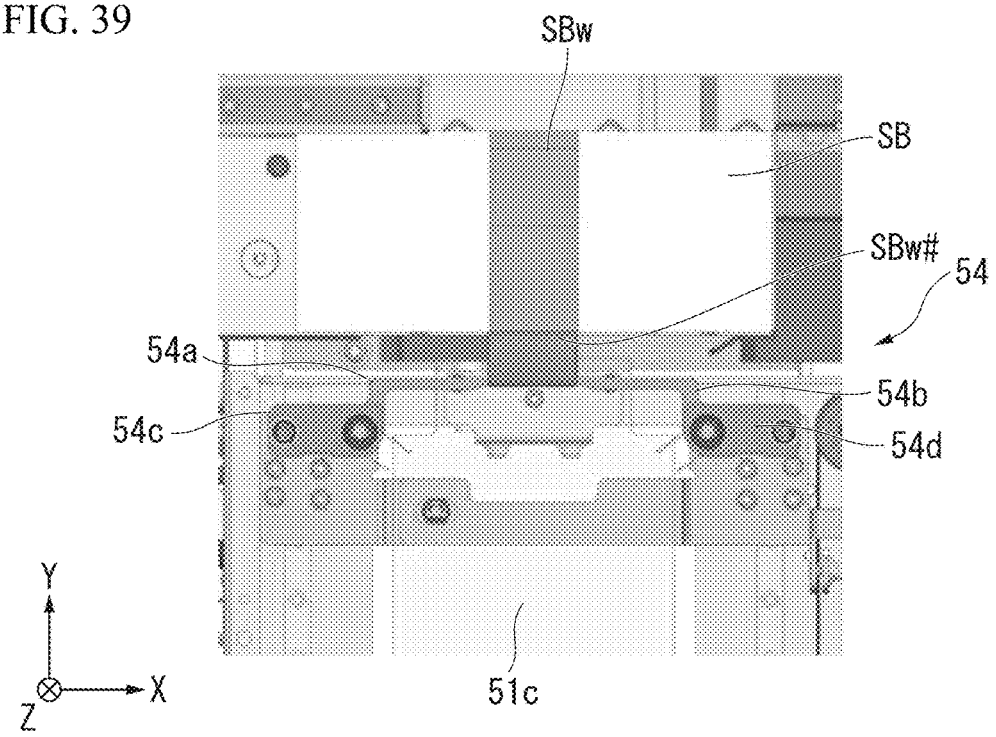
FIG. 39 is a plan view showing the operation of the small band picker 54 of the small band remover 50 in the paper sheets pre-processing apparatus 5.

As shown in FIG. 37, the small band picker 54 moves the front end portions of the first picker claw 54*a* and the second picker claw 54*b* in the Y direction using the first cam 54*c* and the second cam 54*d* after the small band SBw is cut by the small band cutter 53. Next, the first cam 54*c* and the second cam 54*d* pivot the front end portions of the first picker claw 54*a* and the second picker claw 54*b* as the posture thereof is deviated from the Y direction to the X direction. Next, as shown in FIG. 38, the first cam 54*c* and the second cam 54*d* are operated such that the lengthwise direction thereof is parallel to the long side direction of the small bundle SB, and further, pivot the first picker claw 54*a* and the second picker claw 54*b*. Accordingly, the first picker claw 54*a* and the second picker claw 54*b* are disposed parallel to the long side direction of the small bundle SB, and the front end portions are disposed to oppose each other in the portion SBw# of the small band SBw. Next, as shown in FIG. 39, the first cam 54*c* and the second cam 54*d* slide the first picker claw 54*a* and the second picker claw 54*b* in the −Y direction as the first cam 54*c* and the second cam 54*d* are moved in the −Y direction. Accordingly, in the first picker claw 54*a* and the second picker claw 54*b*, the small band SBw is hooked by the front end portions at the −Y direction side and the small band SBw is pulled off the small bundle SB. Further, the small bundle press 52 is preferably pressed from above the small bundle SB with a pressure to prevent the paper sheets P from being extracted in an operation in which the small band SBw is pulled off the small bundle SB.

Figure 40:
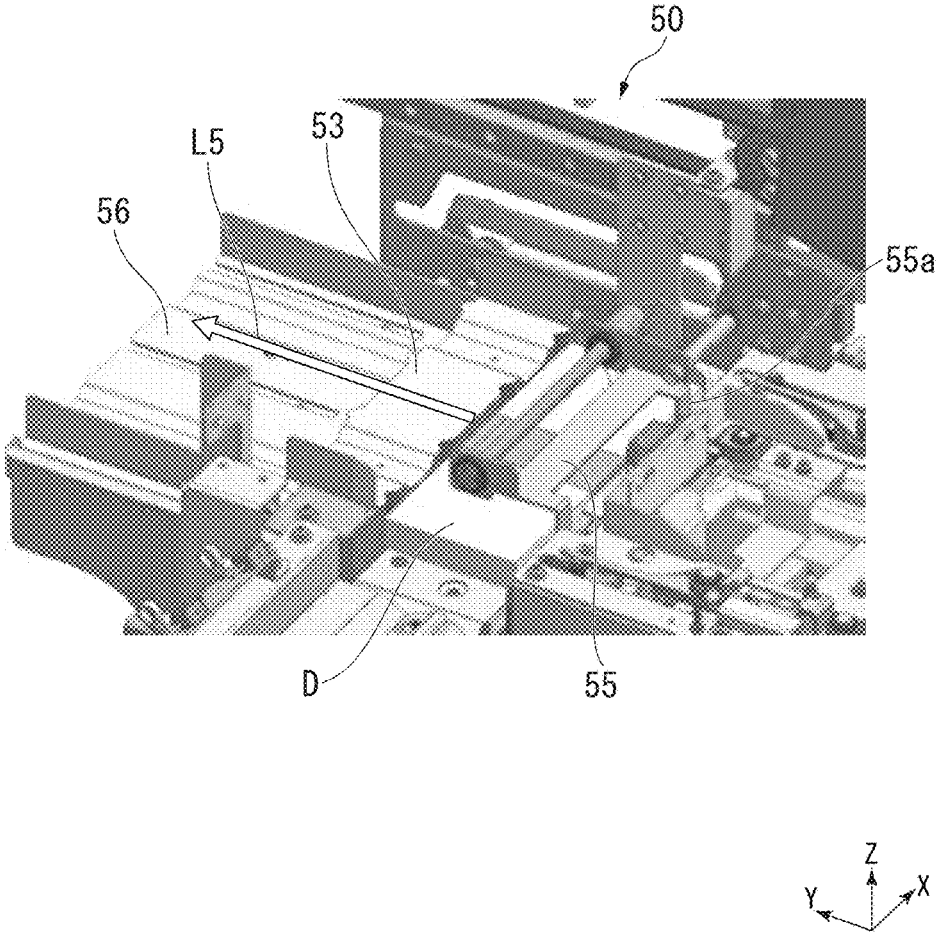
FIG. 40 is a perspective view showing a second sweeper 55 of the small band remover 50 in the paper sheets pre-processing apparatus 5 of the embodiment.
Figure 41:
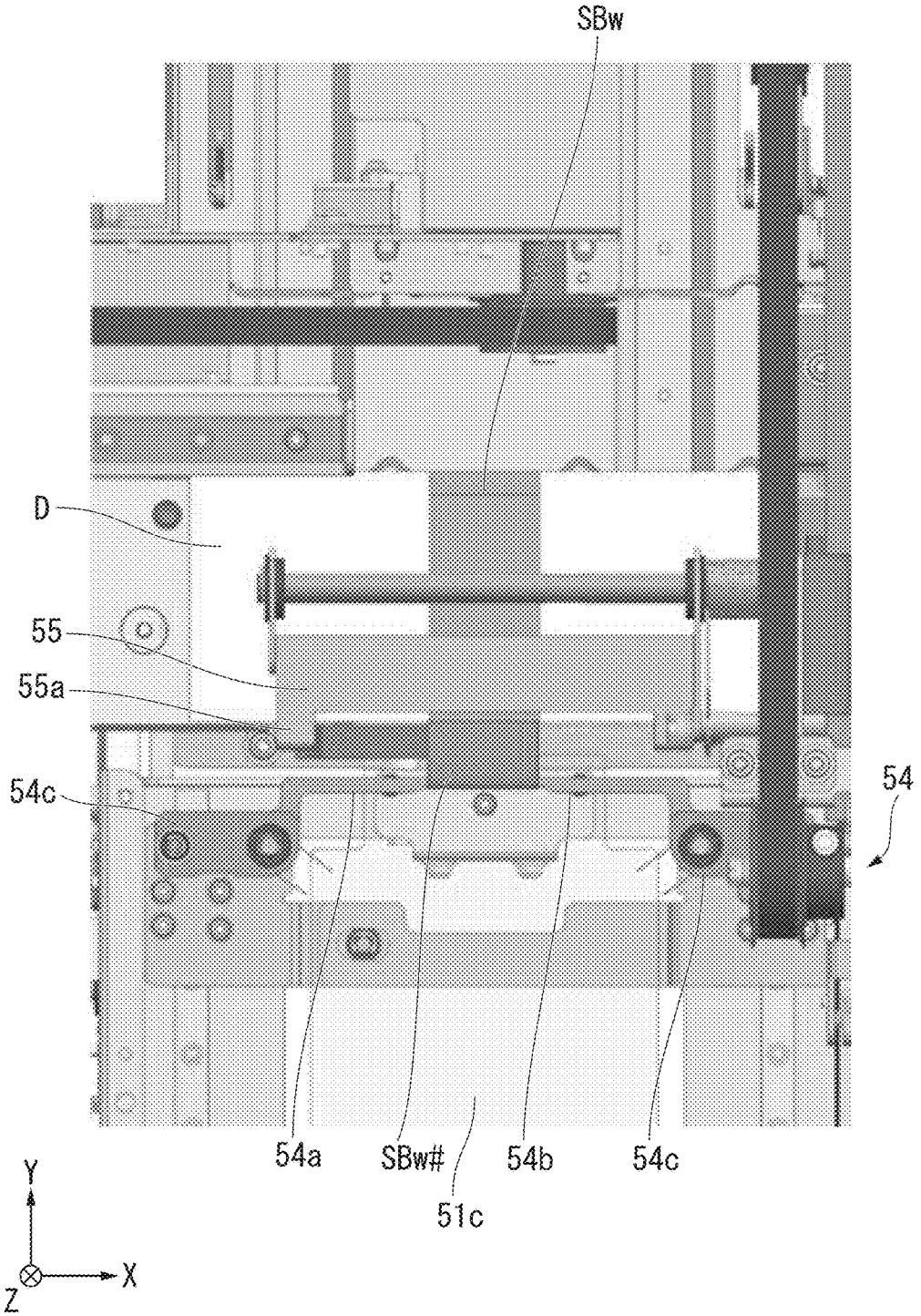
FIG. 41 is a plan view showing the second sweeper 55 of the small band remover 50 in the paper sheets pre-processing apparatus 5 of the embodiment.
Figure 42:
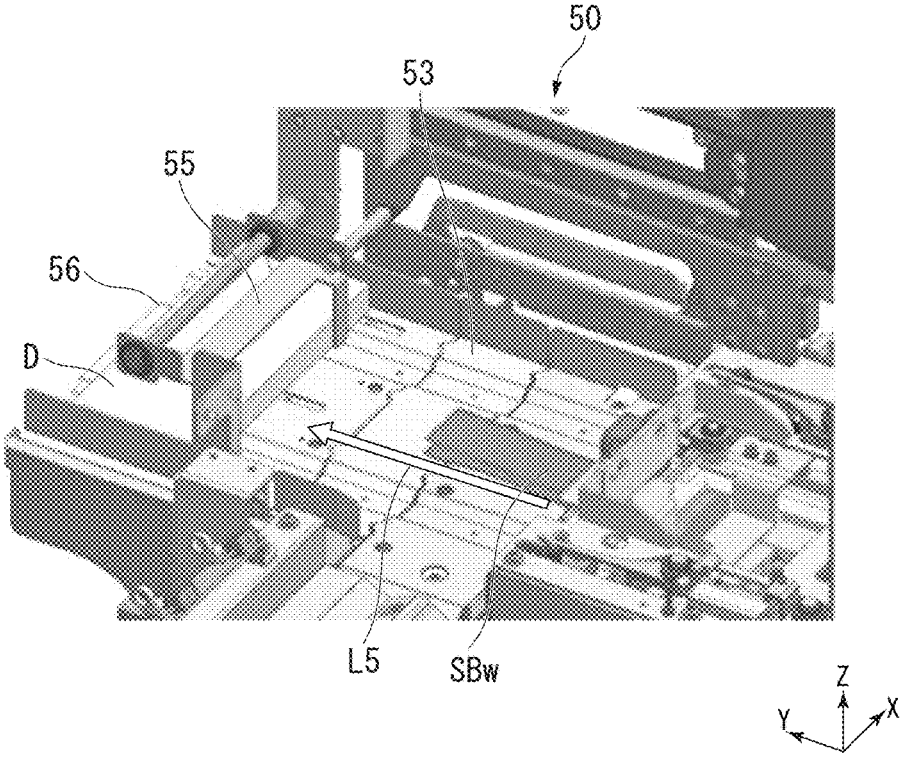
FIG. 42 is a perspective view showing an operation of the second sweeper 55 of the small band remover 50 in the paper sheets pre-processing apparatus 5 of the embodiment.
Figure 43:
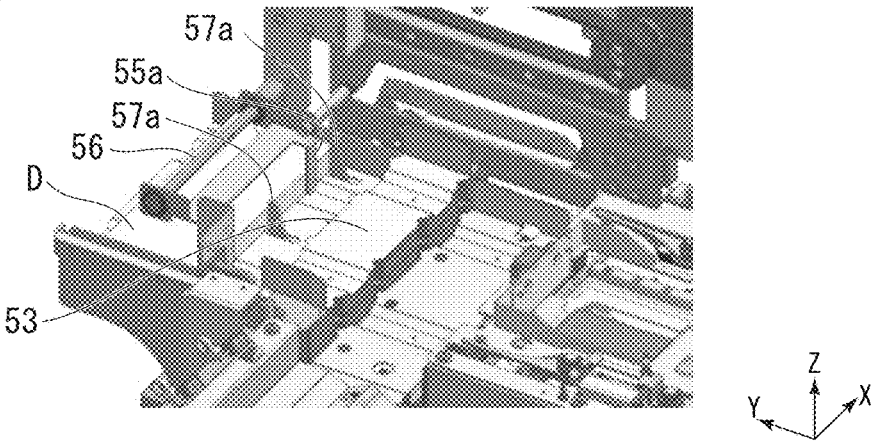
FIG. 43 is a perspective view showing a third sweeper 57 of the small band remover 50 in the paper sheets pre-processing apparatus 5 of the embodiment.

FIGS. 40, 41 and 42 are views showing an operation of a second sweeper 55 of the small band remover 50. FIG. 40 is a perspective view showing the second sweeper 55 of the small band remover 50 in the paper sheets pre-processing apparatus 5 of the embodiment. FIG. 41 is a plan view showing the second sweeper 55 of the small band remover 50 in the paper sheets pre-processing apparatus 5 of the embodiment. FIG. 42 is a perspective view showing an operation of the second sweeper 55 of the small band remover 50 in the paper sheets pre-processing apparatus 5 of the embodiment. FIG. 43 is a plan view showing an operation of the second sweeper 55 of the small band remover 50 in the paper sheets pre-processing apparatus 5 of the embodiment.

The small band remover 50 includes the second sweeper 55 and a separated small bundles conveyance table 56. The second sweeper 55 conveys the small bundles separated by pulling the small band SBw off the small bundle SB by the small band picker 54 to the separated small bundles conveyance table 56. As shown in FIGS. 40 and 41, the second sweeper 55 includes a second sweeper arm 55*a*. The second sweeper arm 55*a* has an L shape when seen in the X direction. The second sweeper arm 55*a* presses the separated small bundles D from an upper side using a portion parallel to the Y direction in a state in which the separated small bundles D are moved. In addition, the second sweeper arm 55*a* supports the separated small bundles D from the −Y direction using a portion parallel to the Z direction in a state in which the separated small bundles D are conveyed.

In addition, the small band cutter 53 lowers the main body section 53A before the separated small bundles D are conveyed by the second sweeper 55. Accordingly, the upper surface of the main body section 53A disposes substantially the same position in the Z direction as the separated small bundles conveyance table 56. Further, the upper surface of the main body section 53A, the separated small bundles conveyance table 56 and the end portion of the −Z direction side of the second sweeper arm 55*a* preferably become a core structure configured to prevent the paper sheets P from dropping from the separated small bundles D.

As shown in FIGS. 40 and 41, the second sweeper 55 disposed the second sweeper arm 55*a* at the −Y direction side of the separated small bundles D, and then, as shown in FIG. 42, slides the second sweeper arm 55*a* toward the +Y direction side. Accordingly, the second sweeper 55 conveys the separated small bundles D along the conveyance path L5 (the Y direction). The second sweeper 55 causes the separated small bundles D to pass over the main body section 53A to be conveyed onto the separated small bundles conveyance table 56. As a result, the second sweeper 55 separates the small band SBw from the separated small bundles D. Afterward, the small band picker 54 further moves the first cam 54*c* and the second cam 54*d* in the −Y direction and conveys the small band SBw to a position on the predetermined photographing stage 51*c*.

Figure 44:
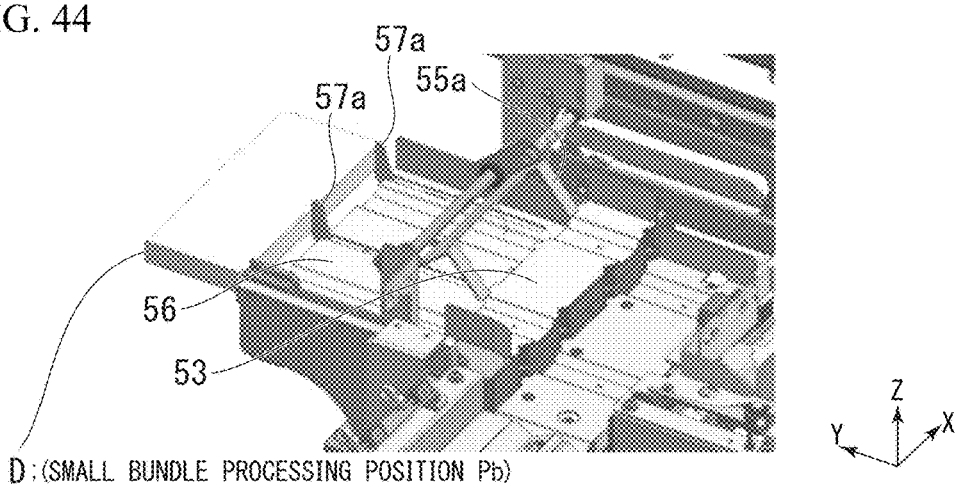
FIG. 44 is a perspective view showing an operation of the third sweeper 57 of the small band remover 50 in the paper sheets pre-processing apparatus 5 of the embodiment.
Figure 45:
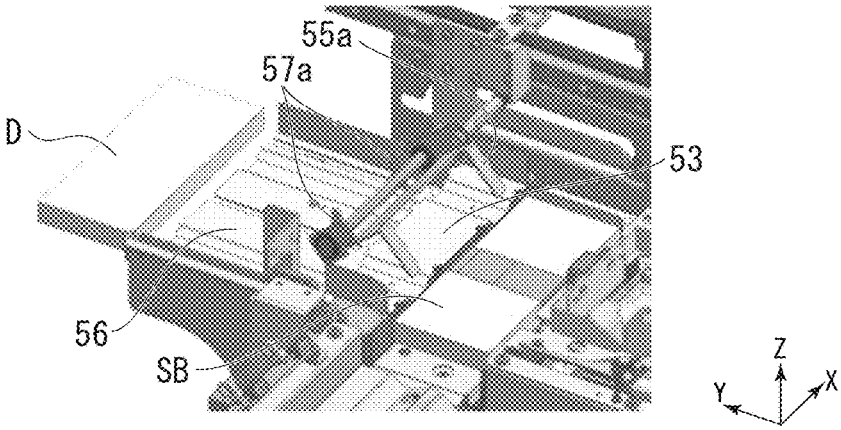
FIG. 45 is a perspective view showing another operation of the second sweeper 55 of the small band remover 50 in the paper sheets pre-processing apparatus 5 of the embodiment.

FIGS. 43, 44 and 45 are views showing an operation of a third sweeper 57 of the small band remover 50. FIG. 43 is a perspective view showing the third sweeper 57 of the small band remover 50 in the paper sheets pre-processing apparatus 5 of the embodiment. FIG. 44 is a perspective view showing an operation of the third sweeper 57 of the small band remover 50 in the paper sheets pre-processing apparatus 5 of the embodiment. FIG. 45 is a perspective view showing another operation of the second sweeper 55 of the small band remover 50 in the paper sheets pre-processing apparatus 5 of the embodiment.

The small band remover 50 includes the third sweeper 57. The third sweeper 57 discharges the separated small bundles D conveyed by the second sweeper 55 from the separated small bundles conveyance table 56. As shown in FIG. 43, the third sweeper 57 includes a plurality of claw sections 57*a*, 57*b* and 57*c*. The claw sections 57*a*, 57*b* and 57*c* are connected to a movable guide (not shown) and raised or lowered (withdrawn) by a vertical operation of the movable guide. The claw sections 57*a*, 57*b* and 57*c* are raised as the separated small bundles D are conveyed to a predetermined position on the separated small bundles conveyance table 56 by the second sweeper 55. Accordingly, the claw sections 57*a*, 57*b* and 57*c* are exposed from the upper surface of the separated small bundles conveyance table 56 and disposed at the −Y direction side of the separated small bundles D.

Next, as shown in FIG. 44, the third sweeper 57 moves the claw sections 57*a*, 57*b* and 57*c* in the Y direction. Accordingly, the claw sections 57*a*, 57*b* and 57*c* support the side surface in the −Y direction side of the separated small bundles D and convey the side surface to the +Y direction side. As a result, the claw sections 57*a*, 57*b* and 57*c* discharge the separated small bundles D from the separated small bundles conveyance table 56. The separated small bundles D freely drop onto a position (a small bundle discharge position Pb) by being pushed off the separated small bundles conveyance table 56.

Afterward, as shown in FIG. 45, the third sweeper 57 is withdrawn and lowered to a position before the discharge of the separated small bundles D. In addition, the second sweeper 55 moves in the −Y direction and is withdrawn to convey the next separated small bundle D. In addition, the small band cutter 53 raises the main body section 53A to cut the small band SBw of the next small bundle SB when the claw sections 57*a*, 57*b* and 57*c* are raised.

Hereinafter, an operation of reading the bar code SBb and discarding the small band SBw using the small band remover 50 will be described.

Figure 46:
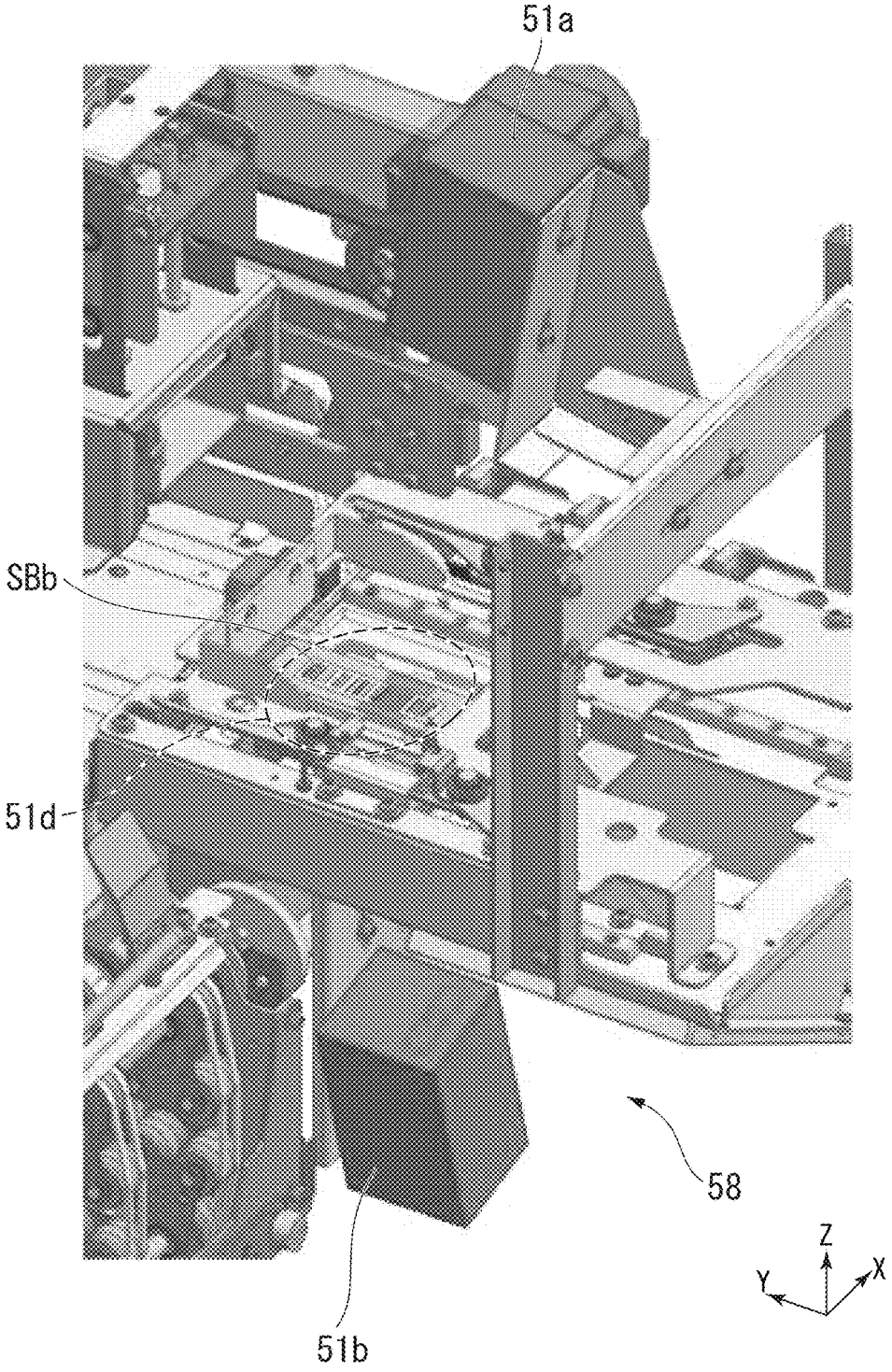
FIG. 46 is a perspective view showing a state in which a bar code SBb is read by the small band remover 50 in the paper sheets pre-processing apparatus 5 of the embodiment.
Figure 47:
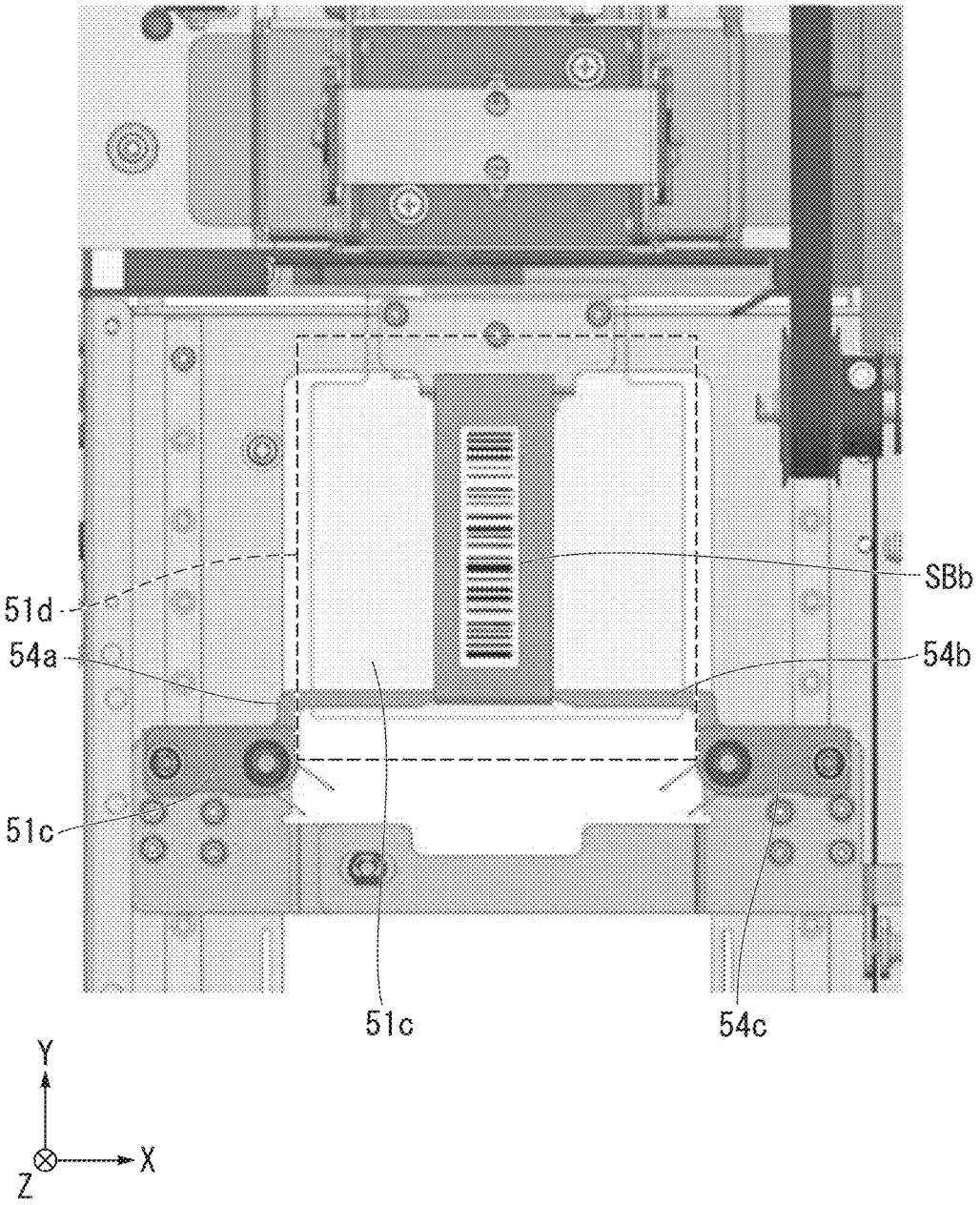
FIG. 47 is a plan view showing the aspect in which the bar code SBb is read by the small band remover 50 in the paper sheets pre-processing apparatus 5 of the embodiment.
Figure 48:
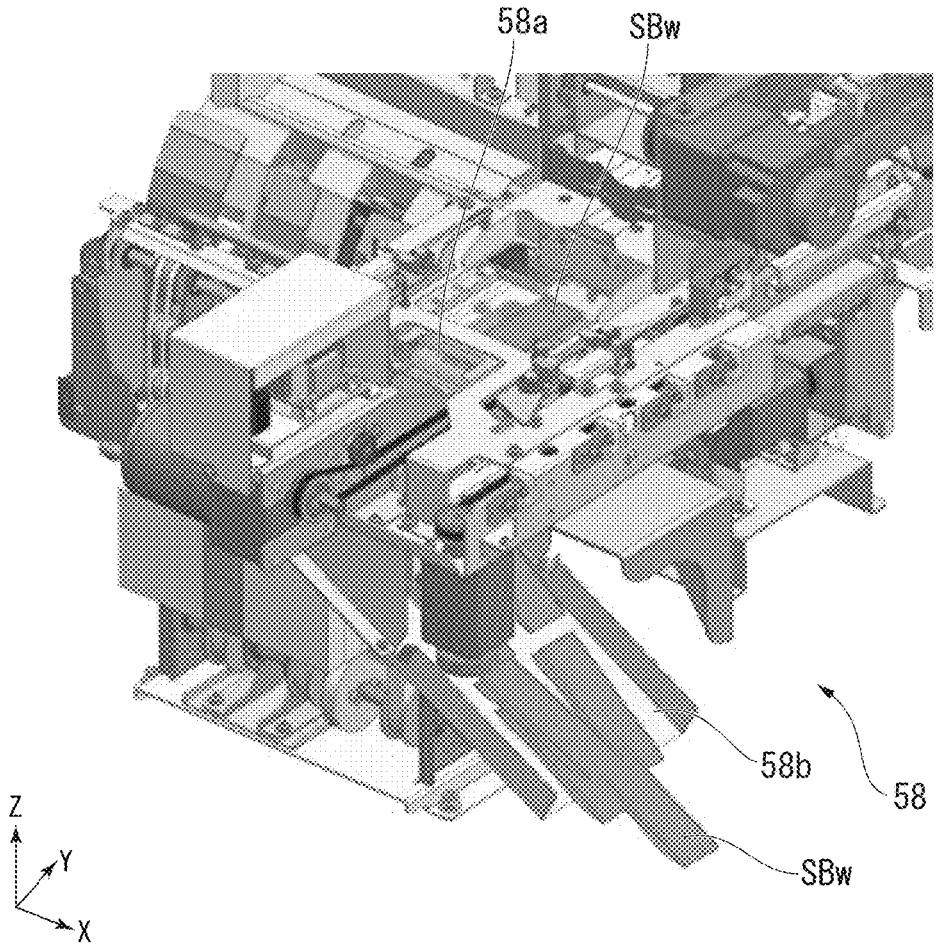
FIG. 48 is a perspective view showing a state in which a small band SBw is discarded by the small band remover 50 in the paper sheets pre-processing apparatus 5 of the embodiment.
Figure 49:
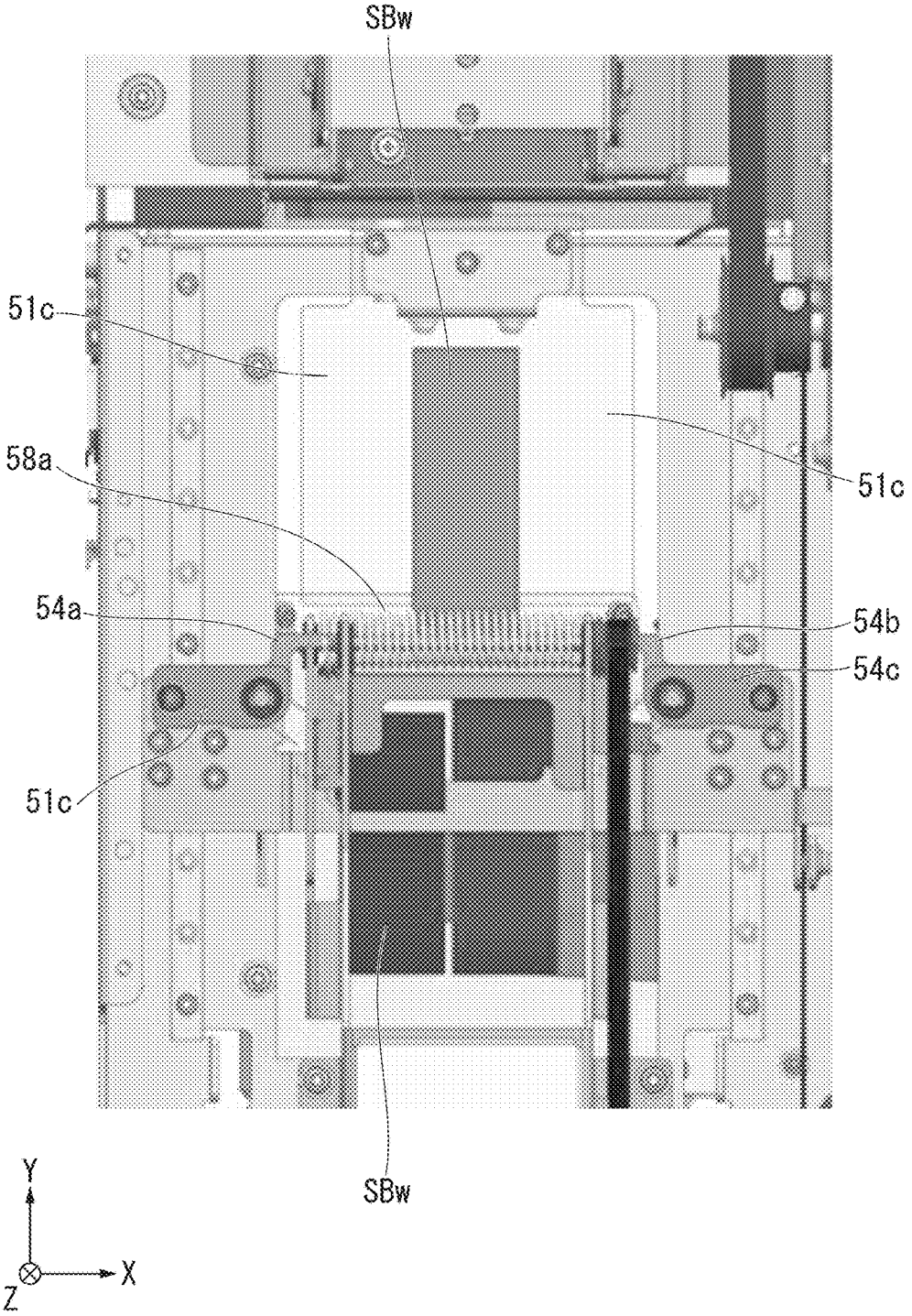
FIG. 49 is a plan view showing the aspect in which the small band SBw is discarded by the small band remover 50 in the paper sheets pre-processing apparatus 5 of the embodiment.

FIG. 46 is a perspective view showing a state in which the bar code SBb is read by the small band remover 50 in the paper sheets pre-processing apparatus 5 of the embodiment. FIG. 47 is a plan view showing a state in which the bar code SBb is read by the small band remover 50 in the paper sheets pre-processing apparatus 5 of the embodiment. FIG. 48 is a perspective view showing a state in which the small band SBw is discarded by the small band remover 50 in the paper sheets pre-processing apparatus 5 of the embodiment. FIG. 49 is a plan view showing a state in which the small band SBw is discarded by the small band remover 50 in the paper sheets pre-processing apparatus 5 of the embodiment.

The small band remover 50 includes image capturers 51*a* and 51*b*, the photographing stage 51*c* and a small band discharger 58. As shown in FIG. 46, the small band SBw is separated from the separated small bundles D and conveyed in the −Y direction by the small band picker 54. Accordingly, as shown in FIG. 47, the small band SBw is conveyed onto the photographing stage 51*c*. The photographing stage 51*c* is a transparent plate-shaped member.

The photographing stage 51*c* is included in a photographing range 51*d* by the image capturers 51*a* and 51*b*. The image capturers 51*a* and 51*b* photograph the small band SBw from above and below according to conveyance of the small band SBw to the photographing stage 51*c*. The image capturers 51*a* and 51*b* generate image information of the photographed bar code SBb. The image capturers 51*a* and 51*b* analyze the generated image information and generate small bundle information (information reader).

As shown in FIG. 49, the small band discharger 58 includes a small band removal roller 58*a* and a small band discharge guide 58*b*. As shown in FIG. 49, the small band removal roller 58*a* is installed at the −Y direction side of the photographing stage 51*c*. The small band removal roller 58*a*, the X direction of which becomes a lengthwise direction, has a tandem form. The small band removal roller 58*a* is rotationally driven in the −Y direction by a driving mechanism (not shown) around the X direction serving as an axis of rotation. After the bar code SBb is photographed, the small band SBw is conveyed to the small band removal roller 58*a* by the small band picker 54. The small band removal roller 58*a* rolls up the small band SBw conveyed by the rotation operation to send the small band SBw to the −Y direction side. The small band discharge guide 58*b* receives the small band SBw sent by the small band removal roller 58*a* as shown in FIG. 49 and discharges the small band SBw to the outside as shown in FIG. 48.

[Small Bundle Accumulator 60]

Figure 50:
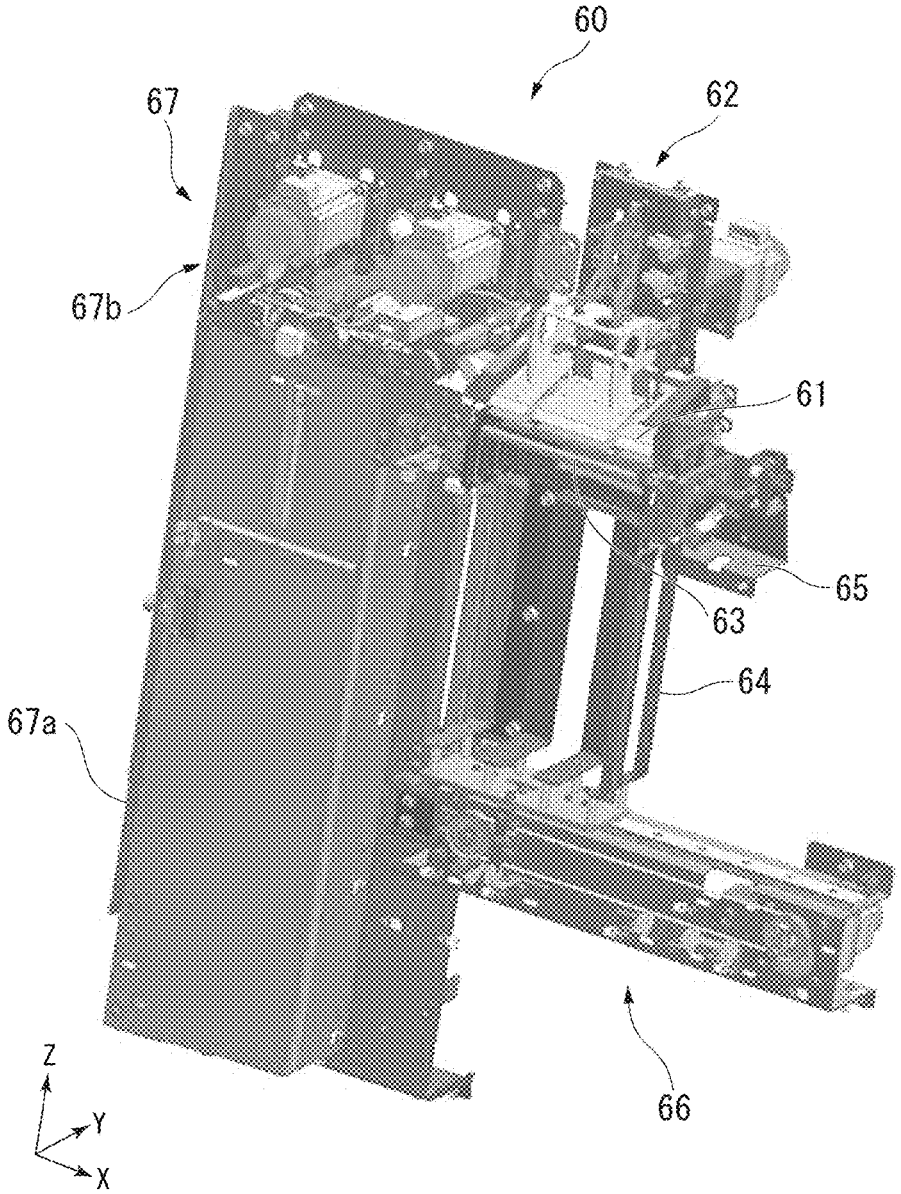
FIG. 50 is an exterior view of a small bundle accumulation processing system of the paper sheets pre-processing apparatus 5 of the embodiment.
Figure 51:
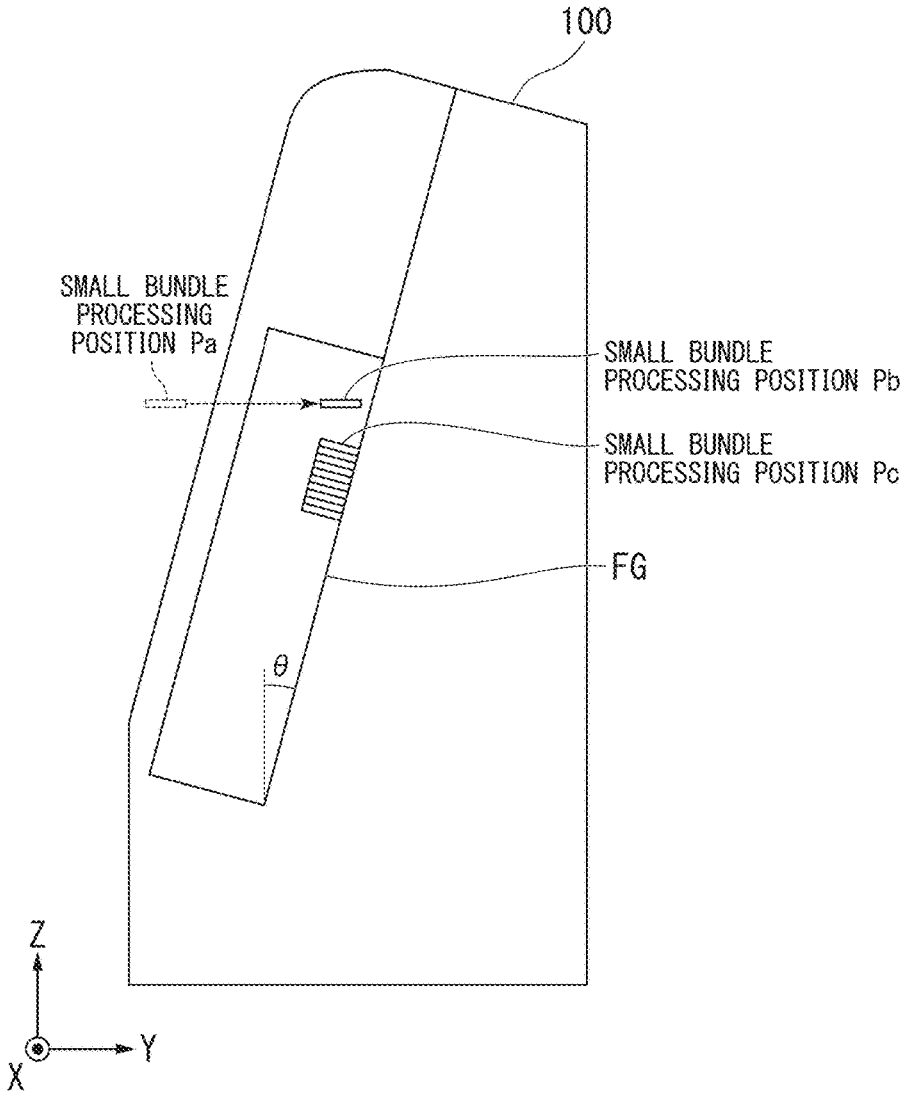
FIG. 51 is a schematic diagram of the main body processing apparatus 100 of the embodiment.

Hereinafter, the small bundle accumulator 60 of the embodiment will be described. FIG. 50 is an exterior view of a small bundle accumulation processing system of the paper sheets pre-processing apparatus 5 of the embodiment. FIG. 51 is a schematic diagram of the main body processing apparatus 100 of the embodiment.

As shown in FIG. 51, in the small bundle accumulator 60, the separated small bundles D discharged by the small band remover 50 are accumulated at a small bundle accumulation position Pc by the small bundle accumulator 60. In the main body processing apparatus 100, the paper sheets P are transferred to the X direction side (a forward direction of FIG. 51) in a state in which the paper sheets P of the processing target are accumulated. The main body processing apparatus 100 accumulates the transferred paper sheets P on the feeder guide FG. The feeder guide FG is inclined by a predetermined angle θ with respect to the Z direction to accumulate the plurality of paper sheets P. The plurality of paper sheets P accumulated on the feeder guide FG are ejected one by one to be sent to a conveyance path. Further, the feeder guide FG may be a portion of a reception mechanism of the separated small bundles D of an accumulated sheet supply 112 of the main body processing apparatus 100 (to be described below).

As shown in FIG. 50, the small bundle accumulator 60 includes a small bundle shutter 61, a small bundle press 62, a small bundle accumulation support 63, a small bundle transferor 64, an arranger 65, a transfer driver 66 and a card stacker 67.

Figure 52:
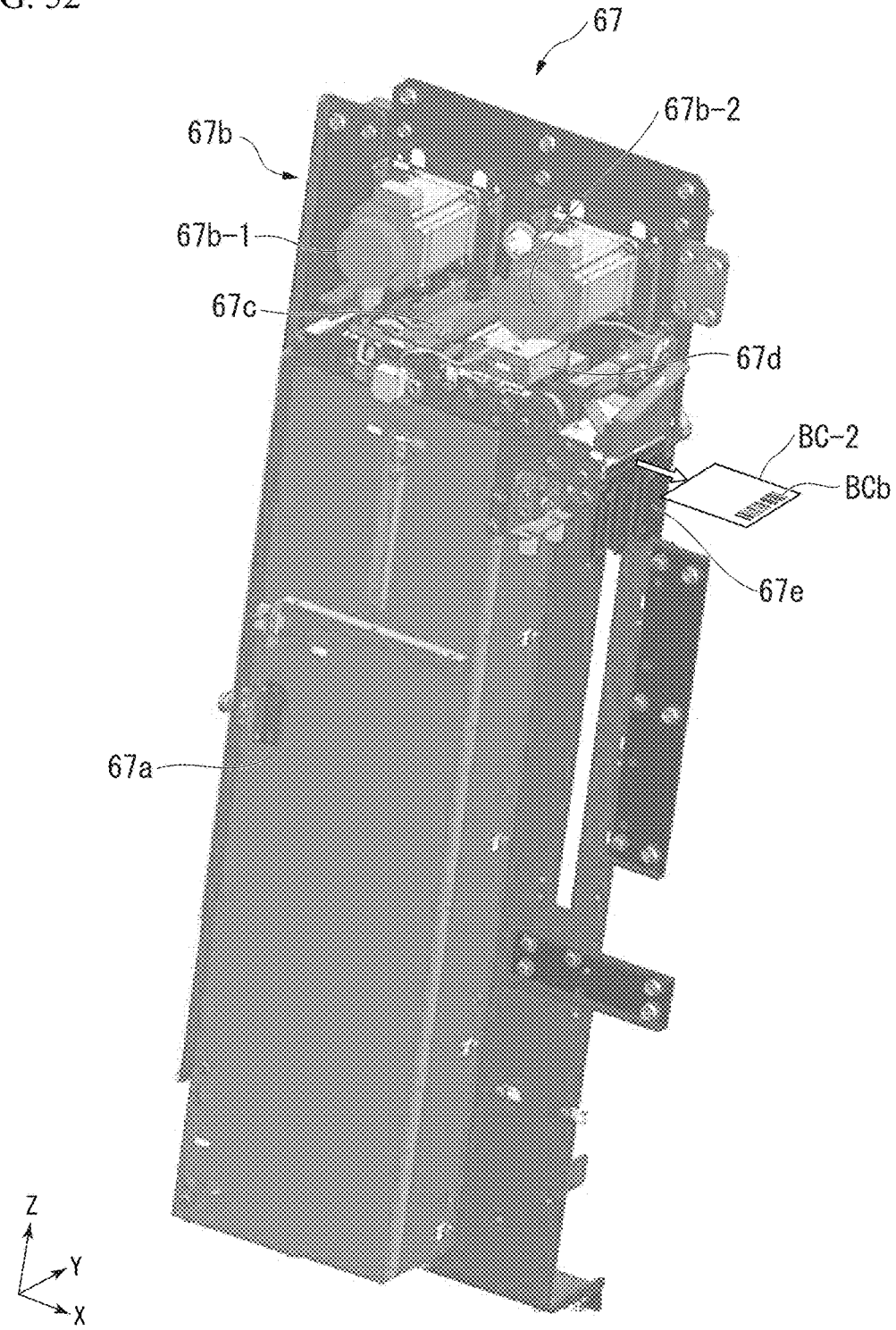
FIG. 52 is a perspective view of a card stacker 67 of the paper sheets pre-processing apparatus 5 of the embodiment.

FIG. 52 is a perspective view of the card stacker 67 of the paper sheets pre-processing apparatus 5 of the embodiment. The card stacker 67 inserts the secondary batch card BC-2 into each of the separated small bundles D to identify the separated small bundles D from which the small band SBw is removed. A bar code BCb on which strap numbers for identifying the separated small bundles D are encoded is printed on the secondary batch card BC-2. The card stacker 67 includes a card stacker 67*a*, a card conveyer 67*b*, a feed controller 67*c*, a bar code reader 67*d* and a support driver 67*e*. The card stacker 67*a* accommodates a plurality of secondary batch cards BC-2 such that a printing surface of the bar code BCb of the secondary batch card BC-2 is in the +Z direction. The card stacker 67*a* has an uplift structure configured to uplift a new secondary batch card BC-2 in the +Z direction and supply the new secondary batch card BC-2 into the card conveyer 67*b* whenever a secondary batch card BC-2 is discharged. The card conveyer 67*b* includes two driving motors 67*b*-1 and 67*b*-2 and rubber rollers (not shown). The rubber rollers sandwich an upper surface and a lower surface of the secondary batch card BC-2.

The card conveyer 67*b* rotatably drives the rubber rollers using the driving forces of the driving motors 67*b*-1 and 67*b*-2 and conveys the secondary batch card BC-2 uplifted by the card stacker 67*a* in the X direction. The card conveyer 67*b* conveys and discharges the secondary batch card BC-2 before dropping timing of the separated small bundles D. The bar code reader 67*d* reads the bar code BCb printed on the conveyed secondary batch card BC-2 by the bar code reader 67*d*. The bar code reader 67*d* decodes the bar code BCb based on the read image information and generates bar code information such as a strap number or the like. The support driver 67*e* has a driving motor (not shown) and drives the small bundle accumulation support 63 in the Z direction.

The feed controller 67*c* controls a pressing force on the secondary batch card BC-2 using the rubber rollers. In addition, the feed controller 67*c* drives a driving motor (not shown) to control the support driver 67*e*. The secondary batch card BC-2 is conveyed to a reading region of the bar code reader 67*d* under control of the feed controller 67*c*. The secondary batch card BC-2 is discharged to the small bundle shutter 61 after the bar code information is read.

Figure 53:
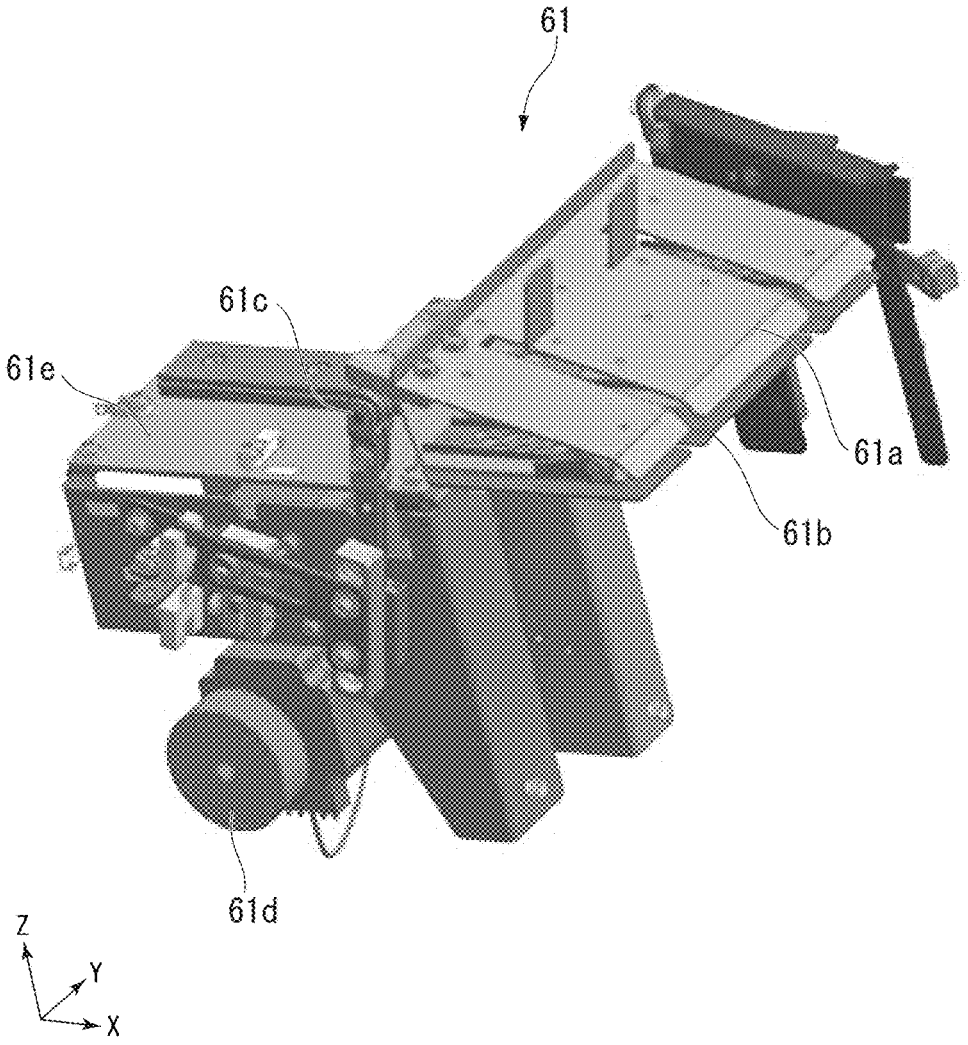
FIG. 53 is a perspective view of a small bundle shutter 61 of the paper sheets pre-processing apparatus 5 of the embodiment.
Figure 54:
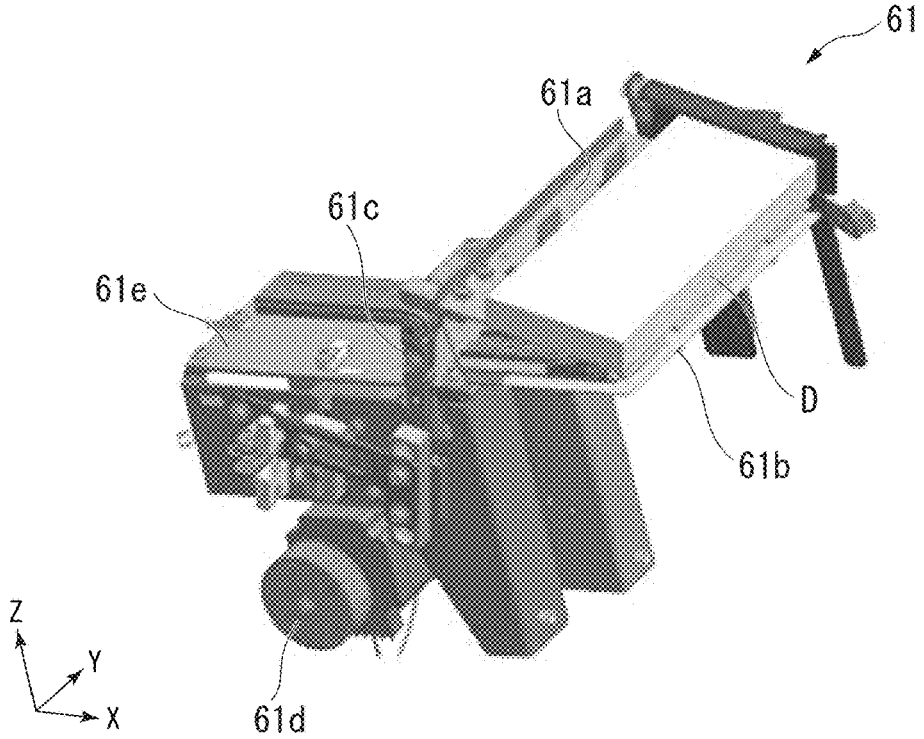
FIG. 54 is a perspective view showing an operation of the small bundle shutter 61 of the paper sheets pre-processing apparatus 5 of the embodiment.
Figure 55:
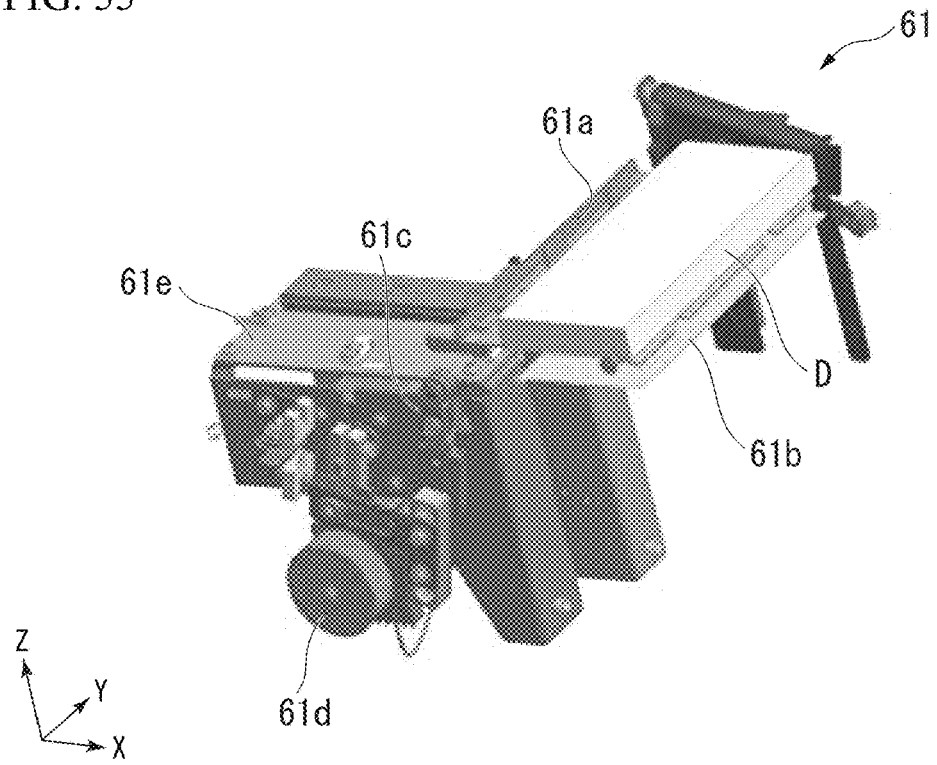
FIG. 55 is a perspective view showing the operation of the small bundle shutter 61 of the paper sheets pre-processing apparatus 5 of the embodiment.
Figure 56:
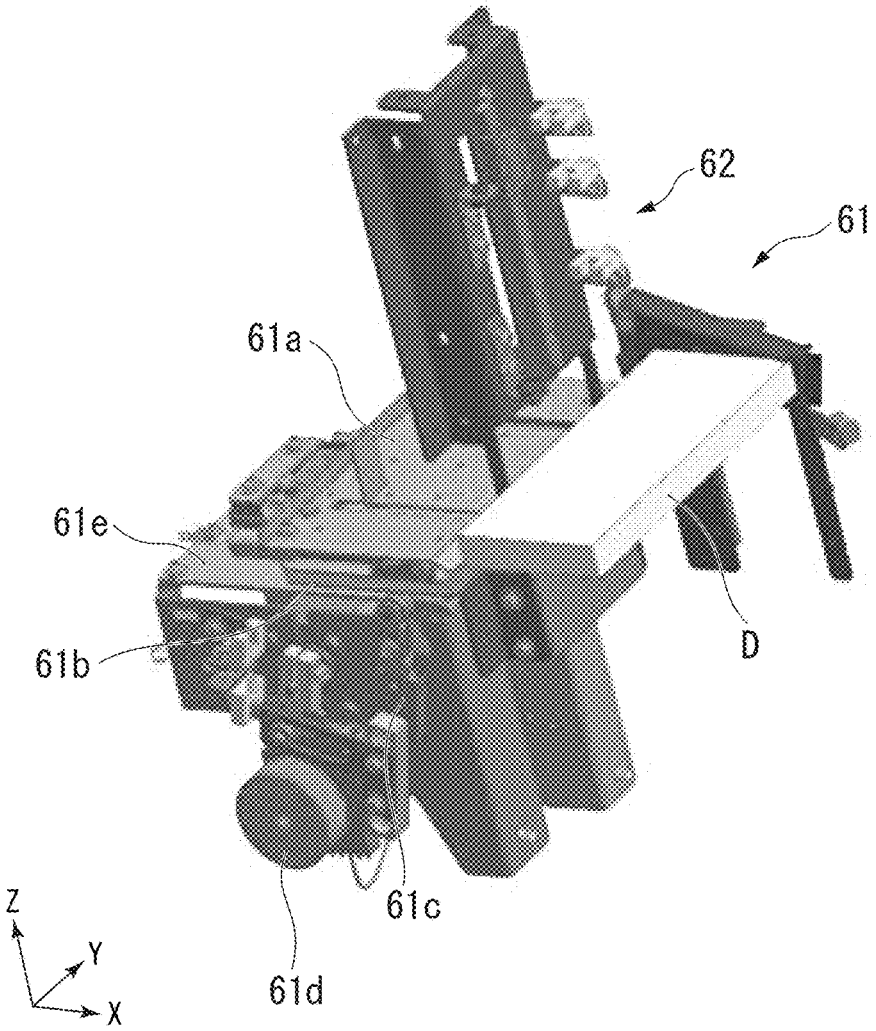
FIG. 56 is a perspective view showing the operation of the small bundle shutter 61 of the paper sheets pre-processing apparatus 5 of the embodiment.

FIG. 53 is a perspective view of the small bundle shutter 61 of the paper sheets pre-processing apparatus 5 of the embodiment. FIGS. 54, 55 and 56 are perspective views showing an operation of the small bundle shutter 61 of the paper sheets pre-processing apparatus 5 of the embodiment.

The small bundle shutter 61 catches the separated small bundles D freely dropped on the small bundle discharge position Pb. As shown in FIG. 55, the small bundle shutter 61 includes an upper shutter tray 61*a*, a lower shutter tray 61*b*, a tray driver 61*c*, a driving motor 61*d* and a tray withdrawer 61*e*. In a state shown in FIG. 55, the upper shutter tray 61*a* is disposed under the small bundle discharge position Pb. The upper shutter tray 61*a* is a reception surface configured to receive the separated small bundles D dropped by the small band remover 50. The reception surface of the upper shutter tray 61*a* is a horizontal surface (an XY plane) perpendicular to a dropping direction of the separated small bundles D. In the upper shutter tray 61*a*, the tray driver 61*c* is driven by the driving motor 61*d* and the reception surface is the XY plane.

The lower shutter tray 61*b* is installed at the −Z direction side of the upper shutter tray 61*a*. The end portions in the +X direction of the upper shutter tray 61*a* and the lower shutter tray 61*b* are connected by a hinge mechanism. Accordingly, the upper shutter tray 61*a* is switched between a state in which the upper shutter tray 61*a* is inclined with respect to the lower shutter tray 61*b* (see FIG. 53) and a state in which the upper shutter tray 61*a* comes in contact with the lower shutter tray 61*b* (see FIG. 54).

The tray driver 61*c* supports a place of the upper shutter tray 61*a* opposite to a place connected to the lower shutter tray 61*b* in the X direction. The tray driver 61*c* is driven to switch a positional relation between the upper shutter tray 61*a* and the lower shutter tray 61*b* to the inclined state and the contacted state. The tray driver 61*c* adjusts an inclined angle of the upper shutter tray 61*a* as the driving motor 61*d* is driven by a controller (not shown).

The tray withdrawer 61*e* has a driving mechanism (not shown) and moves the upper shutter tray 61*a* and the lower shutter tray 61*b* in the X direction. The tray withdrawer 61*e* moves the upper shutter tray 61*a* in the +X direction side as shown in FIGS. 53 and 54 when the separated small bundles D are received by the upper shutter tray 61*a*. The tray withdrawer 61*e* withdraws the upper shutter tray 61*a* in the −X direction as shown in FIG. 55 when the separated small bundles D are delivered to the small bundle accumulation support 63 by the upper shutter tray 61*a*.

The small bundle shutter 61 disposes the upper shutter tray 61*a* and the lower shutter tray 61*b* at the +X direction side as shown in FIG. 54 in a standby state of the separated small bundles D. In the standby state, the secondary batch card BC-2 is conveyed onto the upper shutter tray 61*a* from the Y direction side by the card stacker 67. The separated small bundles D pushed out in the +Y direction by the third sweeper 57 of the small band remover 50 are dropped onto the upper shutter tray 61*a*. The upper shutter tray 61*a* receives the separated small bundles D as shown in FIG. 54 when the separated small bundles D are dropped. Next, as shown in FIG. 55, the tray driver 61*c* is switched to the state in which the upper shutter tray 61*a* comes in contact with the lower shutter tray 61*b*. Accordingly, the separated small bundles D are inclined by a predetermined angle from a horizontal surface. As shown in FIG. 56, next, the tray withdrawer 61*e* withdraws the upper shutter tray 61*a* and the lower shutter tray 61*b* and drops the separated small bundles D and the secondary batch card BC-2. The small bundle shutter 61 accumulates the separated small bundles D on the small bundle accumulation support 63 as the operation is repeated.

Figure 57:
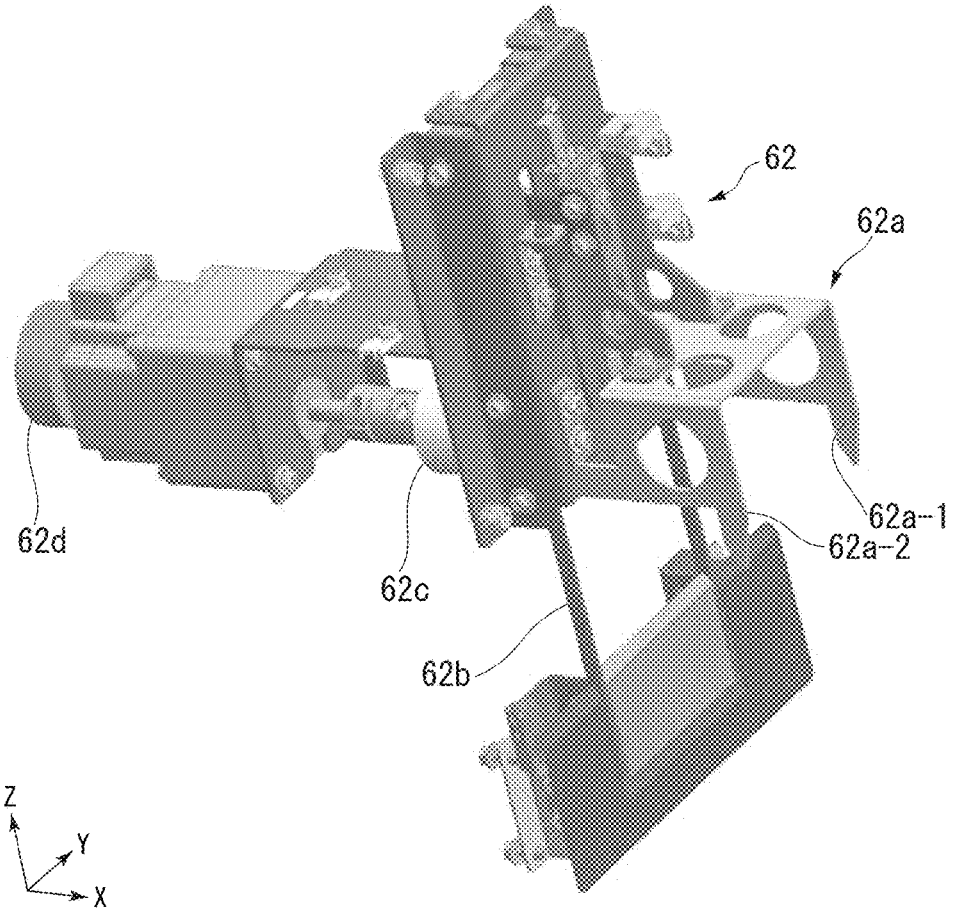
FIG. 57 is a perspective view of a small bundle press 62 of the paper sheets pre-processing apparatus 5 of the embodiment.
Figure 58:
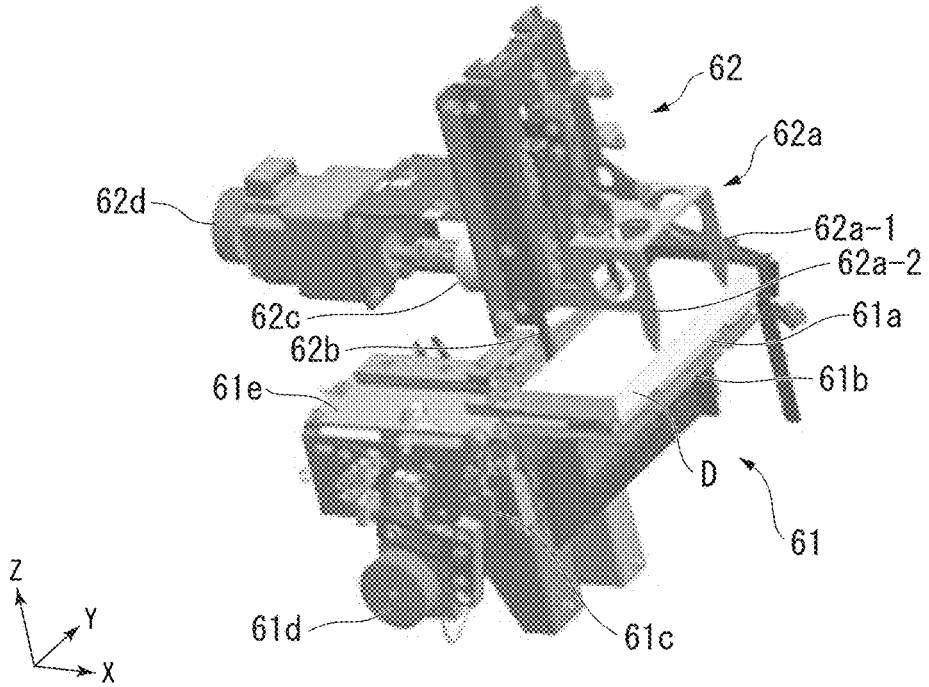
FIG. 58 is a perspective view showing an operation of the small bundle press 62 of the paper sheets pre-processing apparatus 5 of the embodiment.
Figure 59:
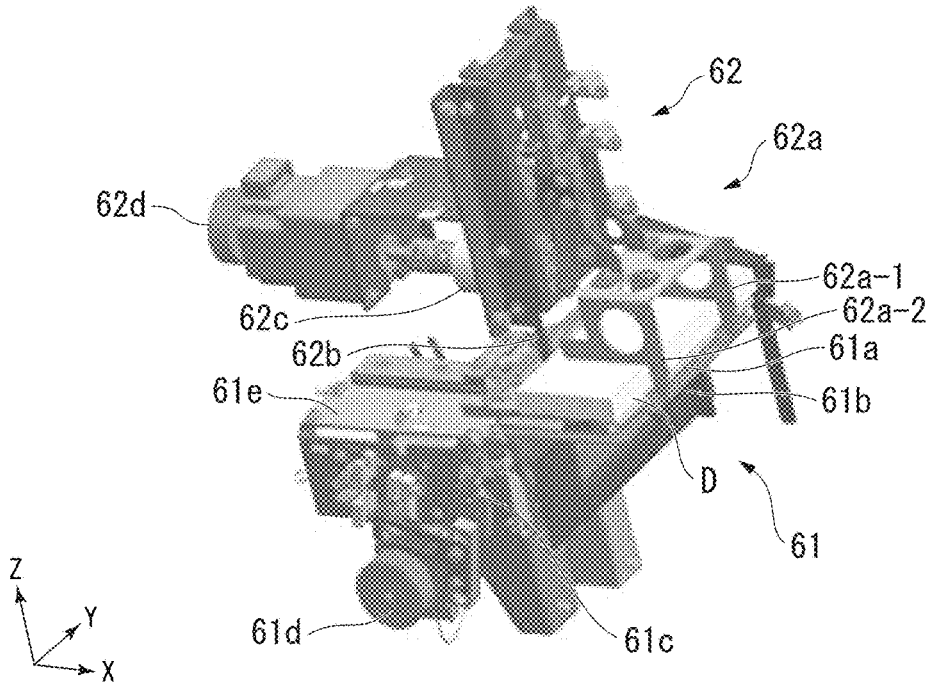
FIG. 59 is a perspective view showing the operation of the small bundle press 62 of the paper sheets pre-processing apparatus 5 of the embodiment.
Figure 60:
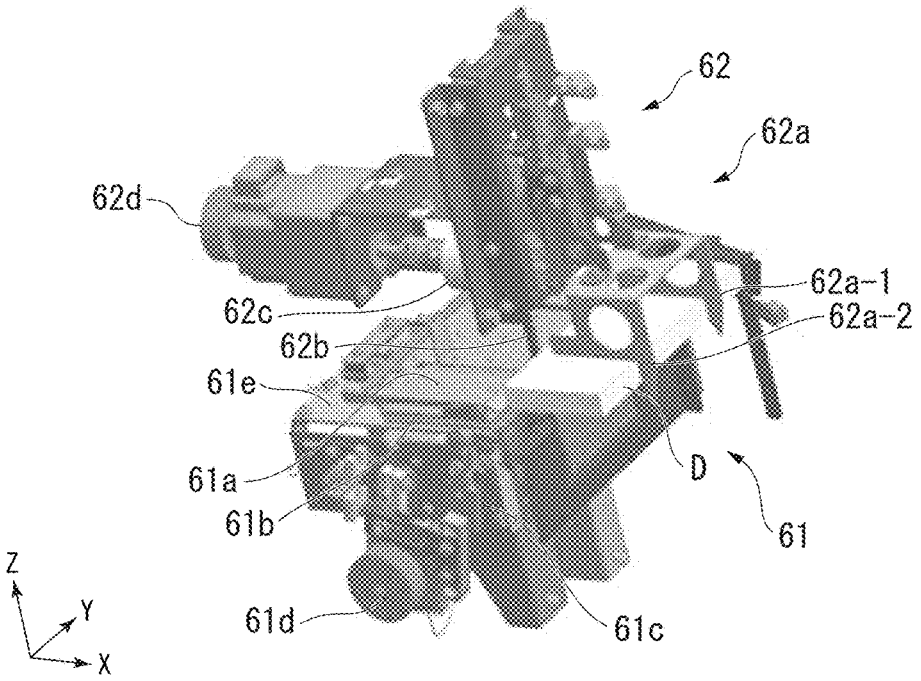
FIG. 60 is a perspective view showing the operation of the small bundle press 62 of the paper sheets pre-processing apparatus 5 of the embodiment.

FIG. 57 is a perspective view of the small bundle press 62 of the paper sheets pre-processing apparatus 5 of the embodiment. FIGS. 58, 59 and 60 are perspective views showing an operation of the small bundle press 62 of the paper sheets pre-processing apparatus 5 of the embodiment.

The small bundle press 62 supports a behavior of the separated small bundles D that are dropped when the separated small bundles D are accumulated.

As shown in FIG. 57, the small bundle press 62 includes a press arm 62*a*, a positioning shaft 62*b*, an electromagnetic clutch 62*c* and a vertically operated motor 62*d*. The press arm 62*a* holds the paper sheets P to prevent droppage thereof when the separated small bundles D are dropped. The press arm 62*a* has front end portions 62*a*-1 and 62*a*-2 configured to abut the side surfaces in the +X direction of the separated small bundles D at both ends in the Y direction. The positioning shaft 62*b* becomes a core structure with the upper shutter tray 61*a* and the lower shutter tray 61*b* in the X direction. The electromagnetic clutch 62*c* transmits power generated by the vertically operated motor 62*d* and moves the press arm 62*a* in an upward direction (the +Z direction).

The small bundle press 62 disposes the press arm 62*a* at a predetermined position on the small bundle shutter 61 in the standby state in which the separated small bundles D does not drop on the upper shutter tray 61*a*. Here, the vertically operated motor 62*d* transmits a driving torque to support the press arm 62*a* via the electromagnetic clutch 62*c*. The small bundle press 62 blocks power transmission of the electromagnetic clutch 62*c* when the separated small bundles D drop on the upper shutter tray 61*a*, and the upper shutter tray 61*a* and the lower shutter tray 61*b* come in contact as shown in FIG. 58. Then, as shown in FIG. 59, the press arm 62*a* drops on the separated small bundles D. Afterward, when the upper shutter tray 61*a* and the lower shutter tray 61*b* are withdrawn by the tray withdrawer 61*e*, as shown in FIG. 60, the press arm 62*a* drops together with the separated small bundles D and the secondary batch card BC-2. Accordingly, the press arm 62*a* prevents the paper sheets P from dropping from the separated small bundles D. In addition, the small bundle press 62 functions as a stopper of the separated small bundles D discharged from the small band remover 50 by the front end portions 62*a*-1 and 62*a*-2 of the press arm 62*a*.

The press arm 62*a* drops together with the separated small bundles D and is supported by the small bundle accumulation support 63. The press arm 62*a* is raised to a predetermined position on the upper shutter tray 61*a* after the press arm 62*a* drops on the small bundle accumulation support 63 and before the separated small bundles D drop on the upper shutter tray 61*a*. Accordingly, the small bundle press 62 accumulates the plurality of separated small bundles D on the small bundle accumulation support 63.

Figure 61:
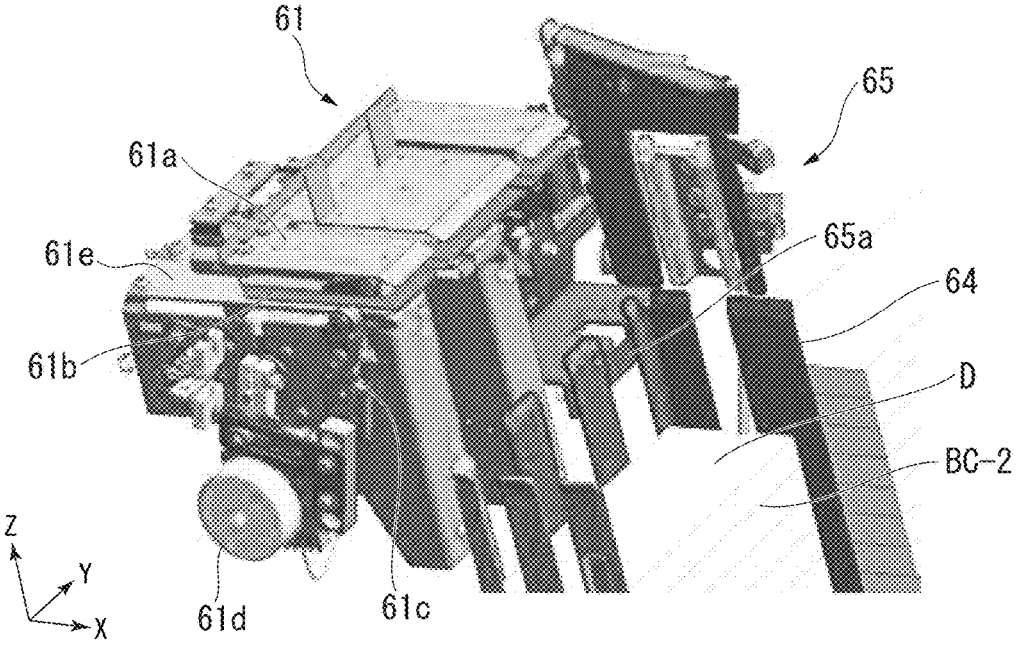
FIG. 61 is a perspective view showing an arranger 65 of a small bundle accumulator 60 in the paper sheets pre-processing apparatus 5 of the embodiment.

FIG. 61 is a perspective view showing the arranger 65 of the small bundle accumulator 60 of the paper sheets pre-processing apparatus 5 of the embodiment. The arranger 65 arranges positions of the separated small bundles D freely dropped on the small bundle transferor 64. The arranger 65 has a contact surface 65*a* formed in the −X direction of the small bundle transferor 64. The arranger 65 brings the contact surface 65*a* in contact with the separated small bundles D and the secondary batch card BC-2 in the small bundle transferor 64 using a driving mechanism (not shown) such as a solenoid or the like. The arranger 65 modifies positions of the separated small bundles D and the secondary batch card BC-2 in the small bundle transferor 64 using vibrations.

Figure 62:
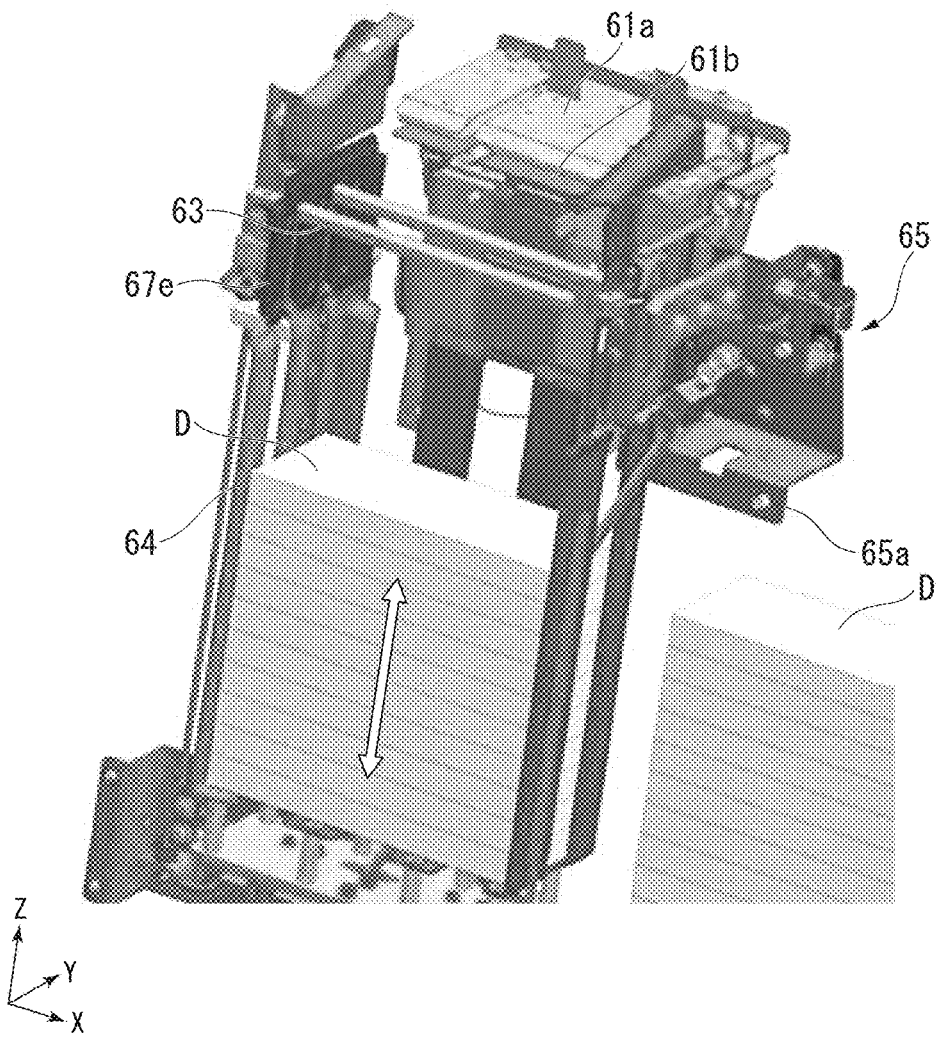
FIG. 62 is a perspective view showing a small bundle accumulation support 63 and a small bundle transferor 64 of the small bundle accumulator 60 in the paper sheets pre-processing apparatus 5 of the embodiment.

FIG. 62 is a perspective view showing the small bundle accumulation support 63 and the small bundle transferor 64 of the small bundle accumulator 60 in the paper sheets pre-processing apparatus 5 of the embodiment. The small bundle accumulation support 63 is moved in a vertical direction in the small bundle transferor 64 by the support driver 67*e*. The small bundle accumulation support 63 becomes a core structure with the small bundle transferor 64 in the Y direction. The small bundle accumulation support 63 lowers the separated small bundles D from an upper end position by a predetermined distance shown in FIG. 62 by catching the separated small bundles D. The small bundle accumulation support 63 catches the predetermined number (for example, ten) of separated small bundles D and the secondary batch card BC-2. The small bundle accumulation support 63 delivers the predetermined number of separated small bundles D and the secondary batch card BC-2 to the small bundle transferor 64. The small bundle accumulation support 63 slides, for example, in the −X direction to be accommodated in the card stacker 67 in a state in which the predetermined number of separated small bundles D and the secondary batch card BC-2 are accumulated. Afterward, the small bundle accumulation support 63 is raised to the upper end position and disposed at the upper end position under the small bundle shutter 61 again.

Figure 63:
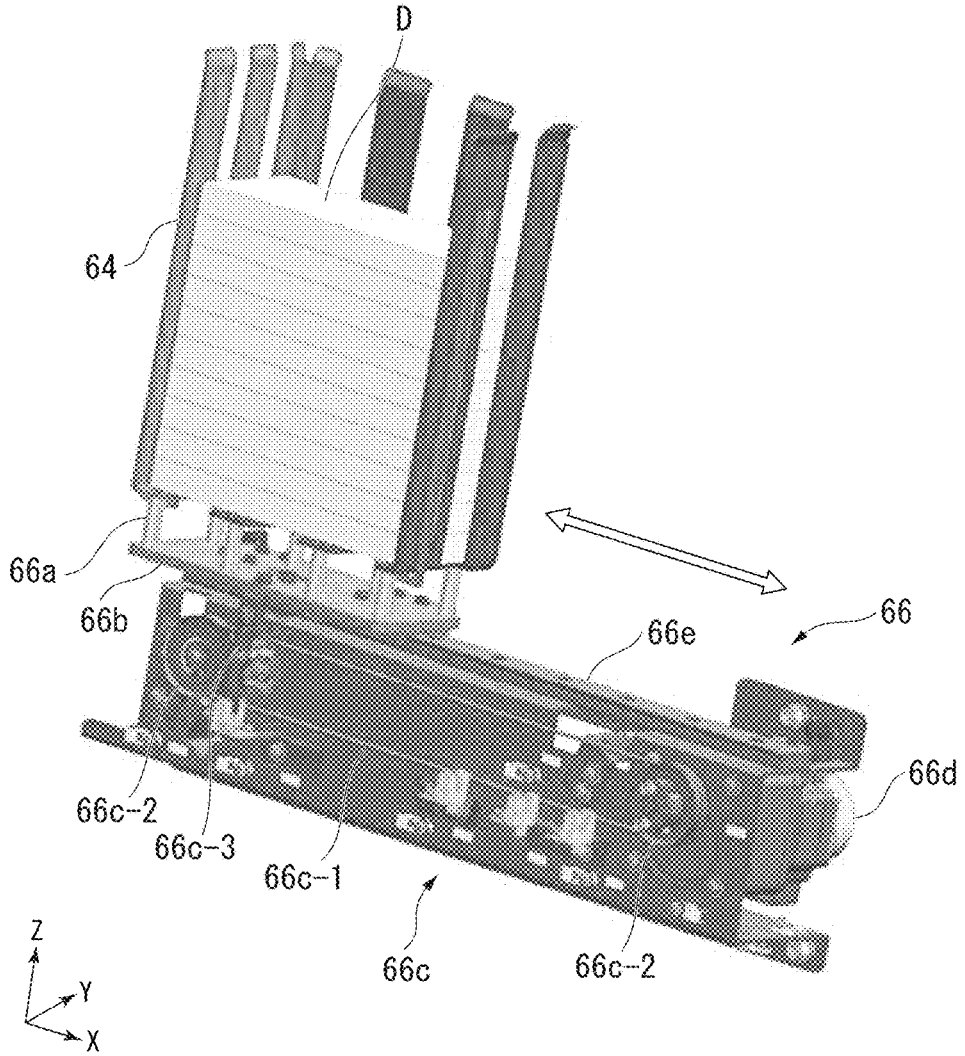
FIG. 63 is a perspective view showing the small bundle transferor 64 and a transfer driver 66 of the small bundle accumulator 60 in the paper sheets pre-processing apparatus 5 of the embodiment.

FIG. 63 is a perspective view showing the small bundle transferor 64 and the transfer driver 66 of the small bundle accumulator 60 in the paper sheets pre-processing apparatus 5 of the embodiment. The small bundle transferor 64 delivers the predetermined number of separated small bundles D from the small bundle accumulation support 63. The small bundle transferor 64 supports both sides in the X direction and the +Y direction side of the separated small bundles D and the lower surface of the separated small bundles D. The small bundle transferor 64 is moved in the X direction by the transfer driver 66.

The transfer driver 66 includes a transfer connecting section 66*a*, a support stage 66*b*, a driver 66*c*, a driving motor 66*d* and a slide rail 66*e*. The transfer connecting section 66*a* connects a lower portion of the small bundle transferor 64 and the support stage 66*b*. The support stage 66*b* has an upper surface connected to the small bundle transferor 64 by the transfer connecting section 66*a*, and a lower surface in which a concave rail reception section (not shown) assembled with the slide rail 66*e* is formed. The driver 66*c* includes a transfer belt 66*c*-1, a driving roller 66*c*-2 and a connecting section 66*c*-3. The driving roller 66*c*-2 is operated to receive a driving torque generated by the driving motor 66*d* and send the driving torque to the transfer belt 66*c*-1.

The connecting section 66*c*-3 is connected to a lower portion of the support stage 66*b*. The connecting section 66*c*-3 moves the support stage 66*b* along the slide rail 66*e* using a sending operation of the transfer belt 66*c*-1.

The transfer driver 66 is in a standby state in which the small bundle transferor 64 is disposed as described in FIG. 63 until the predetermined number of separated small bundles D and the secondary batch card BC-2 are accumulated. The transfer driver 66 slides the small bundle transferor 64 in the +X direction as the predetermined number of separated small bundles D and the secondary batch card BC-2 are accumulated. The transfer driver 66 slides the small bundle transferor 64 to a position at which the accumulated sheet supply 112 (the feeder guide FG) of the main body processing apparatus 100 is present. A feeder paddle becomes a core structure with the small bundle transferor 64. The feeder paddle receives the predetermined number of separated small bundles D and the secondary batch card BC-2 accumulated on the small bundle transferor 64, and installs the separated small bundles D and the secondary batch card BC-2 at the accumulated sheet supply 112 (the feeder guide FG) of the main body processing apparatus 100.

In the above-mentioned paper sheets pre-processing apparatus 5, the small bundle information that has decoded the strap number and the bar code SBb read by the secondary batch card BC-2 is stored in, for example, a storage (not shown) by an internal computer of the paper sheets pre-processing apparatus 5. The small bundle information that has decoded the stored strap number and bar code SBb is sent to the paper sheets comparison apparatus 300.

According to the at least one embodiment that has been described above, since the large band remover 20 configured to remove the large band Bw from the bundle B, the small bundle picker 40 configured to remove the small band SBw from the small bundle SB and the small bundle accumulator 60 configured to accumulate the plurality of paper sheets P, from which the small band SBw is removed, in a thickness direction are provided, a burden of removal of removal and the small band SBw of the large band Bw in the pre-processing in which the paper sheets P are input into the main body processing apparatus 100 can be reduced. In addition, according to the at least one embodiment, since removal of the large band Bw and removal of the small band SBw can be automatically performed, a waiting time in which the paper sheets P are input can be reduced with no necessity of stoppage of the pre-processing.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A paper sheets pre-processing apparatus comprising:

a large band remover configured to convey a bundle in which a plurality of paper sheets are bound by small bands and a predetermined number of small bundles are bound by a large band, and remove the large band from the bundle;

a small bundle coupler configured to convey the predetermined number of small bundles included in the bundle from which the large band is removed by the large band remover along a conveyance path, and couple the predetermined number of small bundles to each other;

a small band remover configured to separate a single small bundle from the plurality of small bundles coupled by the small bundle coupler and remove the small band from the small bundle; and an accumulator configured to accumulate the plurality of paper sheets from which the small band is removed by the small band remover in a thickness direction of the paper sheets;

wherein the large band remover comprises:

a deformer configured to deform a positional relation between the predetermined number of small bundles;

a large band cutter configured to cut the large band in a state in which the positional relation is deformed by the deformer; and a remover configured to remove the large band cut by the large band cutter; and wherein the remover sandwiches the large band cut by the large band cutter between a band removal roller and a clamp pin, and removes the large band cut by the large band cutter as the band removal roller is rotationally driven to pull the large band.

2. The paper sheets pre-processing apparatus according to claim 1, wherein the deformer comprises:

a first support configured to support both sides in a paper sheets accumulation direction of the predetermined number of small bundles; and a second support configured to support one side in a direction perpendicular to the paper sheets accumulation direction of the small bundle;

wherein the deformer is configured to press some small bundles among the predetermined number of small bundles from the other side with respect to the one side supported by the second support.

3. The paper sheets pre-processing apparatus according to claim 1, wherein the large band cutter is configured to move a space formed between the large band and the small bundle.

4. The paper sheets pre-processing apparatus according to claim 1, wherein the small band remover comprises:

a presser configured to press the small bundle in the paper sheets accumulation direction of the paper sheets;

a small band cutter disposed at one side in a direction perpendicular to the paper sheets accumulation direction of the paper sheets, configured to move in a long side direction of the paper sheets, and configured to cut the small band provided at the small bundle pressed by the presser; and a small band picker disposed at the other side of a direction perpendicular to the paper sheets accumulation direction of the paper sheets and configured to extract the small band cut by the small band cutter.

5. The paper sheets pre-processing apparatus according to claim 1, wherein the small band remover includes an information reader configured to read small bundle information displayed on the small band.

6. The paper sheets pre-processing apparatus according to claim 1, further comprising a card stacker configured to insert an identification card between the paper sheet serving as the small bundle, from which the small band is removed by the small band remover, wherein the accumulator accumulates the plurality of paper sheets into which the identification card is inserted between the paper sheet by the card inserter.

* * * * *